US011136648B2

(12) United States Patent
Oishi et al.

(10) Patent No.: US 11,136,648 B2
(45) **Date of Patent: *Oct. 5, 2021**

(54) FREE-CUTTING COPPER ALLOY, AND METHOD FOR PRODUCING FREE-CUTTING COPPER ALLOY

(71) Applicant: Mitsubishi Materials Corporation, Tokyo (JP)

(72) Inventors: Keiichiro Oishi, Osaka (JP); Kouichi Suzaki, Osaka (JP); Shinji Tanaka, Osaka (JP); Yoshiyuki Goto, Osaka (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/325,074

(22) PCT Filed: Aug. 15, 2017

(86) PCT No.: PCT/JP2017/029371

§ 371 (c)(1),
(2) Date: Feb. 12, 2019

(87) PCT Pub. No.: WO2018/034281

PCT Pub. Date: Feb. 22, 2018

(65) Prior Publication Data

US 2020/0123633 A1 Apr. 23, 2020

(30) Foreign Application Priority Data

Aug. 15, 2016 (JP) ..... JP2016-159238

(51) Int. Cl.

| | |
|---|---|
| ***C22C 9/04*** | (2006.01) |
| ***C22F 1/08*** | (2006.01) |
| ***C22F 1/00*** | (2006.01) |

(52) U.S. Cl.
CPC ..... *C22C 9/04* (2013.01); *C22F 1/002* (2013.01); *C22F 1/08* (2013.01)

(58) Field of Classification Search
None
See application file for complete search history.

(56) References Cited

U.S. PATENT DOCUMENTS

| | | | |
|---|---|---|---|
| 4,055,445 | A | 10/1977 | Pops |
| 5,865,910 | A | 2/1999 | Bhargava |

(Continued)

FOREIGN PATENT DOCUMENTS

| | | | |
|---|---|---|---|
| CA | 2 582 972 | A1 | 4/2006 |
| EP | 1 045 041 | A1 | 10/2000 |

(Continued)

OTHER PUBLICATIONS

Mima, Genjiro, et al., Journal of the Japan Copper and Brass Research Association, 2 (1963) p. 62-77, with partial tanslation.

(Continued)

*Primary Examiner* — Anthony M Liang
(74) *Attorney, Agent, or Firm* — Merchant & Gould P.C.

(57) ABSTRACT

This free-cutting copper alloy contains 76.0%-79.0% Cu, 3.1%-3.6% Si, 0.36%-0.84% Sn, 0.06%-0.14% P, 0.022%-0.10% Pb, with the remainder being made up of Zn and unavoidable impurities. The composition satisfies the following relations: $74.4 \leq f1 = Cu + 0.8 \times Si - 8.5 \times Sn + P + 0.5 \times Pb \leq 78.2$, $61.2 \leq f2 = Cu - 4.4 \times Si - 0.7 \times Sn - P + 0.5 \times Pb \leq 62.8$, $0.09 \leq f3 = P/Sn \leq 0.35$. The area ratio (%) of the constituent phases satisfies the following relations: $30 \leq \kappa \leq 65$, $0 \leq \gamma \leq 2.0$, $0 \leq \beta \leq 0.3$, $0 \leq \mu \leq 2.0$, $96.5 \leq f4 = \alpha + \kappa$, $99.4 \leq f5 = \alpha + \kappa + \gamma + \mu$, $0 \leq f6 = \gamma + \mu \leq 3.0$, $36 \leq f7 = 1.05 \times \kappa + 6 \times \gamma^{1/2} + 0.5 \times \mu \leq 72$. The κ phase is present within the α phase, the long side of the γ phase does not exceed 50 μm, and the long side of the μ phase does not exceed 25 μm.

16 Claims, 3 Drawing Sheets

(56) References Cited

U.S. PATENT DOCUMENTS

| | | | |
|---|---|---|---|
| 2002/0159912 | A1 | 10/2002 | Oishi |
| 2007/0062615 | A1 | 3/2007 | Oishi |
| 2007/0169854 | A1 | 7/2007 | Oishi |
| 2007/0169855 | A1 | 7/2007 | Oishi |
| 2009/0297390 | A1 | 12/2009 | Hidenobu et al. |
| 2013/0276938 | A1 | 10/2013 | Oishi |
| 2013/0315660 | A1 | 11/2013 | Oishi |
| 2013/0319581 | A1 | 12/2013 | Oishi |
| 2014/0251488 | A1 | 9/2014 | Oishi et al. |
| 2016/0068931 | A1 | 3/2016 | Xu et al. |
| 2017/0211169 | A1 | 7/2017 | Hanaoka et al. |

FOREIGN PATENT DOCUMENTS

| | | | | |
|---|---|---|---|---|
| EP | 2 634 275 | A1 | | 9/2013 |
| JP | 7-508560 | A | | 9/1995 |
| JP | 2000-119774 | A | | 4/2000 |
| JP | 2000-119775 | A | | 4/2000 |
| JP | 2004-263301 | A | | 9/2004 |
| JP | 2008-516081 | A | | 5/2008 |
| JP | 2008-214760 | A | | 9/2008 |
| JP | 2009-509031 | A | | 3/2009 |
| JP | 2013104071 | A | * | 3/2013 |
| JP | 2013-104071 | A | | 5/2013 |
| JP | 2016-511792 | A | | 4/2016 |
| WO | 94/01591 | A1 | | 1/1994 |
| WO | 2006/016442 | A1 | | 2/2006 |
| WO | 2006/016624 | A1 | | 2/2006 |
| WO | 2007/034571 | A1 | | 3/2007 |
| WO | 2008/081947 | A1 | | 7/2008 |
| WO | 2012/057055 | A1 | | 5/2012 |
| WO | 2013/065830 | A1 | | 5/2013 |
| WO | 2015/166998 | A1 | | 11/2015 |
| WO | 2018/034280 | A1 | | 2/2018 |
| WO | 2018/034282 | A1 | | 2/2018 |
| WO | 2018/034283 | A1 | | 2/2018 |
| WO | 2018/034284 | A1 | | 2/2018 |
| WO | 2019/035224 | A1 | | 2/2019 |
| WO | 2019/035225 | A1 | | 2/2019 |
| WO | 2019/035226 | A1 | | 2/2019 |

OTHER PUBLICATIONS

International Search Report issued in application PCT/JP2017/029374, completed Oct. 30, 2017 and dated Nov. 7, 2017.
Office Action issued in Japanese application No. 2017-567262 dated Mar. 26, 2018, with machine translation.
International Search Report issued in application PCT/JP2017/029369, completed Oct. 30, 2017 and dated Nov. 7, 2017.
International Search Report issued in application PCT/JP2017/029376, completed Oct. 30, 2017 and dated Nov. 7, 2017.
Office Action issued in Japanese application No. 2017-567267 dated Mar. 26, 2018, with machine translation.
International Search Report issued in application PCT/JP2017/029371, completed Oct. 30, 2017 and dated Nov. 7, 2017.
Office Action issued in Japanese application No. 2017-567265 dated Mar. 26, 2018, with machine translation.
International Search Report issued in application PCT/JP2017/029373, completed Oct. 30, 2017 and dated Nov. 7, 2017.
International Search Report issued in application PCT/JP2018/006203, completed Apr. 26, 2018 and dated May 15, 2018.
International Search Report issued in application PCT/JP2018/006218, completed Apr. 26, 2018 and dated May 15, 2018.
International Search Report issued in application PCT/JP2018/006245, completed Apr. 26, 2018 and dated May 15, 2018.
Extended European Search Report issued in co-pending application 18846602.3 completed on Jun. 15, 2020 and dated Jun. 26, 2020.
JCBAT204 : Sep. 12, 2005 "Lead-less free-cutting brass bar", Japan Copper and Brass Association technical standard, with computer translation.
Office Action issued in co-pending Japanese application 2018-530923, dated Aug. 7, 2018, with Machine translation obtained by Global Dossier on May 8, 2019.
Opposition issued in co-pending Japanese application 2017-567267 on May 5, 2019 with computer translation.
Opposition issued in co-pending Japanese application 2017-567265 on May 27, 2019 with computer translation.
Opposition issued in co-pending Japanese application 2017-567266 on May 27, 2019 with computer translation.
Opposition issued in co-pending Japanese application 2017-567267 on March 5, 2019 with computer translation.
Opposition issued in co-pending Japanese application 2017-567265 on Mar. 27, 2019 with computer translation.
Opposition issued in co-pending Japanese application 2017-567266 on Mar. 27, 2019 with computer translation.
Office Action issued in co-pending U.S. Appl. No. 16/274,622 dated Aug. 26, 2019.
Office Action issued in Indian Patent Application 201917005548 dated Jan. 6, 2021.
Office Action issued in U.S. Appl. No. 16/324,684 dated Dec. 22, 2020.
Office Action issued in co-pending related U.S. Appl. No. 16/325,029 dated Oct. 27, 2020.

* cited by examiner

CROSS-SECTION OF TEST No.T401
AFTER USE IN HARSH WATER ENVIRONMENT FOR 8 YEARS (a)

CROSS-SECTION OF TEST No.T402
AFTER DEZINCIFICATION CORROSION TEST 1

(b)

CROSS-SECTION OF TEST No.T88
AFTER DEZINCIFICATION CORROSION TEST 1

(c)

FREE-CUTTING COPPER ALLOY, AND METHOD FOR PRODUCING FREE-CUTTING COPPER ALLOY

This is a National Phase Application in the United States of International Patent Application No. PCT/JP2017/029371 filed Aug. 15, 2017, which claims priority on Japanese Patent Application No. 2016-159238, filed Aug. 15, 2016. The entire disclosures of the above patent applications are hereby incorporated by reference.

TECHNICAL FIELD

The present invention relates to a free-cutting copper alloy having excellent corrosion resistance, excellent impact resistance, high strength, and high-temperature strength (high-temperature creep) in which the lead content is significantly reduced, and a method of manufacturing the free-cutting copper alloy. In particular, the present invention relates to a free-cutting copper alloy for use in devices used for drinking water consumed by a person or an animal every day such as faucets, valves, or fittings as well as valves, fittings and the like for electrical uses, automobiles, machines, and industrial plumbing, used in harsh environments where fluid flows at a high velocity, and a method of manufacturing the free-cutting copper alloy.

Priority is claimed on Japanese Patent Application No. 2016-159238, filed on Aug. 15, 2016, the content of which is incorporated herein by reference.

BACKGROUND ART

Conventionally, as a copper alloy that is used in devices for drinking water and valves, fittings and the like for electrical uses, automobiles, machines, and industrial plumbing, a Cu—Zn—Pb alloy including 56 to 65 mass % of Cu, 1 to 4 mass % of Pb, and a balance of Zn (so-called free-cutting brass), or a Cu—Sn—Zn—Pb alloy including 80 to 88 mass % of Cu, 2 to 8 mass % of Sn, 2 to 8 mass % of Pb, and a balance of Zn (so-called bronze: gunmetal) was generally used.

However, recently, Pb's influence on a human body or the environment is a concern, and a movement to regulate Pb has been extended in various countries. For example, a regulation for reducing the Pb content in drinking water supply devices to be 0.25 mass % or lower has come into force from January, 2010 in California, the United States and from January, 2014 across the United States. In addition, it is said that a regulation for reducing the amount of Pb leaching from the drinking water supply devices to about 5 mass ppm will come into force in the future. In countries other than the United States, a movement of the regulation has become rapid, and the development of a copper alloy material corresponding to the regulation of the Pb content has been required.

In addition, in other industrial fields such as automobiles, machines, and electrical and electronic apparatuses industries, for example, in ELV regulations and RoHS regulations of the Europe, free-cutting copper alloys are exceptionally allowed to contain 4 mass % Pb. However, as in the field of drinking water, strengthening of regulations on Pb content including elimination of exemptions has been actively discussed.

Under the trend of the strengthening of the regulations on Pb in free-cutting copper alloys, copper alloys that includes Bi or Se having a machinability improvement function instead of Pb, or Cu—Zn alloys including a high concentration of Zn in which the amount of β phase is increased to improve machinability have been proposed.

For example, Patent Document 1 discloses that corrosion resistance is insufficient with mere addition of Bi instead of Pb, and proposes a method of slowly cooling a hot extruded rod to 180° C. after hot extrusion and further performing a heat treatment thereon in order to reduce the amount of β phase to isolate β phase.

In addition, Patent Document 2 discloses a method of improving corrosion resistance by adding 0.7 to 2.5 mass % of Sn to a Cu—Zn—Bi alloy to precipitate γ phase of a Cu—Zn—Sn alloy.

However, the alloy including Bi instead of Pb as disclosed in Patent Document 1 has a problem in corrosion resistance. In addition, Bi has many problems in that, for example, Bi may be harmful to a human body as with Pb, Bi has a resource problem because it is a rare metal, and Bi embrittles a copper alloy material. Further, even in cases where β phase is isolated to improve corrosion resistance by performing slow cooling or a heat treatment after hot extrusion as disclosed in Patent Documents 1 and 2, corrosion resistance is not improved at all in a harsh environment.

In addition, even in cases where γ phase of a Cu—Zn—Sn alloy is precipitated as disclosed in Patent Document 2, this γ phase has inherently lower corrosion resistance than α phase, and corrosion resistance is not improved at all in a harsh environment. In addition, in Cu—Zn—Sn alloys, γ phase including Sn has a low machinability improvement function, and thus it is also necessary to add Bi having a machinability improvement function.

On the other hand, regarding copper alloys including a high concentration of Zn, β phase has a lower machinability function than Pb. Therefore, such copper alloys cannot be replacement for free-cutting copper alloys including Pb. In addition, since the copper alloy includes a large amount of β phase, corrosion resistance, in particular, dezincification corrosion resistance or stress corrosion cracking resistance is extremely poor. In addition, these copper alloys have a low strength under high temperature (for example, 150° C.), and thus cannot realize a reduction in thickness and weight, for example, in automobile components used under high temperature near the engine room when the sun is blazing, or in plumbing pipes used under high temperature and high pressure.

Further, Bi embrittles copper alloy, and when a large amount of β phase is contained, ductility deteriorates. Therefore, copper alloy including Bi or a large amount of β phase is not appropriate for components for automobiles or machines, or electrical components or for materials for drinking water supply devices such as valves. Regarding brass including γ phase in which Sn is added to a Cu—Zn alloy, Sn cannot improve stress corrosion cracking, strength under high temperature is low, and impact resistance is poor. Therefore, the brass is not appropriate for the above-described uses.

On the other hand, for example, Patent Documents 3 to 9 disclose Cu—Zn—Si alloys including Si instead of Pb as free-cutting copper alloys.

The copper alloys disclosed in Patent Documents 3 and 4 have an excellent machinability without containing Pb or containing only a small amount of Pb that is mainly realized by superb machinability-improvement function of γ phase. Addition of 0.3 mass % or higher of Sn can increase and promote the formation of γ phase having a function to improve machinability. In addition, Patent Documents 3 and 4 disclose a method of improving corrosion resistance by forming a large amount of γ phase.

In addition, Patent Document 5 discloses a copper alloy including an extremely small amount of 0.02 mass % or lower of Pb having excellent machinability that is mainly realized by defining the total area of γ phase and κ phase. Here, Sn functions to form and increase γ phase such that erosion-corrosion resistance is improved.

Further, Patent Documents 6 and 7 propose a Cu—Zn—Si alloy casting. The documents disclose that in order to refine crystal grains of the casting, an extremely small amount of Zr is added in the presence of P, and the P/Zr ratio or the like is important.

In addition, in Patent Document 8, proposes a copper alloy in which Fe is added to a Cu—Zn—Si alloy is proposed.

Further, Patent Document 9, proposes a copper alloy in which Sn, Fe, Co, Ni, and Mn are added to a Cu—Zn—Si alloy.

Here, in Cu—Zn—Si alloys, it is known that, even when looking at only those having Cu concentration of 60 mass % or higher, Zn concentration of 30 mass % or lower, and Si concentration of 10 mass % or lower as described in Patent Document 10 and Non-Patent Document 1, 10 kinds of metallic phases including matrix α phase, β phase, γ phase, δ phase, ε phase, ζ phase, η phase, κ phase, μ phase, and χ phase, in some cases, 13 kinds of metallic phases including α', β', and γ' in addition to the 10 kinds of metallic phases are present. Further, it is empirically known that, as the number of additive elements increases, the metallographic structure becomes complicated, or a new phase or an intermetallic compound may appear. In addition, it is also empirically known that there is a large difference in the constitution of metallic phases between an alloy according to an equilibrium diagram and an actually produced alloy. Further, it is well known that the composition of these phases may change depending on the concentrations of Cu, Zn, Si, and the like in the copper alloy and processing heat history.

Apropos, γ phase has excellent machinability but contains high concentration of Si and is hard and brittle. Therefore, when a large amount of γ phase is contained, problems arise in corrosion resistance, ductility, impact resistance, high-temperature strength (high temperature creep), and the like in a harsh environment. Therefore, use of Cu—Zn—Si alloys including a large amount of γ phase is also restricted like copper alloys including Bi or a large amount of β phase.

Incidentally, the Cu—Zn—Si alloys described in Patent Documents 3 to 7 exhibit relatively satisfactory results in a dezincification corrosion test according to ISO-6509. However, in the dezincification corrosion test according to ISO-6509, in order to determine whether or not dezincification corrosion resistance is good or bad in water of ordinary quality, the evaluation is merely performed after a short period of time of 24 hours using a reagent of cupric chloride which is completely unlike water of actual water quality. That is, the evaluation is performed for a short period of time using a reagent which only provides an environment that is different from the actual environment, and thus corrosion resistance in a harsh environment cannot be sufficiently evaluated.

In addition, Patent Document 8 proposes that Fe is added to a Cu—Zn—Si alloy. However, Fe and Si form an Fe—Si intermetallic compound that is harder and more brittle than γ phase. This intermetallic compound has problems like reduced tool life of a cutting tool during cutting and generation of hard spots during polishing such that the external appearance is impaired. In addition, since Si is consumed when the intermetallic compound is formed, the performance of the alloy deteriorates.

Further, in Patent Document 9, Sn, Fe, Co, and Mn are added to a Cu—Zn—Si alloy. However, each of Fe, Co, and Mn combines with Si to form a hard and brittle intermetallic compound. Therefore, such addition causes problems during cutting or polishing as disclosed by Document 8. Further, according to Patent Document 9, β phase is formed by addition of Sn and Mn, but 3 phase causes serious dezincification corrosion and causes stress corrosion cracking to occur more easily.

RELATED ART DOCUMENT

Patent Document

[Patent Document 1] JP-A-2008-214760
[Patent Document 2] WO2008/081947
[Patent Document 3] JP-A-2000-119775
[Patent Document 4] JP-A-2000-119774
[Patent Document 5] WO2007/034571
[Patent Document 6] WO2006/016442
[Patent Document 7] WO2006/016624
[Patent Document 8] JP-T-2016-511792
[Patent Document 9] JP-A-2004-263301
[Patent Document 10] U.S. Pat. No. 4,055,445

Non-Patent Document

[Non-Patent Document 1] Genjiro MIMA, Masaharu HASEGAWA, Journal of the Japan Copper and Brass Research Association, 2 (1963), p. 62 to 77

SUMMARY OF THE INVENTION

Problem that the Invention is to Solve

The present invention has been made in order to solve the above-described problems of the related art, and an object thereof is to provide a free-cutting copper alloy having excellent corrosion resistance in fluid having a high flow rate in a strict water quality environment, impact resistance, and high-temperature strength, and a method of manufacturing the free-cutting copper alloy. In this specification, unless specified otherwise, corrosion resistance refers to dezincification corrosion resistance.

In order to achieve the object by solving the problems, a free-cutting copper alloy according to the first aspect of the present invention includes:

76.0 mass % to 79.0 mass % of Cu;
3.1 mass % to 3.6 mass % of Si;
0.36 mass % to 0.84 mass % of Sn;
0.06 mass % to 0.14 mass % of P;
0.022 mass % to 0.10 mass % of Pb; and
a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$74.4 \leq f1=[Cu]+0.8\times[Si]-8.5\times[Sn]+[P]+0.5\times[Pb] \leq 78.2,$$

$$61.2 \leq f2=[Cu]-4.4\times[Si]-0.7\times[Sn]-[P]+0.5\times[Pb] \leq 62.8,$$

and $$0.09 \leq f3=[P]/[Sn] \leq 0.35$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$30 \leq (\kappa) \leq 65,$$

$$0 \leq (\gamma) \leq 2.0,$$

$$0 \leq (\beta) \leq 0.3,$$

$$0 \leq (\mu) \leq 2.0,$$

$$96.5 \leq f4=(\alpha)+(\kappa),$$

$$99.4 \leq f5=(\alpha)+(\kappa)+(\gamma)+(\mu),$$

$$0 \leq f6=(\gamma)+(\mu) \leq 3.0, \text{ and}$$

$$36 \leq f7=1.05\times(\kappa)+6\times(\gamma)^{1/2}+0.5\times(\mu) \leq 72$$

are satisfied,

κ phase is present in α phase, the length of the long side of γ phase is 50 μm or less, and the length of the long side of μ phase is 25 μm or less.

According to the second aspect of the present invention, the free-cutting copper alloy according to the first aspect further includes one or more element(s) selected from the group consisting of 0.02 mass % to 0.08 mass % of Sb, 0.02 mass % to 0.08 mass % of As, and 0.02 mass % to 0.20 mass % of Bi.

A free-cutting copper alloy according to the third aspect of the present invention includes:

76.5 mass % to 78.7 mass % of Cu;

3.15 mass % to 3.55 mass % of Si;

0.41 mass % to 0.78 mass % of Sn;

0.06 mass % to 0.13 mass % of P;

0.023 mass % to 0.07 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$74.6 \leq f1=[Cu]+0.8\times[Si]-8.5\times[Sn]+[P]+0.5\times[Pb] \leq 77.8,$$

$$61.45 \leq f2=[Cu]-4.4\times[Si]-0.7\times[Sn]-[P]+0.5\times[Pb] \leq 62.6,$$

and $$0.1 \leq f3=[P]/[Sn] \leq 0.3$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$33 \leq (\kappa) \leq 62,$$

$$0 \leq (\gamma) \leq 1.5,$$

$$0 \leq (\beta) \leq 0.2,$$

$$0 \leq (\mu) \leq 1.0,$$

$$97.5 \leq f4=(\alpha)+(\kappa),$$

$$99.6 \leq f5=(\alpha)+(\kappa)+(\gamma)+(\mu),$$

$$0 \leq f6=(\gamma)+(\mu) \leq 2.0, \text{ and}$$

$$40 \leq f7=1.05\times(\kappa)+6\times(\gamma)^{1/2}+0.5\times(\mu) \leq 70$$

are satisfied,

κ phase is present in α phase, the length of the long side of γ phase is 40 μm or less, and the length of the long side of μ phase is 15 μm or less.

According to the fourth aspect of the present invention, the free-cutting copper alloy according to the third aspect further includes one or more element(s) selected from the group consisting of 0.02 mass % to 0.07 mass % of Sb, 0.02 mass % to 0.07 mass % of As, and 0.02 mass % to 0.10 mass % of Bi.

According to the fifth aspect of the present invention, in the free-cutting copper alloy according to any one of the first to fourth aspects of the present invention, a total amount of Fe, Mn, Co, and Cr as the inevitable impurities is lower than 0.08 mass %.

According to the sixth aspect of the present invention, in the free-cutting copper alloy according to any one of the first to fifth aspects of the present invention, the amount of Sn in κ phase is 0.40 mass % to 0.85 mass %, and the amount of P in κ phase is 0.07 mass % to 0.22 mass %.

According to the seventh aspect of the present invention, the free-cutting copper alloy according to any one of the first to sixth aspects of the present invention is made into a hot worked material, wherein a Charpy impact test value is 12 $J/cm^2$ to 45 $J/cm^2$, a tensile strength is 540 $N/mm^2$ or higher, and a creep strain after holding the material at 150° C. for 100 hours in a state where a load corresponding to 0.2% proof stress at room temperature is applied is 0.4% or lower. The Charpy impact test value is a value of a specimen having an U-shaped notch.

According to the eighth aspect of the present invention, the free-cutting copper alloy according to any one of the first to seventh aspects of the present invention is used in a water supply device, an industrial plumbing member, a device that comes in contact with liquid, or an automobile component that comes in contact with liquid.

According to the ninth aspect of the present invention, the method of manufacturing the free-cutting copper alloy according to any one of the first to eighth aspects of the present invention includes:

any one or both of a cold working step and a hot working step; and an annealing step that is performed after the cold working step or the hot working step, wherein in the annealing step, the material is held at a temperature of 510° C. to 575° C. for 20 minutes to 8 hours or is cooled in a temperature range from 575° C. to 510° C. at an average cooling rate of 0.1° C./min to 2.5° C./min, and subsequently the material is cooled in a temperature range from 470° C. to 380° C. at an average cooling rate of higher than 3° C./min and lower than 500° C./min.

According to the tenth aspect of the present invention, the method of manufacturing the free-cutting copper alloy according to any one of the first to eighth aspects of the present invention includes:

a hot working step, wherein the material's temperature during hot working is 600° C. to 740° C., wherein when hot extrusion is performed as the hot working, the material is cooled in a temperature range from 470° C. to 380° C. at an average cooling rate of higher than 3° C./min and lower than 500° C./min in the process of cooling, and wherein when hot forging is performed as the hot working, the material is cooled in a temperature range from 575° C. to 510° C. at an average cooling rate of 0.1° C./min to 2.5° C./min and subsequently is cooled in a temperature range from 470° C. to 380° C. at an average cooling rate of higher than 3° C./min and lower than 500° C./min in the process of cooling.

According to the eleventh aspect of the present invention, the method of manufacturing the free-cutting copper alloy according to any one of the first to eighth aspects of the present invention includes:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C.;

the heating time is in a range of 10 minutes to 300 minutes; and when the material's temperature is represented by T° C. and the heating time is represented by t min, $150 \leq (T-220) \times (t)^{1/2} \leq 1200$ is satisfied.

Advantage of the Invention

According to the aspects of the present invention, a metallographic structure is defined in which the amount of μ phase that is effective for machinability is reduced as much as possible and fine κ phase is present in α phase while minimizing the amount of γ phase that has an excellent machinability function but low corrosion resistance, impact resistance and high-temperature strength (high temperature creep). Further, a composition and a manufacturing method for obtaining this metallographic structure are defined. Therefore, according to the aspects of the present invention, it is possible to provide a free-cutting copper alloy having excellent machinability, corrosion resistance in a strict environment including high-speed fluid, cavitation resistance, erosion-corrosion resistance, normal-temperature strength, high-temperature strength, and wear resistance and a method of manufacturing the free-cutting copper alloy.

BEST MODE FOR CARRYING OUT THE INVENTION

Figure 1:
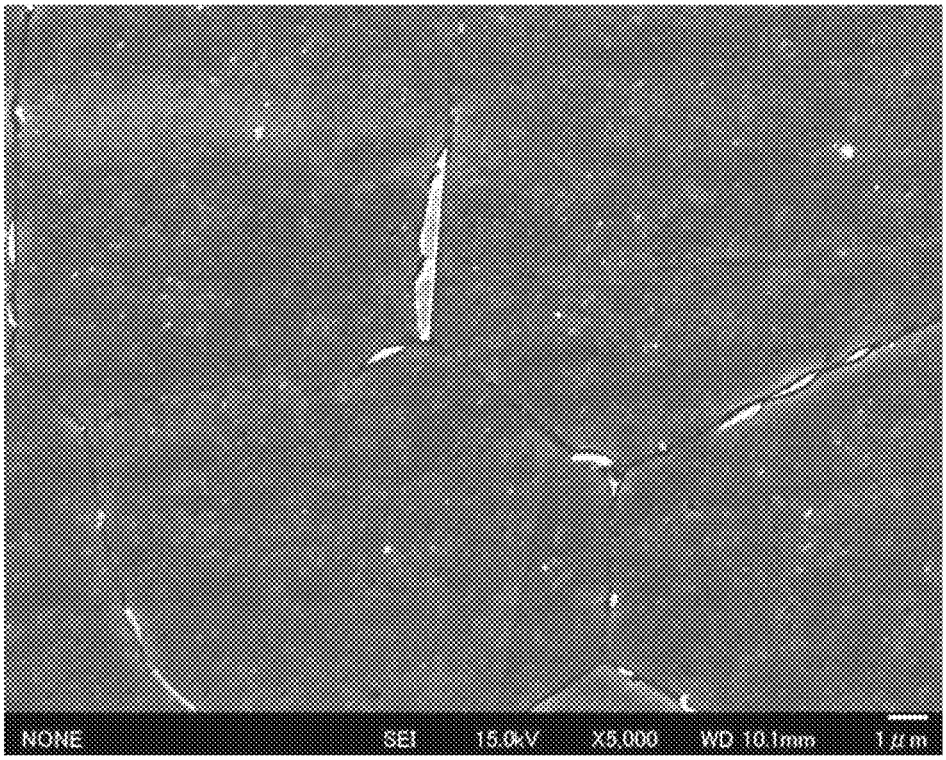
FIG. 1 is an electron micrograph of a metallographic structure of a free-cutting copper alloy (Test No. T123) according to Example 1.

Below is a description of free-cutting copper alloys according to the embodiments of the present invention and the methods of manufacturing the free-cutting copper alloys.

The free-cutting copper alloys according to the embodiments are for use in devices used for drinking water consumed by a person or an animal every day such as faucets, valves, or fittings, components for electrical uses, automobiles, machines and industrial plumbing such as valves or fittings, and devices and components that contact liquid.

Here, in this specification, an element symbol in parentheses such as [Zn] represents the content (mass %) of the element.

In the embodiment, using this content expressing method, a plurality of composition relational expressions are defined as follows.

Composition Relational Expression $f1=[Cu]+0.8\times[Si]-8.5\times[Sn]+[P]+0.5\times[Pb]$ Composition Relational Expression $f2=[Cu]-4.4\times[Si]-0.7\times[Sn]-[P]+0.5\times[Pb]$ Composition Relational Expression $f3=[P]/[Sn]$ Further, in the embodiments, in constituent phases of metallographic structure, an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%. Constituent phases of metallographic structure refer to α phase, γ phase, κ phase, and the like and do not include intermetallic compound, precipitate, non-metallic inclusion, and the like. In addition, the area ratio of κ phase present in α phase is included in the area ratio of α phase, and the area ratio of α' phase is included in that of α phase. The sum of the area ratios of all the constituent phases is 100%.

In the embodiments, a plurality of metallographic structure relational expressions are defined as follows.

Metallographic Structure Relational Expression $f4=(\alpha)+(\kappa)$

Metallographic Structure Relational Expression $f5=(\alpha)+(\kappa)+(\gamma)+(\mu)$ Metallographic Structure Relational Expression $f6=(\gamma)+(\mu)$ Metallographic Structure Relational Expression $f7=1.05\times(\kappa)+6\times(\gamma)^{1/2}+0.5\times(\mu)$ A free-cutting copper alloy according to a first embodiment of the present invention includes: 76.0 mass % to 79.0 mass % of Cu; 3.1 mass % to 3.6 mass % of Si; 0.36 mass % to 0.84 mass % of Sn; 0.06 mass % to 0.14 mass % of P; 0.022 mass % to 0.10 mass % of Pb; and a balance including Zn and inevitable impurities. The composition relational expression f1 is in a range of $74.4 \leq f1 \leq 78.2$, the composition relational expression f2 is in a range of $61.2 \leq f2 \leq 62.8$, and the composition relational expression f3 is in a range of $0.09 \leq f3 \leq 0.35$. The area ratio of κ phase is in a range of $30 \leq (\kappa) \leq 65$, the area ratio of γ phase is in a range of $0 \leq (\gamma) \leq 52.0$, the area ratio of β phase is in a range of $0 \leq (\beta) \leq 0.3$, and the area ratio of μ phase is in a range of $0 \leq (\mu) \leq 2.0$. The metallographic structure relational expression f4 is in a range of $f4 \geq 96.5$, the metallographic structure relational expression f5 is in a range of $f5 \geq 99.4$, the metallographic structure relational expression f6 is in a range of $0 \leq f6 \leq 3.0$, and the metallographic structure relational expression f7 is in a range of $36 \leq f7 \leq 72$. κ phase is present in α phase. A length of a long side of γ phase is 50 μm or less, and a length of a long side of μ phase is 25 μm or less.

A free-cutting copper alloy according to a second embodiment of the present invention includes: 76.5 mass % to 78.7 mass % of Cu; 3.15 mass % to 3.55 mass % of Si; 0.41 mass % to 0.78 mass % of Sn; 0.06 mass % to 0.13 mass % of P; 0.023 mass % to 0.07 mass % of Pb; and a balance including Zn and inevitable impurities. The composition relational expression f1 is in a range of $74.6 \leq f1 \leq 77.8$, the composition relational expression f2 is in a range of $61.4 \leq f2 \leq 62.6$, and the composition relational expression f3 is in a range of $0.1 \leq f3 \leq 0.3$. The area ratio of κ phase is in a range of $33 \leq (\kappa) \leq 62$, the area ratio of γ phase is in a range of $0 \leq (\gamma) \leq 1.5$, the area ratio of β phase is in a range of $0 \leq (\beta) \leq 0.2$, and the area ratio of μ phase is in a range of $0 \leq (\mu) \leq 1.0$. The metallographic structure relational expression f4 is in a range of $f4 \geq 97.5$, the metallographic structure relational expression f5 is in a range of $f5 \geq 99.6$, the metallographic structure relational expression f6 is in a range of $0 \leq f6 \leq 2.0$, and the metallographic structure relational expression f7 is in a range of $40 \leq f7 \leq 70$. κ phase is present in α phase. A length of a long side of γ phase is 40 μm or less, and a length of a long side of μ phase is 15 μm or less.

In addition, the free-cutting copper alloy according to the first embodiment of the present invention may further include one or more element(s) selected from the group consisting of 0.02 mass % to 0.08 mass % of Sb, 0.02 mass % to 0.08 mass % of As, and 0.02 mass % to 0.20 mass % of Bi.

In addition, the free-cutting copper alloy according to the second embodiment of the present invention may further include one or more element(s) selected from the group consisting of 0.02 mass % to 0.07 mass % of Sb, 0.02 mass % to 0.07 mass % of As, and 0.02 mass % to 0.10 mass % of Bi.

Further, in the free-cutting copper alloy according to the first or second embodiment of the present invention, it is preferable that the amount of Sn in κ phase is 0.40 mass % to 0.85 mass %, and it is preferable that the amount of P in κ phase is 0.07 mass % to 0.22 mass %.

Further, it is preferable that the free-cutting copper alloy according to the first or second embodiment of the present invention is a hot worked material, it is preferable that a Charpy impact test value of the hot worked material is 12 $J/cm^2$ to 45 $J/cm^2$, it is preferable that a tensile strength of the hot worked material is 540 $N/mm^2$ or higher, and it is preferable that a creep strain after holding the copper alloy at 150° C. for 100 hours in a state where 0.2% proof stress (load corresponding to 0.2% proof stress) at room temperature is applied is 0.4% or lower.

The reason why the component composition, the composition relational expressions f1, f2, and f3, the metallographic structure, the metallographic structure relational expressions f4, f5, f6 and f7, and the mechanical properties are defined as above is explained below.

<Component Composition>

(Cu)

Cu is a main element of the alloy according to the embodiment. In order to achieve the object of the present invention, it is necessary to add at least 76.0 mass % or higher of Cu. When the Cu content is lower than 76.0 mass %, the proportion of γ phase is higher than 2% although depending on the contents of Si, Zn, and Sn and the manufacturing process, and not only dezincification corrosion resistance but also stress corrosion cracking resistance, impact resistance, cavitation resistance, erosion-corrosion resistance, ductility, normal-temperature strength, and high temperature creep deteriorate. In some cases, β phase may also appear. Accordingly, the lower limit of the Cu content is 76.0 mass % or higher, preferably 76.5 mass % or higher, and more preferably 76.8 mass % or higher.

On the other hand, when the Cu content is higher than 79.0%, the effects on corrosion resistance, cavitation resistance, erosion-corrosion resistance, and strength are saturated, and the proportion of κ phase may be excessively high. In addition, μ phase having a high Cu concentration, in some cases, ζ phase and χ phase are likely to precipitate. As a result, machinability, impact resistance, ductility, and hot workability may deteriorate although depending on conditions of a metallographic structure. Accordingly, the upper limit of the Cu content is 79.0 mass % or lower, preferably 78.7 mass % or lower, and more preferably 78.5 mass % or lower.

(Si)

Si is an element necessary for obtaining most of excellent properties of the alloy according to the embodiment. Si contributes the formation of metallic phases such as κ phase, γ phase, or μ phase. Si improves machinability, corrosion resistance, stress corrosion cracking resistance, cavitation resistance, erosion-corrosion resistance, wear resistance, normal-temperature strength, and high temperature properties of the alloy according to the embodiment. Regarding machinability, addition of Si does not substantially improve machinability of α phase. However, due to the presence of a phase such as γ phase, κ phase, or μ phase that is formed by addition of Si and is harder than α phase, excellent machinability can be obtained without addition of a large amount of Pb. However, as the proportion of the metallic phase such as γ phase or μ phase increases, ductility or impact resistance deteriorates. Corrosion resistance in a strict environment deteriorates. Further, a problem in high temperature creep properties for withstanding long-term use arises. Accordingly, it is necessary to define κ phase, γ phase, μ phase, and β phase described below to be in an appropriate range.

In addition, Si has an effect of significantly suppressing evaporation of Zn during melting or casting, and as the Si content increases, the specific gravity can be reduced.

In order to solve these problems of a metallographic structure and to satisfy all the properties, it is necessary to add 3.1 mass % or higher of Si although depending on the contents of Cu, Zn, Sn, and the like. The lower limit of the Si content is preferably 3.15 mass % or higher, more preferably 3.17 mass % or higher, and still more preferably 3.2 mass % or higher. At first, it is presumed that the Si content should be reduced in order to reduce the proportion of γ phase or μ phase having a high Si concentration.

However, as a result of a thorough study on a mixing ratio between Si and another element and the manufacturing process, it was found that it is necessary to define the lower limit of the Si content as described above. In addition, although depending on the content of another element and the composition relational expressions, elongated acicular κ phase can be made to precipitate in α phase due to addition of about 3% or higher of Si and manufacturing process conditions. α phase is strengthened by κ phase present in α phase, and tensile strength, high-temperature strength machinability, wear resistance, cavitation resistance, erosion-corrosion resistance, corrosion resistance, and impact resistance can be improved without deterioration of ductility.

On the other hand, when the Si content is excessively high, the amount of κ phase is excessively large, and ductility and impact resistance deteriorate. Therefore, the upper limit of the Si content is 3.6 mass % or lower, preferably 3.55 mass % or lower, and more preferably 3.5 mass % or lower.

(Zn)

Zn is a main element of the alloy according to the embodiments together with Cu and Si and is required for improving machinability, corrosion resistance, strength, and castability. Zn is included in the balance, but to be specific, the upper limit of the Zn content is about 20 mass % or lower, and the lower limit thereof is about 16.5 mass % or higher.

(Sn)

Sn significantly improves dezincification corrosion resistance, cavitation resistance, and erosion-corrosion resistance in a harsh environment and improves stress corrosion cracking resistance, machinability, and wear resistance. In a copper alloy including a plurality of metallic phases (constituent phases), there is a difference in corrosion resistance between the respective metallic phases. Even when the two phases that remain in the metallographic structure are α phase and κ phase, corrosion begins from a phase having lower corrosion resistance and progresses. Sn improves corrosion resistance of α phase having the highest corrosion resistance and improves corrosion resistance of κ phase having the second highest corrosion resistance at the same time. The amount of Sn distributed in κ phase is about 1.4 times the amount of Sn distributed in α phase. That is, the amount of Sn distributed in κ phase is about 1.4 times the amount of Sn distributed in α phase. As the amount of Sn in κ phase is more than α phase, corrosion resistance of κ phase improves more. Because of the larger Sn content in κ phase, there is little difference in corrosion resistance between α phase and κ phase. Alternatively, at least a difference in corrosion resistance between α phase and κ phase is reduced. Therefore, the corrosion resistance of the alloy significantly improves.

However, addition of Sn promotes the formation of γ phase or β phase. Sn itself does not have an excellent machinability function, but improves the machinability of the alloy by forming γ phase having excellent machinability. On the other hand, γ phase deteriorates alloy corrosion resistance, ductility, impact resistance, and high temperature properties. When the Sn content is about 0.5%, the amount of Sn distributed in γ phase is about 8 times to 16 times the amount of Sn distributed in α phase. That is, the amount of Sn distributed in γ phase is about 8 times to 16 times the amount of Sn distributed in α phase. γ phase including Sn improves corrosion resistance slightly more than γ phase not including Sn, which is insufficient. This way, addition of Sn to a Cu—Zn—Si alloy promotes the formation of γ phase although the corrosion resistance of κ phase and α phase is improved. In addition, a large amount of Sn is distributed in γ phase. Therefore, unless a mixing ratio between the essential elements of Cu, Si, P, and Pb is appropriately adjusted and an appropriate control of a metallographic structure state including the manufacturing process is performed, addition of Sn merely slightly improves the corrosion resistance of κ phase and α phase. Instead, an increase in γ phase causes deterioration in alloy corrosion resistance, ductility, impact resistance, and high temperature properties.

Regarding cavitation resistance and erosion-corrosion resistance, by increasing the Sn concentration in α phase and κ phase, α phase and κ phase are strengthened, and cavitation resistance, erosion-corrosion resistance, and wear resistance can be improved. Further, elongated κ phase present in α phase strengthens α phase and functions more effectively.

In addition, addition of Sn to κ phase improves the machinability of κ phase. This effect is further improved by addition of P and Sn.

This way, depending on a method of using Sn, corrosion resistance, normal-temperature strength, high temperature creep properties, impact resistance, cavitation resistance, erosion-corrosion resistance, and wear resistance are further improved. However, when the method of using Sn is not appropriate, an increase in γ phase causes deterioration in properties.

By performing a control of a metallographic structure including the relational expressions and the manufacturing process described below, a copper alloy having excellent properties can be prepared. In order to exhibit the above-described effect, the lower limit of the Sn content is necessarily 0.36 mass % or higher, preferably higher than 0.40 mass %, more preferably 0.41 mass % or higher, still more preferably 0.44 mass % or higher, and most preferably 0.47 mass % or higher.

On the other hand, when the Sn content is higher than 0.84 mass %, the proportion of γ phase increases regardless of any adjustment to the mixing ratio of the composition or to the manufacturing process. Alternatively, the amount of solid solution of Sn in κ phase is excessively large, and cavitation resistance and erosion-corrosion resistance are saturated. The presence of an excess amount of Sn in κ phase deteriorates toughness of κ phase, ductility, and impact resistance. The upper limit of the Sn content is 0.84 mass % or lower, preferably 0.78 mass % or lower, more preferably 0.74 mass % or lower, and most preferably 0.68 mass % or lower.

(Pb)

Addition of Pb improves the machinability of the copper alloy. About 0.003 mass % of Pb is solid-solubilized in the matrix, and when the Pb content is higher than 0.003 mass %, Pb is present in the form of Pb particles having a diameter of about 1 μm. The machinability of the alloy according to the embodiment is basically improved using the machinability function of κ phase that is harder than α phase, and is further improved due to a different action such as soft Pb particles. The alloy according to the embodiment has high machinability by adding Sn, defining the amount of κ phase to be in the appropriate range, and making κ phase to be present in a phase. However, even a small amount of Pb is highly effective for machinability, and thus Pb is necessary. In the alloy according to the embodiment, the proportion of γ phase having excellent machinability is limited to be 2.0% or lower. Therefore, a small amount of Pb can be replaced with γ phase. When the Pb content is 0.022 mass % or higher, a significant effect is exhibited. The Pb content is 0.022 mass % or higher and preferably 0.023 mass % or higher.

On the other hand, Pb is harmful to a human body and has an effect on impact resistance and high temperature creep. As described above, the alloy according to the embodiment already has high machinability. Therefore, the upper limit of the Pb content is sufficient at 0.10 mass % or lower. The upper limit of the Pb content is preferably 0.07 mass % or lower and most preferably 0.05 mass % or lower.

(P)

P improves dezincification corrosion resistance in a strict environment, machinability, cavitation resistance, erosion-corrosion resistance, and wear resistance. In particular, this effect becomes significant by adding Sn and P together.

The amount of P distributed in κ phase is about 2 times the amount of P distributed in α phase. That is, the amount of P distributed in κ phase is about 2 times the amount of P distributed in α phase. In addition, p has a significant effect of improving the corrosion resistance of α phase. However, when P is added alone, an effect of improving the corrosion resistance of κ phase is low. In cases where P is present together with Sn, the corrosion resistance of κ phase can be improved. However, P does not substantially improve the corrosion resistance of γ phase. In addition, the effect of P improving machinability is further improved by adding P and Sn together.

In order to exhibit the above-described effects, the lower limit of the P content is 0.06 mass % or higher, preferably 0.065 mass % or higher, and more preferably 0.07 mass % or higher.

On the other hand, in cases where the P content is higher than 0.14 mass %, the effect of improving corrosion resistance is saturated. In addition, a compound of P and Si is likely to be formed, impact resistance and ductility deteriorate due to an increase in the P concentration in κ phase, and machinability also deteriorates. Therefore, the upper limit of the P content is 0.14 mass % or lower, preferably 0.13 mass % or lower, and more preferably 0.12 mass % or lower.

(Sb, As, Bi)

As in the case of P and Sn, both Sb and As significantly improve dezincification corrosion resistance and stress corrosion cracking resistance, in particular, in a strict environment.

In order to improve corrosion resistance due to addition of Sb, it is necessary to add 0.02 mass % or higher of Sb, and it is preferable to add 0.03 mass % or higher of Sb. On the other hand, even if the Sb content is higher than 0.08 mass %, the effect of improving corrosion resistance is saturated, and the proportion of γ phase increases instead. The Sb content is 0.08 mass % or lower, preferably 0.07 mass % or lower, and more preferably 0.06 mass % or lower.

In order to improve corrosion resistance due to addition of As, it is necessary to add 0.02 mass % or higher of As, and it is preferable to add higher than 0.03 mass % or higher of As. On the other hand, even if the As content is higher than 0.08 mass %, the effect of improving corrosion resistance is saturated. Therefore, the As content is 0.08 mass % or lower, preferably 0.07 mass % or lower, and more preferably 0.06 mass % or lower.

By adding Sb alone, the corrosion resistance of α phase is improved. Sb is a low melting point metal having a higher melting point than Sn and exhibits similar behavior to Sn. The amount of Sn distributed in γ phase or κ phase is larger than the amount of Sn distributed in α phase, and thus the corrosion resistance of κ phase is improved. However, Sb has substantially no effect of improving the corrosion resistance of γ phase, and addition of an excess amount of Sb may increase the proportion of γ phase. Therefore, in order to use Sb, the proportion of γ phase is preferably 2.0% or lower.

Among Sn, P, Sb, and As, As strengthens the corrosion resistance of α phase. Even in cases where κ phase is corroded, the corrosion resistance of α phase is improved, and thus As functions to prevent the corrosion of α phase that occurs in a chain reaction. However, in either a case where As is added alone or a case where As is added together with Sn, P, and Sb, the effect of improving the corrosion resistance of κ phase and γ phase is low.

In cases where both Sb and As are added, even when the total content of Sb and As is higher than 0.10 mass %, the effect of improving corrosion resistance is saturated, and ductility and impact resistance deteriorate. Therefore, the total content of Sb and As is preferably 0.10 mass % or lower.

Bi further improves the machinability of the copper alloy. To that end, it is necessary to add 0.02 mass % or higher of Bi, and it is preferable to add 0.025 mass % or higher of Bi. On the other hand, harmfulness of Bi to a human body is not verified. However, from the viewpoint of an effect on impact resistance and high temperature properties, the upper limit of the Bi content is 0.20 mass % or lower, preferably 0.10 mass % or lower, and more preferably 0.05 mass % or lower.

(Inevitable Impurities)

Examples of the inevitable impurities in the embodiment include Al, Ni, Mg, Se, Te, Fe, Co, Ca, Zr, Cr, Ti, In, W, Mo, B, Ag, and rare earth elements.

In the related art, a free-cutting copper alloy is not mainly formed of a good-quality raw material such as electrolytic copper or electrolytic zinc but is mainly formed of a recycled copper alloy. In a pretreatment step (downstream step, machining step) of the related art, substantially all the members and components are cut, and a large amount of a copper alloy is wasted at a proportion of 40 to 80 with respect to 100 of the material. Examples of the wasted copper include chips, mill ends, burrs, runners, and products having manufacturing defects. This wasted copper alloy is a main raw material. When chips and the like are insufficiently separated, alloy becomes contaminated by Pb, Fe, Se, Te, Sn, P, Sb, As, Ca, Al, Zr, Ni, or rare earth elements of other free-cutting copper alloys. In addition, the cutting chips include Fe, W, Co, Mo, and the like incorporated from tools. The wasted material includes a plated product, and thus Ni and Cr are incorporated thereinto. Mg, Fe, Cr, Ti, Co, In, and Ni are incorporated into pure copper-based scrap. From the viewpoints of reuse of resources and costs, scrap such as chips including these elements at least in a range where there is no adverse effect on the properties is used as a raw material to some extent. Empirically, a large amount of Ni is incorporated from the scrap and the like, and the amount of Ni is allowed up to lower than 0.06 mass % but is preferably lower than 0.05 mass %. Fe, Mn, Co, Cr, or the like forms an intermetallic compound with Si and, in some cases, forms an intermetallic compound with P so as to have an effect on machinability. Therefore, the amount of each of Fe, Mn, Co, and Cr is preferably lower than 0.05 mass % and more preferably lower than 0.04 mass %. In particular, Fe is likely to form an intermetallic compound with P such that P is consumed and the intermetallic compound interferes with machinability. The total content of Fe, Mn, Co, and Cr is also preferably lower than 0.08 mass %. The total content is more preferably lower than 0.07 mass % and, as long as raw material conditions are allowed, is still more preferably lower than 0.06 mass %. Regarding Ag, Ag exhibits similar properties to Cu, and thus there is no problem in the Ag content. The amount of each of Al, Mg, Se, Te, Ca, Zr, Ti, In, W, Mo, B, and rare earth elements as other elements is preferably lower than 0.02 mass % and more preferably lower than 0.01 mass %.

The amount of the rare earth elements refers to the total amount of one or more selected from the group consisting of Sc, Y, La, Ce, Pr, Nd, Pm, Sm, Eu, Gd, Tb, Dy, Ho, Er, Tm, Tb, and Lu.

(Composition Relational Expression f1)

The composition relational expression f1 is an expression indicating a relationship between the composition and the metallographic structure. Even if the amount of each of the elements is in the above-described defined range, unless this composition relational expression f1 is not satisfied, the desired properties of the embodiment cannot be satisfied. In the composition relational expression f1, a large coefficient of −8.5 is assigned to Sn. When the composition relational expression f1 is lower than 74.4, although depending on other relational expressions, the proportion of γ phase increases, and a length of a long side of γ phase increases. As a result, normal-temperature strength decreases, impact resistance and high temperature properties deteriorate, and the improvement of cavitation resistance and erosion-corrosion resistance is also small. Accordingly, the lower limit of the composition relational expression f1 is 74.4 or higher, preferably 74.6 or higher, more preferably 74.8 or higher, and still more preferably 75.0 or higher. As the composition relational expression f1 approaches the more preferable range, the area ratio of γ phase decreases. Even in cases where γ phase is present, γ phase is spheroidized. That is, a length of a long side of γ phase tends to be short, and corrosion resistance, impact resistance, ductility, normal-temperature strength, and high temperature properties are further improved.

On the other hand, when the Sn content is in the range of the embodiment, the upper limit of the composition relational expression f1 mainly affects the proportion of κ phase. When the composition relational expression f1 is higher than 78.2, the proportion of κ phase is excessively high, and μ phase is likely to precipitate. When the proportion of κ phase or κ phase is excessively high, impact resistance, ductility, and hot workability deteriorate. Accordingly, the upper limit of the composition relational expression f1 is 78.2 or lower, preferably 77.8 or lower, and more preferably 77.5 or lower.

This way, by defining the composition relational expression f1 to be in the above-described range, a copper alloy having excellent properties can be obtained. As, Sb, and Bi as selective elements and the inevitable impurities that are separately defined have substantially no effect on the composition relational expression f1 in consideration of the contents thereof, and thus are not defined in the composition relational expression f1.

(Composition Relational Expression f2)

The composition relational expression f2 is an expression indicating a relationship between the composition and workability, various properties, and the metallographic structure. When the composition relational expression f2 is lower than 61.2, the proportion of γ phase in the metallographic structure increases, and other metallic phases including β phase and μ phase are likely to appear and are likely to remain. Therefore, corrosion resistance, ductility, impact resistance, cold workability, and high-temperature strength (creep) properties deteriorate. In addition, during hot forging, crystal grains are coarsened, and cracking is likely to occur. Accordingly, the lower limit of the composition relational expression f2 is 61.2 or higher, preferably 61.4 or higher, and more preferably 61.5 or higher.

On the other hand, when the composition relational expression f2 is higher than 62.8, hot deformation resistance is improved, hot deformability deteriorates, and surface cracking may occur in a hot extruded material or a hot forged product. Although it also relates to a hot working ratio or an extrusion ratio, it is difficult to perform hot working such as hot extrusion or hot forging, for example, at about 640° C. (material's temperature immediately after hot working). In addition, coarse α phase having a length of more than 300 μm and a width of more than 100 μm in a direction parallel to a hot working direction may appear. When coarse α phase is present, machinability deteriorates, and strength decreases. In addition, γ phase having a long length of a long side is likely to be present at a boundary between α phase and κ phase increases. In addition, the range of solidification temperature, that is, (liquidus temperature-solidus temperature) becomes higher than 50° C., shrinkage cavities during casting are significant, and sound casting cannot be obtained. On the other hand, the presence of the coarse α phase also affects the formation of elongated κ phase present in α phase, and as the value of f1 increases, elongated κ phase is not likely to be present in α phase. The upper limit of the composition relational expression f2 is 62.8 or lower, preferably 62.6 or lower, and more preferably 62.5 or lower. This way, by setting the composition relational expression f2 to be in a narrow range, excellent corrosion resistance, machinability, hot workability, impact resistance, and high temperature properties can be obtained.

As, Sb, and Bi as selective elements and the inevitable impurities that are separately defined have substantially no effect on the composition relational expression f2 in consideration of the contents thereof, and thus are not defined in the composition relational expression f2.

(Composition Relational Expression f3)

Addition of 0.36 mass % or higher of Sn improves, in particular, cavitation resistance and erosion-corrosion resistance. In the embodiment, the proportion of γ phase in the metallographic structure decreases, and the amount of Sn in κ phase or α phase is effectively increased. Further, by adding Sn together with P, the effect is further improved. The composition relational expression f3 relates to a mixing ratio between P and Sn. When the value of P/Sn is 0.09 to 0.35, that is, the number of P atoms is ⅓ to 1.3 with respect to one Sn atom substantially in terms of atomic concentration, corrosion resistance, cavitation resistance, and erosion-corrosion resistance can be improved. f3 is preferably 0.1 or higher. In addition, the upper limit value of f3 is preferably 0.3 or lower. In particular, when the value of P/Sn is higher than the upper limit of the range, corrosion resistance, cavitation resistance, and erosion-corrosion resistance deteriorate. When the value of P/Sn is lower than the lower limit of the range, impact resistance deteriorates.

(Comparison to Patent Documents)

Here, the results of comparing the compositions of the Cu—Zn—Si alloys described in Patent Documents 3 to 9 and the composition of the alloy according to the embodiment are shown in Table 1.

The embodiment and Patent Document 3 are different from each other in the Pb content. The embodiment and Patent Document 4 are different from each other as to whether P/Sn ratio is defined. The embodiment and Patent Document 5 are different from each other in the Pb content. The embodiment and Patent Documents 6 and 7 are different from each other as to whether or not Zr is added. The embodiment and Patent Document 8 are different from each other as to whether or not Fe is added. The embodiment and Patent Document 9 are different from each other as to whether or not Pb is added and also whether or not Fe, Ni, and Mn are added.

As described above, the alloy according to the embodiment and the Cu—Zn—Si alloys described in Patent Documents 3 to 9 are different from each other in the composition ranges.

TABLE 1

| | Cu | Si | Pb | Sn | P | P/Sn | Fe | Zr | Other Essential Elements |
|---|---|---|---|---|---|---|---|---|---|
| First Embodiment | 76.0-79.0 | 3.1-3.6 | 0.022-0.10 | 0.36-0.84 | 0.06-0.14 | 0.09-0.35 | — | — | |
| Second Embodiment | 76.5-78.7 | 3.15-3.55 | 0.023-0.07 | 0.41-0.78 | 0.06-0.14 | 0.1-0.3 | — | — | |
| Patent Document 3 | 69-79 | 2.0-4.0 | — | 0.3-3.5 | 0.02-0.25 | — | — | — | |
| Patent Document 4 | 69-79 | 2.0-4.0 | 0.02-0.4 | 0.3-3.5 | 0.02-0.25 | — | — | — | |
| Patent Document 5 | 71.5-78.5 | 2.0-4.5 | 0.005-0.02 | 0.1-1.2 | 0.01-0.2 | — | 0.5 or lower | — | |
| Patent Document 6 | 69-88 | 2-5 | 0.004-0.45 | 0.1-2.5 | 0.01-0.25 | — | | 5 ppm-400 ppm | |
| Patent Document 7 | 69-88 | 2-5 | 0.005-0.45 | 0.05-1.5 | 0.01-0.25 | — | 0.3 or lower | 5 ppm-400 ppm | |
| Patent Document 8 | 74.5-76.5 | 3.0-3.5 | 0.01-0.25 | 0.05-0.2 | 0.04-0.10 | — | 0.11-0.2 | — | |
| Patent Document 9 | 70-83 | 1-5 | — | 0.01-2 | 0.1 or lower | — | 0.01-0.3 | 0.5 or lower | Ni: 0.01-0.3 Mn: 0.01-0.3 |

<Metallographic Structure>

In Cu—Zn—Si alloys, 10 or more kinds of phases are present, complicated phase change occurs, and desired properties cannot be necessarily obtained simply by defining the composition ranges and relational expressions of the elements. By specifying and determining the kinds of metallic phases that are present in a metallographic structure and the ranges thereof, desired properties can finally be obtained.

In the case of Cu—Zn—Si alloys including a plurality of metallic phases, the corrosion resistance level varies between phases. Corrosion begins and progresses from a phase having the lowest corrosion resistance, that is, a phase that is most prone to corrosion, or from a boundary between a phase having low corrosion resistance and a phase adjacent to such phase. In the case of Cu—Zn—Si alloys including three elements of Cu, Zn, and Si, for example, when corrosion resistances of α phase, α' phase, β phase (including β' phase), κ phase, γ phase (including γ' phase), and μ phase are compared, the ranking of corrosion resistance is: α phase>α' phase>κ phase>μ phase≥γ phase>β phase. The difference in corrosion resistance between κ phase and μ phase is particularly large.

Compositions of the respective phases vary depending on the composition of the alloy and the area ratios of the respective phases, and the following can be said.

With respect to the Si concentration of each phase, that of μ phase is the highest, followed by γ phase, κ phase, α phase, α' phase, and β phase. The Si concentrations in μ phase, γ phase, and κ phase are higher than the Si concentration in the alloy. In addition, the Si concentration in μ phase is about 2.5 times to about 3 times the Si concentration in α phase, and the Si concentration in γ phase is about 2 times to about 2.5 times the Si concentration in α phase. The Cu concentration ranking is: μ phase>κ phase≥α phase>α' phase≥γ phase>β phase from highest to lowest. The Cu concentration in μ phase is higher than the Cu concentration in the alloy.

In the Cu—Zn—Si alloys described in Patent Documents 3 to 6, a large part of γ phase, which has the highest machinability-improving function, is present together with α' phase or is present at a boundary between κ phase and α phase. When used in water that is bad for copper alloys or in an environment that is harsh for copper alloys, γ phase becomes a source of selective corrosion (origin of corrosion) such that corrosion progresses. Of course, when β phase is present, β phase starts to corrode before γ phase. When μ phase and γ phase are present together, μ phase starts to corrode slightly later than or at the same time as γ phase. For example, when a phase, κ phase, γ phase, and μ phase are present together, if dezincification corrosion selectively occurs in γ phase or μ phase, the corroded γ phase or μ phase becomes a corrosion product (patina) that is rich in Cu due to dezincification. This corrosion product causes κ phase or α' phase adjacent thereto to be corroded, and corrosion progresses in a chain reaction.

The water quality of drinking water varies across the world including Japan, and under this water quality, corrosion is likely to occur due to a copper alloy. For example, the concentration of residual chlorine, which has an upper limit but is used for disinfection due to safety to a human body, increases, and thus a copper alloy forming a device for water supply is likely to be corroded. The description or more of drinking water is applicable to corrosion resistance in a usage environment where a large amount of a solution is present, for example, usage environments of members including the automobile components, the mechanical components, and the industrial pipes described above. In addition, in order to satisfy requirements of the recent years, for example, to secure corrosion resistance in high-temperature or high-speed fluid, to secure reliability of a high-pressure vessel or a high-pressure valve or to realize reduction in thickness and weight, a copper alloy member having a high strength and excellent high temperature creep and having excellent cavitation resistance and erosion-corrosion resistance is necessary.

On the other hand, even if the amount of γ phase, or the amounts of γ phase, μ phase, and β phase are controlled, that is, the proportions of the respective phases are significantly reduced or are made to be zero, the corrosion resistance of a Cu—Zn—Si alloy including the two phases of α phase and κ phase is not perfect. Depending on the environment where corrosion occurs, κ phase having lower corrosion resistance than α phase may be selectively corroded, and it is necessary to improve the corrosion resistance of κ phase. Further, in cases where κ phase is corroded, the corroded κ phase becomes a corrosion product that is rich in Cu. This corrosion product causes α phase to be corroded, and thus it is also necessary to improve the corrosion resistance of α phase.

In addition, γ phase is a hard and brittle phase. Therefore, even if a large load is applied to a copper alloy member, the γ phase microscopically becomes a stress concentration source. Although machinability is improved, stress corrosion cracking sensitivity is improved, and ductility or impact resistance deteriorates. In addition, high-temperature strength (high temperature creep strength) deteriorates due to a high-temperature creep phenomenon. As in the case of γ phase, μ phase is a hard phase and is mainly present at a grain boundary of α phase or at α phase boundary between α phase and κ phase. Therefore, as in the case of γ phase, μ phase microscopically becomes a stress concentration source. Due to the stress concentration source or a grain boundary sliding phenomenon, μ phase improves stress corrosion cracking sensitivity, deteriorates impact resistance, and deteriorates high-temperature strength. In some cases, the presence of μ phase deteriorates these properties more than γ phase. In addition, γ phase or μ phase itself has a small effect of improving cavitation resistance and erosion-corrosion resistance.

However, if the proportion of γ phase or the proportions of γ phase and μ phase are significantly reduced or are made to be zero in order to improve corrosion resistance and the above-mentioned properties, satisfactory machinability may not be obtained merely by containing a small amount of Pb and the two phases of α phase and κ phase. Therefore, providing that the alloy with a small amount of Pb has excellent machinability, it is necessary that constituent phases of a metallographic structure (metallic phases or crystalline phases) are defined as follows in order to improve corrosion resistance in a harsh environment, ductility, impact resistance, strength, high-temperature strength, cavitation resistance, and erosion-corrosion resistance.

Hereinafter, the unit of the proportion of each of the phases is area ratio (area %).

(γ Phase)

γ phase is α phase that contributes most to the machinability of Cu—Zn—Si alloys. In order to improve corrosion resistance, strength, high temperature properties, and impact resistance in a harsh environment, it is necessary to limit γ phase. In order to improve corrosion resistance, it is necessary to add Sn, and as the Sn content increases, the proportion of γ phase further increases. In order to obtain sufficient machinability and corrosion resistance at the same time when Sn has such contradicting effects, the Sn content, the P content, the composition relational expressions f1, f2, and 3, the metallographic structure relational expressions described below, and the manufacturing process are limited.

(β Phase and Other Phases)

In order to obtain excellent corrosion resistance, cavitation resistance, and erosion-corrosion resistance, and high ductility, impact resistance, strength, and high-temperature properties, the proportions of β phase, γ phase, μ phase, and other phases such as ζ phase in a metallographic structure are particularly important.

The proportion of β phase needs to be at least 0% to 0.3% and is preferably 0.2% or lower, and it is most preferable that β phase is not present.

The proportion of phases such as ζ phase other than α phase, κ phase, β phase, γ phase, and μ phase is preferably 0.3% or lower and more preferably 0.1% or lower. It is most preferable that the other phases such as ζ phase are not present.

First, in order to obtain excellent corrosion resistance, it is necessary that the proportion of γ phase is 0% to 2.0% and a length of a long side of γ phase is 50 μm or less.

The length of the long side of γ phase is measured using the following method. For example, using a 500-fold or 1000-fold metallographic micrograph, the maximum length of the long side of γ phase is measured in one visual field. This operation is performed in a plurality of visual fields, for example, five visual fields as described below. The average value of maximum lengths of long sides of γ phase obtained from the respective visual fields is calculated as the length of the long side of γ phase. Therefore, the length of the long side of γ phase will also be referred to as the maximum length of the long side of γ phase.

The proportion of γ phase is preferably 1.5% or lower, more preferably 1.2% or lower, still more preferably 0.8% or lower, and most preferably 0.5% or lower. Even if the proportion of γ phase having an excellent machinability function is 0.5% or lower, the alloy can exhibit excellent machinability due to a predetermined amount of κ phase having improved machinability due to Sn and P, addition of a small amount of Pb, and κ phase present in α phase.

Since the length of the long side of γ phase has an effect on corrosion resistance, the length of the long side of γ phase is 50 μm or less, preferably 40 μm or less, more preferably 30 μm or less, and most preferably 20 μm or less.

As the amount of γ phase increases, γ phase is likely to be selectively corroded. In addition, as the length of γ phase increases, corrosion is more likely to selectively occur, and the progress of corrosion in a depth direction is promoted. Not only the amount of γ phase but also the length of long side of γ phase have an effect on properties other than corrosion resistance. γ phase having a long length is mainly present at a boundary between α phase and κ phase, and normal-temperature strength, impact resistance, and high temperature properties deteriorate along with deterioration in ductility.

The proportion of γ phase and the length of the long side of γ phase are closely related to the contents of Cu, Sn, and Si and the composition relational expressions f1 and f2.

As the proportion of γ phase increases, ductility, impact resistance, normal-temperature strength, high-temperature strength, stress corrosion cracking resistance, and wear resistance deteriorate. The proportion of γ phase is necessarily 2.0% or lower, preferably 1.5% or lower, more preferably 1.2% or lower, still more preferably 0.8% or lower, and most preferably 0.5% or lower. When a high stress is applied, γ phase present in a metallographic structure becomes as a stress concentration source. In addition, in combination with BCC as a crystal structure of γ phase, normal-temperature strength, high-temperature strength, impact resistance, and stress corrosion cracking resistance deteriorate.

(μ Phase)

μ phase affects corrosion resistance, cavitation resistance, erosion-corrosion resistance, ductility, impact resistance, and high temperature properties. Therefore, it is necessary that the proportion of μ phase is at least 0% to 2.0%. The proportion of μ phase is preferably 1.0% or lower and more preferably 0.3% or lower, and it is most preferable that μ phase is not present. μ phase is mainly present at a grain boundary or α phase boundary. Therefore, in a harsh environment, grain boundary corrosion occurs at a grain boundary where μ phase is present. In addition, when impact is applied, cracks are more likely to develop from hard μ phase present at a grain boundary. In addition, for example, when a copper alloy is used in a valve used around the engine of a vehicle or in a high-temperature, high-pressure gas valve, if the copper alloy is held at a high temperature of 150° C. for a long period of time, grain boundary sliding occurs, and creep is more likely to occur. Therefore, it is necessary to limit the amount of μ phase, and at the same time limit the length of the long side of μ phase that is mainly present at a grain boundary to 25 μm or less. The length of the long side of μ phase is preferably 15 μm or less, more preferably 5 μm or less, still more preferably 4 μm or less, and most preferably 2 μm or less.

The length of the long side of μ phase is measured using the same method as the method of measuring the length of the long side of γ phase. That is, by using, for example, a 500-fold or 1000-fold metallographic micrograph or using a 2000-fold or 5000-fold secondary electron micrograph (electron micrograph) according to the size of μ phase, the maximum length of the long side of μ phase in one visual field is measured. This operation is performed in a plurality of visual fields, for example, five arbitrarily chosen visual fields. The average maximum length of the long sides of μ phase calculated from the lengths measured in the respective visual fields is regarded as the length of the long side of μ phase. Therefore, the length of the long side of μ phase can be referred to as the maximum length of the long side of μ phase.

(κ Phase)

Under recent high-speed cutting conditions, the machinability of a material including cutting resistance and chip dischargeability is important. However, in order to obtain excellent machinability in a state where the proportion of γ phase having the highest machinability function is limited to be 2.0% or lower, it is necessary that the proportion of κ phase is at least 30% or higher. The proportion of κ phase is preferably 33% or higher and more preferably 35% or higher.

On the other hand, the proportion of κ phase that is harder than α phase is increased, machinability is improved, and tensile strength is improved. However, on the other hand, as the proportion of κ phase increases, ductility or impact resistance gradually deteriorates. κ phase has an excellent machinability function, but when the proportion of κ phase in the metallographic structure is higher than 60% and reaches about ⅔, conversely, cutting resistance is improved. In consideration of κ phase including about 0.4 to 0.85 mass % of Sn, further deterioration in the ductility of κ phase, and ductility and impact resistance, it is necessary to set the proportion of κ phase to be 65% or lower. The proportion of κ phase is preferably 62% or lower, more preferably 58% or lower, and most preferably 55% or lower.

In the embodiment, by adding solid-solution of a necessary amount of Sn and P to κ phase, machinability, corrosion resistance, cavitation resistance, erosion-corrosion resistance, wear resistance, and high temperature properties of κ phase itself are improved. Simultaneously, κ phase can be made to be present in α phase depending on conditions of the composition and the process. By making κ phase to be present in a phase, machinability, wear resistance, strength, cavitation resistance, and erosion-corrosion resistance of α phase itself are improved. As a result, machinability, normal-temperature strength, high temperature properties, corrosion resistance, cavitation resistance, erosion-corrosion resistance, and wear resistance of the alloy are improved.

(α Phase)

α Phase is a main phase that forms a matrix and is a source of all the properties of the alloy. α phase is most rich in ductility and toughness and is a so-called sticky phase. Since α phase including Si has excellent corrosion resistance, the copper alloy can exhibit excellent mechanical properties and various corrosion resistances.

In particular, regarding cutting, stickiness of α phase improves cutting resistance such that chips are continuous. By having Sn that improves corrosion resistance contained in α phase, the stickiness can be slightly alleviated. Further, by having thin and elongated κ phase with excellent machinability present in α phase, the machinability improvement function of α phase is enhanced. Due to the presence of an appropriate amount of κ phase in α phase, α phase is strengthened without deterioration in ductility or toughness, and tensile strength, wear resistance, cavitation resistance, and erosion-corrosion resistance are improved. If κ phase present in α phase is thin, for example, about 0.1 μm and the amount of κ phase in α phase is about 20% or less, there is no substantial impairment to ductility.

In addition, γ phase and κ phase in the alloy has an excellent machinability function. However, in the alloy including γ phase and κ phase, excellent ductility, strength, various corrosion resistances, and impact resistance cannot be obtained.

(Metallographic Structure Relational Expressions f4, f5, and f6)

In order to obtain excellent ductility, strength, various corrosion resistances, impact resistance, and high-temperature strength, it is necessary that the total proportions of α phase as the main phase, which is rich in ductility and has excellent corrosion resistance, and κ phase (metallographic structure relational expression f4=(α)+(κ)) is 96.5% or higher. The value of f4 is preferably 97.5% or higher, more preferably 98% or higher, and most preferably 98.5% or higher. Since the range of κ phase is defined, the range of α phase is also determined.

Likewise, the total proportion of α phase, κ phase, γ phase, μ phase (metallographic structure relational expression f5=(α)+(κ)+(γ)+(μ)) is preferably 99.4% or higher and most preferably 99.6% or higher.

Further, it is necessary that the total proportion of γ phase and μ phase (f6=(γ)+(μ)) is 3.0% or lower. The value of f6 is preferably 2.0% or lower, more preferably 1.0% or lower, and most preferably 0.5% or lower.

Here, regarding the metallographic structure relational expressions f3 to f6, 10 kinds of metallic phases including α phase, β phase, γ phase, δ phase, ε phase, ζ phase, η phase, κ phase, μ phase, and χ phase are targets, and an intermetallic compound, Pb particles, an oxide, a non-metallic inclusion, a non-melted material, and the like are not targets. Intermetallic compounds that are formed by Si, P, and inevitably incorporated elements (for example, Fe, Co, and Mn) are excluded from the area ratio of a metallic phase. However, these intermetallic compounds have an effect on machinability, and thus it is necessary to pay attention to the inevitable impurities.

(Metallographic Structure Relational Expression f7)

In the alloy according to the embodiment, it is necessary that machinability is excellent while minimizing the Pb content in the Cu—Zn—Si alloy, and it is necessary that the alloy has particularly excellent corrosion resistance, cavitation resistance, erosion-corrosion resistance, impact resistance, ductility, wear resistance, normal-temperature strength, and high-temperature properties. However, γ phase improves machinability, but for obtaining excellent corrosion resistance and impact resistance, presence of γ phase has an adverse effect.

Metallographically, it is preferable to contain a large amount of γ phase having the highest machinability. However, from the viewpoints of corrosion resistance, impact resistance, and other properties, it is necessary to reduce the amount of γ phase. It was found from experiment results that, when the proportion of γ phase is 2.0% or lower, it is necessary that the value of the metallographic structure relational expression f7 is in an appropriate range in order to obtain excellent machinability.

γ phase has the highest machinability. However, in particular, when the amount of γ phase is small, that is, the area ratio of γ phase is 2.0% or lower, a coefficient that is six times that of κ phase is assigned to the square root value of the proportion (%) of γ phase. In addition, since κ phase includes Sn, machinability of Sn is improved. Therefore, a coefficient of 1.05 is assigned to κ phase, and this coefficient is two times or more that of μ phase. In order to obtain excellent machinability, it is necessary that the metallographic structure relational expression f7 is 36 or higher. The value of f7 is preferably 40 or higher, more preferably 42 or higher, and still more preferably 44 or higher.

On the other hand, the metallographic structure relational expression f7 is higher than 72, machinability is saturated, and impact resistance and ductility deteriorate. Therefore, it is necessary that the metallographic structure relational expression f7 is 72 or lower. The value of f7 is preferably 68 or higher, more preferably 65 or higher, and still more preferably 62 or higher.

(Amounts of Sn and P in κ Phase)

In order to improve the corrosion resistance of κ phase, in the alloy, the amount of Sn is preferably 0.36 mass % to 0.84 mass % and the amount of P is preferably 0.06 mass % to 0.14 mass %.

In the alloy according to the embodiment, when the Sn content is in the above-described range and the amount of Sn distributed in α phase is 1, the amount of Sn distributed in κ phase is about 1.4, the amount of Sn distributed in γ phase is about 8 to about 16, and the amount of Sn distributed in μ phase is about 2. For example, in the case of the alloy according to the embodiment, in a Cu—Zn—Si alloy including 0.5 mass % of Sn, when the proportion of α phase is 50%, the proportion of κ phase is 49%, and the proportion of γ phase is 1%, the Sn concentration in α phase is about 0.38 mass %, the Sn concentration in κ phase is about 0.53 mass %, and the Sn concentration in γ phase is about 4.0 mass %. When the area ratio of γ phase is high, the amount of Sn consumed in γ phase increases, and the amounts of Sn distributed in κ phase and α phase are reduced. Accordingly, if where the amount of γ phase is small, Sn is effectively used for corrosion resistance and machinability as described below.

On the other hand, assuming that the amount of P distributed in α phase is 1, the amount of P distributed in κ phase is about 2, the amount of P distributed in γ phase is about 3, and the amount of P distributed in μ phase is about 4. For example, in the case of the alloy according to the embodiment, in a Cu—Zn—Si alloy including 0.1 mass % of P, when the proportion of α phase is 50%, the proportion of κ phase is 49%, and the proportion of γ phase is 1%, the P concentration in α phase is about 0.06 mass %, the P concentration in κ phase is about 0.12 mass %, and the P concentration in γ phase is about 0.18 mass %.

Both Sn and P improve the corrosion resistance of α phase and κ phase, and the amount of Sn and the amount of P in κ phase are about 1.4 times and about 2 times the amount of Sn and the amount of P in α phase, respectively. That is, the amount of Sn in κ phase is about 1.4 times the amount of Sn in α phase, and the amount of P in κ phase is about 2 times the amount of P in α phase. Therefore, the degree of corrosion resistance improvement of κ phase is higher than that of α phase. As a result, the corrosion resistance of κ phase approaches the corrosion resistance of α phase. By adding both Sn and P, in particular, the corrosion resistance of κ phase can be improved. However, even though there is a difference in content, the contribution of Sn to corrosion resistance is higher than that of P.

When the Sn content in the copper alloy is 0.35 mass % or lower, there is a problem in cavitation resistance and erosion-corrosion resistance under strict conditions. This problem can be solved by increasing the Sn content, increasing the concentrations of Sn and P in κ phase and α phase, in particular, κ phase, and controlling a concentration ratio between P and Sn. Simultaneously, corrosion resistance can be improved. In addition, when a large amount of Sn is distributed in κ phase, machinability of κ phase is improved. As a result, loss of machinability caused by a decrease in the amount of γ phase can be compensated for.

On the other hand, a large amount of Sn is distributed in γ phase. However, even if γ phase includes a large amount of Sn, corrosion resistance of γ phase is not substantially improved, and there is a small effect of improving cavitation resistance and erosion-corrosion resistance. The main reason for this is presumed to be that the crystal structure of γ phase is a BCC structure. On the contrary, if the proportion of γ phase is high, the amount of Sn distributed in κ phase is small. Therefore, the degree to which corrosion resistance, cavitation resistance, and erosion-corrosion resistance of κ phase are improved is low. Therefore, the Sn concentration in κ phase is preferably 0.40 mass % or higher, more preferably 0.43 mass % or higher, still more preferably 0.48 mass % or higher, and most preferably 0.55 mass % or higher. On the other hand, originally, κ phase has lower ductility and toughness than α phase, and when the Sn concentration in κ phase reaches 1 mass %, the Sn content in κ phase excessively increases, and ductility and toughness of κ phase deteriorate. Accordingly, the Sn concentration in κ phase is preferably 0.85 mass % or lower, more preferably 0.8 mass % or lower, and still more preferably 0.75 mass % or lower. When κ phase includes a predetermined amount of Sn, corrosion resistance, cavitation resistance, and erosion-corrosion resistance are improved without a significant deterioration in ductility and toughness, and machinability and wear resistance are also improved.

As in the case of Sn, when a large amount of P is distributed in κ phase, corrosion resistance is improved, and the machinability of κ phase is also improved. However, when an excess amount of P is added, P is consumed for the formation of an intermetallic compound of Si such that the properties deteriorate, or when κ phase includes an excess amount of P, impact resistance and ductility deteriorate. The P concentration in κ phase is preferably 0.07 mass % or higher, more preferably 0.08 mass % or higher, and still more preferably 0.09 mass % or higher. The upper limit value of the P concentration in κ phase is preferably 0.22 mass % or lower, more preferably 0.19 mass % or lower, and still more preferably 0.16 mass % or lower.

By adding P and Sn together, corrosion resistance, cavitation resistance, erosion-corrosion resistance, wear resistance, and machinability are improved.

<Properties>

(Normal-Temperature Strength and High-Temperature Strength)

As strength required in various fields such as valves and devices for drinking water and automobiles, tensile strength that is breaking stress applied to pressure vessel is being made much of. In addition, for example, a valve used in an environment close to the engine room of a vehicle or a high-temperature and high-pressure valve is used in an environment where the temperature can reach maximum 150° C. And the alloy, of course, is required to remain intact without deformation or fracture when a pressure or a stress is applied. In the case of pressure vessels, the allowable stress is affected by the tensile strength.

To that end, it is preferable that a hot extruded material or a hot forged material as a hot worked material is a high strength material having a tensile strength of 540 N/mm$^2$ or higher at a normal temperature. Tensile strength at normal temperature is preferably 560 N/mm$^2$ or higher and more preferably 580 N/mm$^2$ or higher.

In general, cold working is not performed on the hot forged material in practice. Pressure resistance depends on tensile strength, and a high tensile strength is required for a member such as a pressure vessel or a valve to which a pressure is applied. Therefore, the forged material is suitable for a member such as a pressure vessel or a valve to which a pressure is applied. On the other hand, when, for example, a hot extruded material among hot worked materials is drawn or wire-drawn in a cold state, the strength is improved. When cold working is performed on the alloy according to the embodiment at a cold working ratio of 15% or lower, the tensile strength increases by 12 N/mm$^2$ per 1% of cold working ratio. On the other hand, the impact resistance decreases by about 4% or 5% per 1% of cold working ratio. For example, when a hot extruded material having a tensile strength of 580 N/mm$^2$ and an impact value of 25 J/cm$^2$ is cold-drawn at a cold working ratio 5% to prepare a cold worked material, the tensile strength of the cold worked material is about 640 N/mm$^2$, and the impact value is about 19 J/cm$^2$. When the cold working ratio varies, the tensile strength and the impact value cannot be uniquely determined.

Regarding the high-temperature strength (properties), it is preferable that a creep strain after exposing the copper alloy at 150° C. for 100 hours in a state where a stress corresponding to 0.2% proof stress at room temperature is applied is 0.4% or lower. This creep strain is more preferably 0.3% or lower and still more preferably 0.2% or lower. As a result, a copper alloy that is not likely to be deformed even when exposed to a high temperature and has high-temperature strength is obtained.

Incidentally, in the case of free-cutting brass including 60 mass % of Cu, 3 mass % of Pb with a balance including Zn and inevitable impurities, tensile strength at a normal temperature is 360 N/mm$^2$ to 400 N/mm$^2$ when formed into a hot extruded material or a hot forged product. In addition, even after the alloy is exposed to 150° C. for 100 hours in a state where a stress corresponding to 0.2% proof stress at room temperature is applied, the creep strain is about 4% to 5%. Therefore, the tensile strength and heat resistance of the alloy according to the embodiment are much higher than those of conventional free-cutting brass including Pb. That is, the alloy according to the embodiment has high strength at room temperature and scarcely deforms even after being exposed to a high temperature for a long period of time. Therefore, a reduction in thickness and weight can be realized using the high strength. In particular, in the case of a forged material such as a high-pressure valve, cold working cannot be performed. Therefore, high performance and a reduction in thickness and weight can be realized using the high strength.

In the case of the alloy according to the embodiment, there is little difference in the properties under high temperature among a hot-forged material, an extruded material, and a cold worked material. That is, the 0.2% proof stress increases due to cold working, but even if a load corresponding to a high 0.2% proof stress is applied, creep strain after exposing the alloy to 150° C. for 100 hours is 0.4% or lower, and the alloy has high heat resistance. Properties under high temperature are mainly affected by the area ratios of β phase, γ phase, and μ phase, and the higher the area ratios are, the worse high temperature properties are. In addition, the longer the length of the long side of α phase or γ phase present at a grain boundary of α phase or at α phase boundary is, the worse high temperature properties are.

(Impact Resistance)

In general, a material of high strength is brittle. It is said that a material having chip partibility during cutting has some kind of brittleness. Impact resistance is contrary to machinability and strength in some aspect.

However, if the copper alloy is for use in various members including drinking water devices such as valves or fittings, automobile components, mechanical components, and industrial plumbing components, the copper alloy needs to have high strength and resistance to impact. Specifically, when a Charpy impact test is performed using a U-notched specimen, the resultant a Charpy impact test value is preferably 12 J/cm$^2$ or higher, more preferably 14 J/cm$^2$ or higher, and still more preferably 16 J/cm$^2$ or higher. In particular, the Charpy impact test value of a hot forged material on which cold working is not performed is preferably 14 J/cm$^2$ or higher, more preferably 16 J/cm$^2$ or higher, and still more preferably 18 J/cm$^2$ or higher. As the alloy according to the embodiment relates to an alloy having excellent machinability, its Charpy impact test value does not need to exceed 45 J/cm$^2$. Conversely, if the Charpy impact test value is higher than 45 J/cm$^2$, toughness and material stickiness increase. Therefore, cutting resistance is improved, and machinability deteriorates. For example, chipping is likely to continuously occur. Therefore, the Charpy impact test value is preferably 45 J/cm$^2$ or lower.

When the amount of hard κ phase increases or the Sn concentration in κ phase increases, strength and machinability are improved, but toughness, that is, impact resistance deteriorates. Therefore, in some aspects, strength and machinability are contrary to toughness (impact resistance). Using the following expression, a strength index indicating in which impact resistance is added to strength is defined.

$$(\text{Strength Index})=(\text{Tensile Strength})+30\times(\text{Charpy Impact Test Value})^{1/2}$$

Regarding a hot worked material (hot extruded material, hot forged material) and a cold worked material on which light cold working is performed at a working ratio of about 5% or 10%, if the strength index is 680 or higher, it can be said that the material has high strength and toughness. The strength index is preferably 700 or higher and more preferably 720 or higher.

Impact resistance of the alloy according to the embodiment also has a close relation with a metallographic structure, and γ phase deteriorates impact resistance. In addition, if μ phase is present at a grain boundary of α phase or a phase boundary between α phase, κ phase, and γ phase, the grain boundary and the phase boundary is embrittled, and impact resistance deteriorates.

As a result of a study, it was found that if μ phase having the length of the long side of more than 25 μm is present at a grain boundary or a phase boundary, impact resistance particularly deteriorates. Therefore, the length of the long side of μ phase present is 25 μm or less, preferably 15 μm or less, more preferably 5 μm or less, still more preferably 4 μm or less, and most preferably 2 μm or less. In addition, in a harsh environment, μ phase present at a grain boundary is more likely to corrode than α phase or κ phase, thus causes grain boundary corrosion and deteriorate properties under high temperature. In the case of μ phase, if the occupancy ratio is low and the length is short and the width is narrow, it is difficult to detect the μ phase using a metallographic microscope at a magnification of about 500-fold or 1000-fold. When observing μ phase whose length is 5 μm or less, the μ phase may be observed at a grain boundary or α phase boundary using an electron microscope at a magnification of about 2000-fold or 5000-fold, μ phase can be found at a grain boundary or a phase boundary.

(Relationship Between Various Properties and κ Phase)

When the amount of κ phase that is harder than α phase increases, the tensile strength increases although tensile strength is affected by ductility and toughness. To that end, the proportion of κ phase is 30% or higher, preferably 33% or higher, and more preferably 35% or higher. Simultaneously, κ phase has a machinability function and excellent wear resistance. Therefore, the amount of κ phase is necessarily 30% or higher and preferably 33% or higher or 35% or higher. On the other hand, when the proportion of κ phase is higher than 65%, toughness or ductility deteriorates, and tensile strength and machinability are saturated. Therefore, the proportion of κ phase is necessarily 65% or lower. The proportion of κ phase is preferably 62% or lower, more preferably 58% or lower, and still more preferably 55% or lower. When κ phase includes an appropriate amount of Sn, corrosion resistance is improved, and machinability, strength, and wear resistance of κ phase are also improved. On the other hand, as the Sn content in the copper alloy increases, ductility or impact resistance gradually deteriorates. When the Sn content in the alloy is higher than 0.84% or the amount of Sn in κ phase is more than 0.85%, the degree to which impact resistance or ductility deteriorates is large.

(κ Phase in α Phase)

Depending on conditions of the composition and the process, elongated κ phase having a narrow width (hereinafter, also referred to as "κ1 phase") can be made to be present in α phase. Specifically, typically, crystal grains of α phase and crystal grains of κ phase are present independently of each other. However, in the case of the alloy according to the embodiment, a plurality of crystal grains of elongated κ phase can be precipitated in crystal grains of α phase. This way, by making κ phase to be present in α phase, α phase is appropriately strengthened, and tensile strength, wear resistance, and machinability are improved without a significant deterioration in ductility and toughness.

In some aspects, cavitation resistance are affected by wear resistance, strength, and corrosion resistance, and erosion-corrosion resistance is affected by corrosion resistance and wear resistance. In particular, when the amount of κ phase is large, or elongated κ phase is present in α phase or the Sn concentration in κ phase is high, cavitation resistance improves. In order to improve erosion-corrosion resistance, it is most effective to increase the Sn concentration in κ phase. When elongated κ phase is present in α phase, erosion-corrosion resistance is further improved (more effective). Regarding both cavitation resistance and erosion-corrosion resistance, the Sn concentration in κ phase is more important than the Sn concentration in the alloy. In particular, when the Sn concentration in κ phase is 0.40 mass % or higher, both the properties are improved. When the Sn concentration in κ phase increases to 0.43%, 0.48%, and 0.55%, both the properties are further improved. In addition to the Sn concentration in κ phase, corrosion resistance of the alloy is also important. The reason for this is follows. When the materials are corroded to form corrosion products during actual use of the copper alloy, these corrosion products easily peel off in high-speed fluid such that a newly formed surface is exposed. The corrosion and peeling are repeated. In an accelerated test (accelerated test of corrosion), this tendency can be determined.

The alloy according to the embodiment includes Sn, in which the proportion of γ phase is limited to be 2.0% or lower, preferably 1.5% or lower, and more preferably 1.0% or lower. As a result, the amount of Sn that is solid-solubilized in κ phase and α phase increases, and corrosion resistance, wear resistance, erosion-corrosion resistance, and cavitation resistance are significantly improved.

<Manufacturing Process>

Next, the method of manufacturing the free-cutting copper alloy according to the first or second embodiment of the present invention is described below.

The metallographic structure of the alloy according to the embodiment varies not only depending on the composition but also depending on the manufacturing process. The metallographic structure of the alloy is affected not only by hot working temperature during hot extrusion and hot forging, heat treatment temperature, and heat treatment conditions but also by an average cooling rate in the process of cooling during hot working or heat treatment. As a result of a thorough study, it was found that the metallographic structure is largely affected by an average cooling rate in a temperature range from 575° C. to 510° C. and a cooling rate in a temperature range from 470° C. to 380° C. in the process of cooling during hot working or a heat treatment.

The manufacturing process according to the embodiment is a process required for the alloy according to the embodiment. Basically, the manufacturing process has the following important roles although they are affected by composition.

1) Reduce the amount of γ phase that deteriorates corrosion resistance and impact resistance and shorten the length of the long side of γ phase.

2) Control μ phase that deteriorates corrosion resistance and impact resistance as well as the length of the long side of μ phase.

3) Precipitate acicular κ phase in α phase.

4) Increase the amount (concentration) of Sn that is solid-solubilized in κ phase and α phase by reducing the amount of γ phase and the amount of Sn that is solid-solubilized in γ phase at the same time.

(Melt Casting)

Melting is performed at a temperature of about 950° C. to about 1200° C. that is higher than the melting point (liquidus temperature) of the alloy according to the embodiment by about 100° C. to about 300° C. Casting is performed at about 900° C. to about 1100° C. that is higher than the melting point by about 50° C. to about 200° C. The alloy is cast into a predetermined mold and is cooled by some cooling means such as air cooling, slow cooling, or water cooling. After solidification, constituent phase(s) changes in various ways.

(Hot Working)

Examples of hot working include hot extrusion and hot forging.

Although depending on production capacity of the equipment used, it is preferable that hot extrusion is performed when the temperature of the material during actual hot working, specifically, immediately after the material passes through an extrusion die, is 600° C. to 740° C. If hot working is performed when the material's temperature is higher than 740° C., a large amount of β phase is formed during plastic working, and β phase may remain. In addition, a large amount of γ phase remains and has an adverse effect on constituent phase(s) after cooling. In addition, even when a heat treatment is performed in the next step, the metallographic structure of a hot worked material is affected. Specifically, when hot working is performed at a temperature of higher than 740° C., the amount of γ phase is larger or a larger amount of γ phase remains than when hot working is performed at a temperature of 740° C. or lower. In addition, in some cases, hot working cracking may occur. The hot working temperature is preferably 670° C. or lower and more preferably 645° C. or lower.

During cooling, the material is cooled at an average cooling rate higher than 3° C./min and lower than 500° C./min in the temperature range from 470° C. to 380° C. The average cooling rate in the temperature range from 470° C. to 380° C. is more preferably 4° C./min or higher and still more preferably 8° C./min or higher. As a result, an increase in the amount of μ phase is prevented.

In addition, when the hot working temperature is low, hot deformation resistance increases. From the viewpoint of deformability, the lower limit of the hot working temperature is preferably 600° C. or higher and more preferably 605° C. or higher. Although depending on the extrusion rate, the shape, and the production capacity of the equipment used, it is preferable to perform hot working at the lowest possible temperature from the viewpoint of the constituent phase(s) of the metallographic structure.

In consideration of feasibility of measurement position, the hot working temperature is defined as a temperature of a hot worked material that can be measured three seconds after hot extrusion or hot forging. The metallographic structure is affected by a temperature immediately after working where large plastic deformation occurs.

Most of extruded materials are made of a brass alloy including 1 to 4 mass % of Pb. Typically, this kind of brass alloy is wound into a coil after hot extrusion unless the diameter of the extruded material exceeds, for example, about 38 mm. The heat of the ingot (billet) during extrusion is taken by an extrusion device such that the temperature of the ingot decreases. The extruded material comes into contact with a winding device such that heat is taken and the temperature further decreases. A temperature decrease of 50° C. to 100° C. from the temperature of the ingot at the start of the extrusion or from the temperature of the extruded material occurs when the average cooling rate is relatively high. Although depending on the weight of the coil and the like, the wound coil is cooled in a temperature range from 470° C. to 380° C. at a relatively low average cooling rate of about 2° C./min due to a heat keeping effect. After the material's temperature reaches about 300° C. when the Pb that is present in the metallographic structure of a brass has just solidified, the average cooling rate further declines. Therefore, water cooling is sometimes performed to facilitate the production. In the case of a brass alloy including Pb, hot extrusion is performed at about 600° C. to 800° C. In the metallographic structure immediately after extrusion, a large amount of β phase having excellent hot workability is present. When the average cooling rate after extrusion is high, a large amount of β phase remains in the cooled metallographic structure such that corrosion resistance, ductility, impact resistance, and high temperature properties deteriorate. In order to avoid the deterioration, by cooling at a relatively low average cooling rate using the heat keeping effect of the extruded coil and the like, β phase is made to transform into α phase so that the metallographic structure has abundant α phase. As described above, the average cooling rate of the extruded material is relatively high immediately after extrusion. Therefore, by performing the subsequent cooling at a slower cooling rate, a metallographic structure that is rich in α phase is obtained. Patent Document 1 does not describe the average cooling rate but discloses that, in order to reduce the amount of β phase and to isolate β phase, slow cooling is performed until the temperature of an extruded material is 180° C. lower.

As described above, the alloy according to the embodiment is manufactured with a cooling rate that is completely different from that in the method of manufacturing a conventional brass alloy including Pb.

(Hot Forging)

As a material in hot forging, a hot extruded material is mainly used, but a continuously cast rod is also used. Since hot forging is performed in a more complex shape than that in hot extrusion, the temperature of the material before forging is high. However, the temperature of a hot forged material that is highly plastically worked and forms a main portion of a forged product, that is, the material's temperature about three seconds after forging is preferably 600° C. to 740° C. as in the case of the hot extruded material.

After hot forging, the hot forged material is cooled in a temperature range from 575° C. to 510° C. at an average cooling rate of 0.1° C./min to 2.5° C./min. Subsequently, the cooled material is cooled in a temperature range from 470° C. to 380° C. at an average cooling rate of higher than 3° C./min and lower than 500° C./min. The average cooling rate in a temperature range from 470° C. to 380° C. is more preferably 4° C./min or higher and still more preferably 8° C./min or higher. As a result, an increase in the amount of μ phase is prevented.

When the material in hot forging is a hot extruded material, by preferably lowering the extrusion temperature to obtain a metallographic structure including a small amount of γ phase, a hot forged material with metallographic structure including a small amount of γ phase can be obtained even if the hot forging temperature is high.

(Cold Working Step)

In order to improve the dimensional accuracy or to straighten the extruded coil, cold working may be performed on the hot extruded material. Specifically, the hot extruded material or the heat treated material is cold-drawn at a working ratio of about 2% to about 20%, preferably about 2% to about 15% and more preferably about 2% to about 10% and then is corrected (combined operation of drawing and straightness correction). In addition, the hot extruded material or the heat treated material is wire-drawn in a cold state at a working ratio of about 2% to about 20%, preferably about 2% to about 15%, and more preferably about 2% to about 10%. Although the cold working ratio is substantially zero, the straightness of the rod material can be improved using a straightness correction facility.

(Heat Treatment (Annealing))

When it is desired to perform work on a material having a small size on which, for example, hot extrusion cannot be performed, a heat treatment is optionally performed after cold drawing or cold wire drawing such that the material recrystallized, that is, is softened. In addition, regarding the hot worked material, in the case a material having substantially no work strain is required, or an appropriate metallographic structure is required, a heat treatment is optionally performed after hot working. Likewise, in the case of a brass alloy including Pb, a heat treatment is optionally performed. In the case of the brass alloy including Bi disclosed in Patent Document 1, a heat treatment is performed under conditions of 350° C. to 550° C. and 1 to 8 hours.

Even in the case of the alloy according to the embodiment, an appropriate metallographic structure can be obtained by the heat treatment including the cooling after hot working. When a heat treatment is performed under at a temperature of higher than 620° C., a large amount of γ phase or β phase is formed, and α phase is coarsened. Heating may be performed at 620° C. or lower, and a heat treatment at a temperature of 575° C. or lower is desired in consideration of a decrease in the proportion of γ phase. In a heat treatment at a temperature of lower than 500° C., the proportion of γ phase increases, and μ phase precipitates. At a temperature of 500° C. or higher and lower than 510° C., merely a small amount of γ phase is eliminated, and a long period of time of heat treatment is necessary. Therefore, it is preferable to perform a heat treatment of 510° C. or higher. Accordingly, the heat treatment temperature is desirably 510° C. to 575° C. and is necessarily held in a temperature range of 510° C. to 575° C. for at least 20 minutes or longer. The heat treatment time (the time for which the material is held at the heat treatment temperature) is preferably 30 minutes to 480 minutes, more preferably 50 minutes or longer, and most preferably 70 minutes to 360 minutes. When a heat treatment is performed at 510° C. or higher and lower than 530° C., in order to reduce the amount of γ phase, twice or more heat treatment time is required compared with when a heat treatment is performed at 530° C. to 570° C.

A value relating to the heat treatment represented by the following numeral expression is defined by the heat treatment time (t) (min) and the heat treatment temperature (T) (° C.).

$$(\text{Value relating to Heat Treatment})=(T-500)\times t$$

Note that when T is 540° C. or higher, T is set as 540.

The value relating to the heat treatment is preferably 800 or higher and more preferably 1200 or higher.

Using the high temperature state of hot extrusion or hot forging, cooling is performed under conditions corresponding to holding in a temperature range of 510° C. to 575° C. for 20 minutes or longer by adjusting the average cooling rate, that is, cooling is performed in a temperature range from 575° C. to 510° C. at an average cooling rate of 0.1° C./min to 2.5° C./min in the process of cooling. As a result, the metallographic structure can be improved. Cooling in a temperature range from 575° C. to 510° C. at 2.5° C./min is equivalent to holding in a temperature range of 510° C. to 575° C. for at least 20 minutes in terms of time. Further, it is preferable that cooling is performed in a temperature range from 570° C. to 530° C. at an average cooling rate of 2° C./min or lower. The average cooling rate in a temperature range from 575° C. to 510° C. is preferably 2° C./min or lower and more preferably 1° C./min or lower. The lower limit of the average cooling rate is set to be 0.1° C./min or higher in consideration of economic efficiency.

On the other hand, in the case of a continuous heat treatment furnace in which the material moves along a heat source, if the temperature is higher than 620° C., the above-described problem occurs. However, cooling is performed under conditions corresponding to increasing the material's temperature to be about 560° C. to 620° C. and subsequently holding in a temperature range of 510° C. to 575° C. for 20 minutes or longer, that is, cooling is performed in a temperature range from 575° C. to 510° C. at an average cooling rate of 0.1° C./min to 2.5° C./min. As a result, the metallographic structure can be improved. The average cooling rate in a temperature range from 575° C. to 525° C. is preferably 2° C./min or lower and more preferably 1° C./min or lower. Further, the average cooling rate in a temperature range from 570° C. to 530° C. is preferably 2° C./min or lower and more preferably 1° C./min or lower. In this facility (continuous heat treatment furnace), productivity is emphasized, and thus there is a limit on passage time. For example, in the case the maximum reaching temperature is 540° C., it is necessary that the material passes through the continuous heat treatment furnace in a temperature range from 540° C. to 510° C. for at least 20 minutes or longer, and there is a large limit. if the temperature is increased to be 575° C. or a temperature slightly higher than 560° C., productivity can be secured, and a more desirable metallographic structure can be obtained.

In this heat treatment, the material is cooled to normal temperature, and it is necessary that the average cooling rate in a temperature range from 470° C. to 380° C. is higher than 3° C./min and lower than 500° C./min. That is, from about 500° C. or higher, it is necessary to adjust the average cooling rate to be high. During cooling in a general heat treatment, the average cooling rate is low at a lower temperature. However, it is preferable that the process of cooling from 470° C. to 380° C. is performed at a higher cooling rate.

A method of controlling the cooling rate after the heat treatment and hot working has an advantageous effect in that the proportions of γ phase and μ phase are reduced, the amount of solid solution of Sn in κ phase is increased, and κ phase is precipitated in α phase. As a result, an alloy having excellent corrosion resistance, cavitation resistance, and erosion-corrosion resistance and having excellent impact resistance, ductility, strength, and machinability can be prepared. In addition, cold working, for example, drawing or wire drawing at a cold working ratio of about 2% to 15% or 10% is performed, and subsequently a heat treatment is performed at 510° C. to 575° C. As a result, the tensile strength is further improved as compared to that of a hot worked material, and impact resistance is higher than that of a hot worked material. Of course, a heat treatment may be performed on a hot worked material at 510° C. to 575° C., and subsequently cold drawing or wire drawing may be performed at a cold working ratio of about 2% to 15% or 10%. This way, by adopting a special manufacturing process, an alloy having excellent corrosion resistance, cavitation resistance, and erosion-corrosion resistance and having excellent impact resistance, ductility, strength, and machinability can be prepared.

Regarding the metallographic structure of the alloy according to the embodiment, one important thing in the manufacturing step is the average cooling rate in the temperature range from 470° C. to 380° C. in the process of cooling after slow cooling following heat treatment or hot working. If the average cooling rate is 3° C./min or lower, the proportion of μ phase increases. μ phase is mainly formed around a grain boundary or a phase boundary. In a harsh environment, the corrosion resistance of μ phase is lower than that of α phase or κ phase. Therefore, selective corrosion of μ phase or grain boundary corrosion is caused to occur. In addition, as in the case of γ phase, μ phase becomes a stress concentration source or causes grain boundary sliding to occur such that impact resistance or high-temperature strength deteriorates. Preferably, in the process of cooling after hot working, the average cooling rate in the temperature range from 470° C. to 380° C. is higher than 3° C./min, more preferably 4° C./min or higher, still more preferably 8° C./min or higher, and most preferably 12° C./min or higher. When rapid cooling from a high material temperature of 580° C. or higher is performed after hot working at an average cooling rate of, for example, 500° C./min or higher, a large amount of β phase or γ phase may remain. Therefore, the upper limit of the average cooling rate is preferably lower than 500° C./min and more preferably 300° C./min or lower.

When the metallographic structure is observed using a 2000-fold or 5000-fold electron microscope, it can be seen that the average cooling rate in a temperature range from 470° C. to 380° C., which decides whether μ phase appears or not, is 8° C./min. In particular, the critical average cooling rate that significantly affect the properties is 2.5° C./min or 4° C./min in a temperature range from 470° C. to 380° C. Of course, whether or not μ phase appears also depends on the other constituent phases and the alloy's composition.

That is, when the average cooling rate in a temperature range from 470° C. to 380° C. is lower than 8° C./min, the length of the long side of μ phase precipitated at a grain boundary is longer than about 1 μm, and μ phase further grows as the average cooling rate becomes lower. When the average cooling rate is about 5° C./min, the length of the long side of μ phase is about 3 μm to 10 μm. When the average cooling rate is about 2.5° C./min or lower, the length of the long side of μ phase is higher than 15 μm and, in some cases, is higher than 25 μm. When the length of the long side of μ phase reaches about 10 μm, μ phase can be distinguished from a grain boundary and can be observed using a 1000-fold metallographic microscope. On the other hand, the upper limit of the average cooling rate varies depending on the hot working temperature or the like. If the average cooling rate is excessively high, constituent phase(s) that is formed at a high temperature is maintained as it is even at normal temperature, the amount of κ phase increases, and the amounts of β phase and γ phase that affect corrosion resistance and impact resistance increase. Therefore, mainly, the average cooling rate in a temperature range of 575° C. or higher is important. It is preferable that cooling is performed at an average cooling rate of preferably lower than 500° C./min, and more preferably 300° C./min or lower.

Currently, for most of extrusion materials of a copper alloy, brass alloy including 1 to 4 mass % of Pb is used. In the case of the brass alloy including Pb, as disclosed in Patent Document 1, a heat treatment is performed at a temperature of 350° C. to 550 as necessary. The lower limit of 350° C. is a temperature at which recrystallization occurs and the material softens almost entirely. At the upper limit of 550° C., the recrystallization ends. Heat treatment at a higher temperature causes a problem in relation to energy. In addition, when a heat treatment is performed at a temperature of higher than 550° C., the amount of β phase significantly increases. As a common manufacturing facility, a batch furnace or a continuous furnace is used, and the material is held at a predetermined temperature for 1 to 8 hours. In the case a batch furnace is used, air cooling is performed after furnace cooling or after the material's temperature decreases to about 300° C. In the case a continuous furnace is used, cooling is performed at a relatively low rate until the material's temperature decreases to about 300° C. Specifically, in a temperature range from 470° C. to 380° C., cooling is performed at an average cooling rate of about 0.5 to about 3° C./min (excluding the time during which the material is held at a predetermined temperature from the calculation of the average cooling rate). Cooling is performed at a cooling rate that is different from that of the method of manufacturing the alloy according to the embodiment.

(Low-Temperature Annealing)

A rod material or a forged product may be annealed at a low temperature which is lower than the recrystallization temperature in order to remove residual stress or to correct the straightness of rod material. As low-temperature annealing conditions, it is desired that the material's temperature is 240° C. to 350° C. and the heating time is 10 minutes to 300 minutes. Further, it is preferable that the low-temperature annealing is performed so that the relation of $150 \leq (T-220) \times (t)^{1/2} \leq 1200$, wherein the temperature (material's temperature) of the low-temperature annealing is represented by T (° C.) and the heating time is represented by t (min), is satisfied. Note that the heating time t (min) is counted from when the temperature is 10° C. lower (T−10) than a predetermined temperature T (° C.)

When the low-temperature annealing temperature is lower than 240° C., residual stress is not removed sufficiently, and straightness correction is not sufficiently performed. When the low-temperature annealing temperature is higher than 350° C., μ phase is formed around a grain boundary or a phase boundary. When the low-temperature annealing time is shorter than 10 minutes, residual stress is not removed sufficiently. When the low-temperature annealing time is longer than 300 minutes, the amount of μ phase increases. As the low-temperature annealing temperature increases or the low-temperature annealing time increases, the amount of μ phase increases, and corrosion resistance, impact resistance, and high-temperature strength deteriorate. However, as long as low-temperature annealing is performed, precipitation of μ phase is not avoidable. Therefore, how precipitation of μ phase can be minimized while removing residual stress is the key.

The lower limit of the value of $(T-220) \times (t)^{1/2}$ is 150, preferably 180 or higher, and more preferably 200 or higher. In addition, the upper limit of the value of $(T-220) \times (t)^{1/2}$ is 1200, preferably 1100 or lower, and more preferably 1000 or lower.

Using this manufacturing method, the free-cutting copper alloys according to the first and second embodiments of the present invention are manufactured.

The hot working step, the heat treatment (annealing) step, and the low-temperature annealing step are steps of heating the copper alloy. When the low-temperature annealing step is not performed, or the hot working step or the heat treatment (annealing) step is performed after the low-temperature annealing step (when the low-temperature annealing step is not the final step among the steps of heating the copper alloy), the step that is performed later among the hot working steps and the heat treatment (annealing) steps is important, regardless of whether cold working is performed. When the hot working step is performed after the heat treatment (annealing) step, or the heat treatment (annealing) step is not performed after the hot working step (when the hot working step is the final step among the steps of heating the copper alloy), it is necessary that the hot working step satisfies the above-described heating conditions and cooling conditions. When the heat treatment (annealing) step is performed after the hot working step, or the hot working step is not performed after the heat treatment (annealing) step (a case where the heat treatment (annealing) step is the final step among the steps of heating the copper alloy), it is necessary that the heat treatment (annealing) step satisfies the above-described heating conditions and cooling conditions. For example, in cases where the heat treatment (annealing) step is not performed after the hot forging step, it is necessary that the hot forging step satisfies the above-described heating conditions and cooling conditions for hot forging. In cases where the heat treatment (annealing) step is performed after the hot forging step, it is necessary that the heat treatment (annealing) step satisfies the above-described heating conditions and cooling conditions for heat treatment (annealing). In this case, it is not necessary that the hot forging step satisfies the above-described heating conditions and cooling conditions for hot forging.

In the low-temperature annealing step, the material's temperature is 240° C. to 350° C. This temperature relates to whether or not μ phase is formed, and does not relate to the temperature range (575° C. to 510° C.) where the amount of γ phase is reduced. This way, the material's temperature in the low-temperature annealing step does not relate to an increase or decrease in the amount of γ phase. Therefore, when the low-temperature annealing step is performed after the hot working step or the heat treatment (annealing) step (the low-temperature annealing step is the final step among the steps of heating the copper alloy), the conditions of the low-temperature annealing step and the heating conditions and cooling conditions of the step before the low-temperature annealing step (the step of heating the copper alloy immediately before the low-temperature annealing step) are both important, and it is necessary that the low-temperature annealing step and the step before the low-temperature annealing step satisfy the above-described heating conditions and the cooling conditions. Specifically, the heating conditions and cooling conditions of the step that is performed last among the hot working steps and the heat treatment (annealing) steps performed before the low-temperature annealing step are important, and it is necessary that the above-described heating conditions and cooling conditions are satisfied. When the hot working step or the heat treatment (annealing) step is performed after the low-temperature annealing step, as described above, the step that is performed last among the hot working steps and the heat treatment (annealing) steps is important, and it is necessary that the above-described heating conditions and cooling conditions are satisfied. The hot working step or the heat treatment (annealing) step may be performed before or after the low-temperature annealing step.

In the free-cutting alloy according to the first or second embodiment of the present invention having the above-described constitution, the alloy composition, the composition relational expressions, the metallographic structure, and the metallographic structure relational expressions are defined as described above. Therefore, corrosion resistance in a harsh environment, cavitation resistance, erosion-corrosion resistance, wear resistance, impact resistance, normal-temperature strength, and high-temperature properties are excellent. In addition, even if the Pb content is low, excellent machinability can be obtained.

The embodiments of the present invention are as described above. However, the present invention is not limited to the embodiments, and appropriate modifications can be made within a range not deviating from the technical requirements of the present invention.

EXAMPLES

The results of an experiment that was performed to verify the effects of the present invention are as described below. The following Examples are shown in order to describe the effects of the present invention, and the requirements for composing the example alloys, processes, and conditions included in the descriptions of the Examples do not limit the technical range of the present invention.

Example 1

<Experiment on the Actual Production Line>

Using a low-frequency melting furnace and a semi-continuous casting machine on the actual production line, a trial manufacture test of copper alloy was performed. Table 2 shows alloy compositions. Since the equipment used was the one on the actual production line, impurities were also measured in the alloys shown in Table 2. In addition, manufacturing steps were performed under the conditions shown in Tables 5 to 10.

(Steps No. A1 to A12 and AH1 to AH4)

Using the low-frequency melting furnace and the semi-continuous casting machine on the actual production line, a billet having a diameter of 240 mm was manufactured. As to raw materials, those used for actual production were used. The billet was cut into a length of 800 mm and was heated. Then hot extruded into a round bar shape having a diameter of 25.6 mm, and the rod bar was wound into a coil (extruded material). The temperature was measured using a radiation thermometer at the center of a final stage of hot extrusion. In this case, the temperature of the extruded material was measured about three seconds after extruded from an extruder. A radiation thermometer DS-06DF (manufactured by Daido Steel Co., Ltd.) was used.

It was verified that the average temperature of the extruded material was within ±5° C. of a temperature shown in Table 5 (in a range of (temperature shown in Table 5) −5° C. to (temperature shown in Table 5) +5° C.).

In Step No. AH1, after the end of preparation of a sample by extrusion, the sample was still in the extruded state. In Step No. AH2, after extrusion, combined drawing and correction were performed at a cold rolling reduction of 4.7% to obtain a diameter of 25.0 mm. In Steps No. A1 to A6, A9, and AH3 to AH6, combined drawing and correction were performed at a cold rolling reduction of 4.7% to obtain a diameter of 25.0 mm. Next, a heat treatment was performed in a batch furnace under various conditions, and the average cooling rate was made to vary. In Step No. A12, combined drawing and correction were performed at a cold rolling reduction of 8.5% to obtain a diameter of 24.5 mm. In Steps No. A7, A8, AH7, and AH8, a heat treatment was performed in a continuous heat treatment furnace. In Step No. AH9, extrusion was performed at an extrusion temperature of 580° C.

In Steps No. A10 and A11, a heat treatment was performed on an extruded material having a diameter of 25.5 mm in a batch furnace, and subsequently combined drawing and correction were performed. As a result, the diameter was 25.0 mm in Step No. A10. In Step No. A11, the cold working ratio during combined drawing and correction was set to 8.5% to obtain a diameter of 24.5 mm.

In the following tables, a case where the combined drawing and correction were performed before the heat treatment was represented by "O", and a case where the combined drawing and correction were not performed before the heat treatment was represented by "−".

(Steps No. B1 to B3 and BH1 to BH3)

A material (rod material) having a diameter of 25 mm obtained in Step No. A10 was cut into a length of 3 m. Next, this rod material was set in a mold and was annealed at a low temperature for straightness correction. The conditions of this low-temperature annealing are shown in Table 7.

The conditional expression indicated in Table 7 is as follows:

$$(\text{Conditional Expression})=(T-220)\times(t)^{1/2}$$

T: temperature (material's temperature) (° C.)

t: heating time (min)

(Step No. C0)

Using the low-frequency melting furnace and the semi-continuous casting machine used on the actual production line, an ingot (billet) having a diameter of 240 mm was manufactured. As to raw materials, raw materials corresponding to those used for actual production were used. The billet was cut into a length of 500 mm and was heated. Hot extrusion was performed to obtain a round bar-shaped extruded material having a diameter of 50 mm. This extruded material was extruded onto an extrusion table in a straight rod shape. The temperature was measured using a radiation thermometer mainly at the final stage of extrusion about three seconds after extrusion from an extruder. It was verified that the average temperature of the extruded material was within ±5° C. of a temperature shown in Table 8 (in a range of (temperature shown in Table 8) −5° C. to (temperature shown in Table 8) +5° C.)

(Steps No. C1, C2, CH1, and CH2)

In Steps No. C1, C2, and CH1, a heat treatment (annealing) was performed on the extruded material (round bar) obtained in Step No. C0 in a batch furnace. The heat treatment was performed while making the average cooling rate from 470° C. to 380° C. to vary.

In Step No. CH2, an extruded material (round bar) was prepared under the same conditions as in Step No. C0, except that the temperature of hot extrusion was 760° C. Next, a heat treatment (annealing) was performed in a batch furnace.

The extruded material obtained in Step No. C0 and some of the heat treated materials obtained in Steps No. C1, C2, CH1, and CH2 were used in an abrasion test.

(Steps No. D1 to D7 and DH1 to DH5)

An extruded material (round bar) having a diameter of 50 mm obtained in Step No. C0 was cut into a length of 180 mm. This round bar was horizontally set and was forged into a thickness of 16 mm using a press machine having a hot forging press capacity of 150 ton. About three seconds immediately after hot forging the material into a predetermined thickness, the temperature was measured using the radiation thermometer. It was verified that the hot forging temperature (hot working temperature) was within ±5° C. of a temperature shown in Table 9 (in a range of (temperature shown in Table 9) −5° C. to (temperature shown in Table 9) +5° C.).

Next, a heat treatment was performed in a batch furnace in Steps No. D1 to D4 and DH2, and a heat treatment was performed in a continuous furnace in Steps No. D5, D6, DH3, and DH4. The heat treatment temperature, the holding time, the average cooling rate in a temperature range from 575° C. to 525° C., and the average cooling rate in a temperature range from 470° C. to 380° C. in the process of cooling were made to vary. The heat treatment temperature was a temperature shown in Table 9±5° C. (range of (temperature shown in Table 9) −5° C. to (temperature shown in Table 9) +5° C.), and the time for which the material was held in this temperature range was set as a heat treatment time (holding time).

<Laboratory Experiment>

Using a laboratory facility, a trial manufacture test of copper alloy was performed. Tables 3 and 4 show alloy compositions. The balance refers to Zn and inevitable impurities. The copper alloys having the compositions shown in Table 2 were also used in the laboratory experiment. In addition, manufacturing steps were performed under the conditions shown in Tables 11 to 12.

(Steps No. E1, E2, E3 and EH1)

In a laboratory, raw materials were mixed at a predetermined component ratio and melted. The melt was cast into a mold having a diameter of 100 mm and a length of 180 mm to prepare a billet. This billet was heated and, in Steps No. E1 and EH1, was extruded into a round bar having a diameter of 25 mm, then the bar's straightness was corrected. In Steps No. E2 and E3, the billet was extruded into a round bar having a diameter of 40 mm, then the straightness was corrected. In Table 11, if straightness correction was performed, "O" is indicated.

Immediately after stopping the extrusion test machine, the temperature was measured using a radiation thermometer. In effect, this temperature corresponds to the temperature of the extruded material about three seconds after being extruded from the extruder.

In Steps No. EH1 and E2, the preparation operations of the samples ended with the extrusion.

The extruded material obtained in Step No. E2 was used as a material for hot forging in steps described below. In addition, a part of the extruded material obtained in Step No. E2 was used as a material for the abrasion test.

A continuously cast rod having a diameter of 40 mm was prepared by continuous casting and was used as a material for hot forging in steps described below.

In Steps No. E1 and E3, a heat treatment (annealing) was performed under conditions shown in Table 11 after extrusion. A part of the heat treated material obtained in Step No. E3 was used as an abrasion test material.

Molten copper alloy obtained in the low-frequency melting furnace of Step No. A was cast into a mold having an outer diameter of 100 mm and a length of 180 mm to prepare a billet. This billet was extruded into a round bar having a diameter of 25 or 40 mm under the same conditions as in the above-described steps. As in the above case, Step No. E1, E2, E3, or EH1 was added to these materials (round bars).

(Steps No. F1 to F3, FH1, and FH2)

A round bar having a diameter of 40 mm obtained in Step No. E2 was cut into a length of 180 mm. This round bar was horizontally set and was forged into a thickness of 15 mm using a press machine having a hot forging press capacity of 150 ton. About three seconds immediately after hot forging the material into a predetermined thickness, the temperature was measured using the radiation thermometer. It was verified that the hot forging temperature (hot working temperature) was within ±5° C. of a temperature shown in Table 12 (in a range of (temperature shown in Table 12) −5° C. to (temperature shown in Table 12) +5° C.). In Steps F1 to F3 and FH2, a heat treatment was performed on the forged material using a batch furnace or a continuous heat treatment furnace of a laboratory under different conditions and different average cooling rates.

(Steps No. F4, F5, and FH3)

A continuously cast rod having a diameter of 40 mm was prepared by continuous casting and was used as a material for forging. The obtained round bar (continuously cast rod) having a diameter of 40 mm was cut into a length of 180 mm. This round bar was horizontally set and was forged into a thickness of 15 mm using a press machine having a hot forging press capacity of 150 ton. In Steps No. F4 and F5, a heat treatment was further performed under conditions shown in Table 12.

TABLE 2

| Alloy | Component Composition (mass %) | | | | | | Impurities (mass %) | | | | Composition Relational Expression | | |
|---|---|---|---|---|---|---|---|---|---|---|---|---|---|
| No. | Cu | Si | Pb | Sn | P | Zn | Element | Amount | Element | Amount | f1 | f2 | f3 |
| S01 | 77.5 | 3.37 | 0.050 | 0.48 | 0.09 | Balance | Fe | 0.04 | Ni | 0.03 | 76.2 | 62.3 | 0.19 |
| | | | | | | | Al | 0.005 | Ag | 0.03 | | | |
| | | | | | | | Cr | 0.009 | B | 0.005 | | | |
| | | | | | | | Se | 0.001 | Co | 0.003 | | | |
| S02 | 77.9 | 3.45 | 0.050 | 0.66 | 0.11 | Balance | Fe | 0.02 | Ni | 0.04 | 75.2 | 62.2 | 0.17 |
| | | | | | | | Ag | 0.01 | Zr | 0.001 | | | |
| | | | | | | | Cr | 0.012 | Te | 0.001 | | | |
| | | | | | | | S | 0.0004 | | | | | |
| S03 | 76.9 | 3.24 | 0.050 | 0.41 | 0.08 | Balance | Fe | 0.03 | Ni | 0.04 | 76.1 | 62.3 | 0.20 |
| | | | | | | | Al | 0.002 | Ag | 0.01 | | | |
| | | | | | | | Mn | 0.008 | Bi | 0.017 | | | |
| | | | | | | | Sb | 0.008 | Rare Earth Element | 0.001 | | | |
| | | | | | | | C | 0.0001 | S | 0.0004 | | | |

TABLE 3

| Alloy | Component Composition (mass %) | | | | | | | Composition Relational Expression | | |
|---|---|---|---|---|---|---|---|---|---|---|
| No. | Cu | Si | Pb | Sn | P | Others | Zn | f1 | f2 | f3 |
| S11 | 78.1 | 3.50 | 0.036 | 0.75 | 0.12 | | Balance | 74.7 | 62.1 | 0.16 |
| S12 | 76.7 | 3.26 | 0.033 | 0.40 | 0.08 | | Balance | 76.0 | 62.0 | 0.20 |
| S13 | 78.6 | 3.58 | 0.048 | 0.51 | 0.08 | | Balance | 77.2 | 62.4 | 0.16 |
| S14 | 78.5 | 3.52 | 0.045 | 0.48 | 0.10 | | Balance | 77.4 | 62.6 | 0.21 |
| S15 | 78.0 | 3.47 | 0.023 | 0.65 | 0.11 | | Balance | 75.4 | 62.2 | 0.17 |
| S16 | 78.4 | 3.52 | 0.028 | 0.75 | 0.08 | | Balance | 74.9 | 62.3 | 0.11 |
| S17-1 | 78.8 | 3.58 | 0.026 | 0.80 | 0.11 | | Balance | 75.0 | 62.4 | 0.14 |
| S17-2 | 78.8 | 3.58 | 0.026 | 0.80 | 0.09 | | Balance | 75.0 | 62.4 | 0.11 |
| S18 | 77.0 | 3.26 | 0.040 | 0.44 | 0.14 | | Balance | 76.0 | 62.2 | 0.32 |
| S19 | 77.8 | 3.49 | 0.048 | 0.53 | 0.06 | | Balance | 76.2 | 62.0 | 0.11 |
| S20 | 77.7 | 3.48 | 0.022 | 0.68 | 0.11 | | Balance | 74.8 | 61.8 | 0.16 |
| S21 | 78.1 | 3.44 | 0.027 | 0.64 | 0.09 | | Balance | 75.5 | 62.4 | 0.14 |
| S22 | 77.0 | 3.45 | 0.047 | 0.44 | 0.09 | | Balance | 76.1 | 61.4 | 0.20 |
| S23 | 76.4 | 3.11 | 0.044 | 0.38 | 0.06 | | Balance | 75.7 | 62.4 | 0.16 |
| S24 | 76.4 | 3.24 | 0.037 | 0.38 | 0.11 | | Balance | 75.9 | 61.8 | 0.29 |
| S25 | 77.6 | 3.40 | 0.044 | 0.50 | 0.06 | | Balance | 76.2 | 62.3 | 0.12 |
| S26 | 78.0 | 3.47 | 0.049 | 0.65 | 0.14 | | Balance | 75.4 | 62.2 | 0.22 |
| S27 | 78.2 | 3.54 | 0.047 | 0.77 | 0.09 | | Balance | 74.6 | 62.0 | 0.12 |
| S31 | 77.9 | 3.42 | 0.041 | 0.57 | 0.07 | Sb: 0.04, As: 0.03, Bi: 0.05 | Balance | 75.9 | 62.4 | 0.12 |
| S32 | 77.6 | 3.41 | 0.045 | 0.51 | 0.10 | As: 0.04, Bi: 0.04 | Balance | 76.1 | 62.2 | 0.20 |
| S33 | 77.3 | 3.35 | 0.031 | 0.49 | 0.07 | Sb: 0.03, Bi: 0.03 | Balance | 75.9 | 62.2 | 0.14 |
| S34 | 78.5 | 3.53 | 0.047 | 0.40 | 0.09 | Sb: 0.04, As: 0.04 | Balance | 78.0 | 62.6 | 0.23 |

TABLE 4

| Alloy | Component Composition (mass %) | | | | | | | Composition Relational Expression | | |
|---|---|---|---|---|---|---|---|---|---|---|
| No. | Cu | Si | Pb | Sn | P | Others | Zn | f1 | f2 | f3 |
| S51 | 75.5 | 3.12 | 0.049 | 0.46 | 0.09 | | Balance | 74.2 | 61.4 | 0.20 |
| S52 | 76.9 | 3.18 | 0.043 | 0.64 | 0.07 | | Balance | 74.1 | 62.4 | 0.11 |
| S53 | 79.4 | 3.60 | 0.033 | 0.46 | 0.11 | | Balance | 78.5 | 63.1 | 0.24 |
| S54 | 78.8 | 3.70 | 0.044 | 0.49 | 0.10 | | Balance | 77.7 | 62.1 | 0.20 |
| S55 | 76.3 | 3.02 | 0.042 | 0.41 | 0.11 | | Balance | 75.4 | 62.6 | 0.27 |

TABLE 4-continued

| Alloy | Component Composition (mass %) | | | | | | | Composition Relational Expression | | |
|---|---|---|---|---|---|---|---|---|---|---|
| No. | Cu | Si | Pb | Sn | P | Others | Zn | f1 | f2 | f3 |
| S56 | 77.5 | 3.12 | 0.043 | 0.40 | 0.09 | | Balance | 76.7 | 63.4 | 0.23 |
| S57 | 76.7 | 3.50 | 0.042 | 0.55 | 0.09 | | Balance | 74.9 | 60.8 | 0.16 |
| S58 | 77.9 | 3.19 | 0.063 | 0.43 | 0.07 | | Balance | 76.9 | 63.5 | 0.16 |
| S59 | 78.7 | 3.57 | 0.040 | 0.87 | 0.11 | | Balance | 74.3 | 62.3 | 0.13 |
| S60 | 76.7 | 3.11 | 0.060 | 0.36 | 0.08 | | Balance | 76.2 | 62.7 | 0.22 |
| S61 | 77.1 | 3.42 | 0.040 | 0.45 | 0.17 | | Balance | 76.2 | 61.6 | 0.38 |
| S62 | 78.2 | 3.53 | 0.030 | 0.64 | 0.06 | | Balance | 75.7 | 62.2 | 0.09 |
| S63 | 76.8 | 3.20 | 0.038 | 0.38 | 0.14 | | Balance | 76.3 | 62.3 | 0.37 |
| S64 | 77.4 | 3.23 | 0.031 | 0.63 | 0.07 | | Balance | 74.7 | 62.7 | 0.11 |
| S65 | 76.2 | 3.43 | 0.046 | 0.41 | 0.09 | | Balance | 75.6 | 60.8 | 0.22 |
| S66 | 77.2 | 3.33 | 0.038 | 0.24 | 0.10 | | Balance | 77.9 | 62.3 | 0.42 |
| S67 | 75.8 | 3.12 | 0.040 | 0.33 | 0.09 | | Balance | 75.6 | 61.8 | 0.27 |
| S68 | 76.3 | 3.12 | 0.035 | 0.07 | 0.06 | | Balance | 78.3 | 62.5 | 0.86 |
| S69 | 77.2 | 3.30 | 0.045 | 0.68 | 0.09 | | Balance | 74.2 | 62.1 | 0.13 |
| S70 | 78.2 | 3.27 | 0.045 | 0.51 | 0.07 | | Balance | 76.6 | 63.4 | 0.14 |
| S71 | 77.1 | 3.32 | 0.039 | 0.72 | 0.06 | | Balance | 73.7 | 61.9 | 0.08 |
| S72 | 76.6 | 3.00 | 0.028 | 0.09 | 0.08 | | Balance | 78.3 | 63.3 | 0.89 |
| S73 | 76.2 | 3.16 | 0.036 | 0.03 | 0 | | Balance | 78.5 | 62.3 | 0 |
| S74 | 77.0 | 3.36 | 0.048 | 0.04 | 0.03 | | Balance | 79.4 | 62.2 | 0.75 |
| S75 | 76.5 | 3.11 | 0.004 | 0.38 | 0.07 | | Balance | 75.8 | 62.5 | 0.18 |
| S76 | 78.3 | 3.69 | 0.044 | 0.58 | 0.10 | | Balance | 76.4 | 61.6 | 0.17 |
| S77 | 77.3 | 3.35 | 0.050 | 0.47 | 0.04 | | Balance | 76.1 | 62.2 | 0.09 |
| S78 | 78.5 | 3.55 | 0.030 | 0.72 | 0.06 | | Balance | 75.3 | 62.3 | 0.08 |
| S79 | 76.5 | 3.14 | 0.044 | 0.41 | 0.07 | Fe: 0.13 | Balance | 75.6 | 62.3 | 0.17 |
| S80 | 77.0 | 3.25 | 0.048 | 0.04 | 0.03 | | Balance | 79.3 | 62.7 | 0.75 |
| S81 | 77.8 | 3.53 | 0.022 | 0.69 | 0.12 | Fe: 0.10, Cr: 0.03 | Balance | 74.9 | 61.7 | 0.17 |
| S82 | 78.1 | 3.49 | 0.045 | 0.67 | 0.11 | Sb: 0.10, As: 0.03 | Balance | 75.3 | 62.2 | 0.16 |

TABLE 5

| Step No. | Hot Extrusion | | | Combined Operation of Drawing and Straightness Correction before Heat Treatment | Diameter of Extuder Material before Heat Treatment (mm) | Heat Treatment (Annealing) | | | | |
|---|---|---|---|---|---|---|---|---|---|---|
| | Temperature (° C.) | Cooling Rate from 575° C. to 510° C. (° C./min) | Cooling Rate from 470° C. to 380° C. (° C./min) | | | Kind of Furnace | Temperature (° C.) | Time (min) | Cooling Rate from 575° C. to 510° C. (° C./min) | Cooling Rate from 470° C. to 380° C. (° C./min) |
| A1 | 640 | 20 | 20 | ○ | 25.0 | Batch Furnace | 540 | 160 | 15 | 20 |
| A2 | 640 | 20 | 20 | ○ | 25.0 | Batch Furnace | 540 | 160 | 15 | 14 |
| A3 | 640 | 20 | 20 | ○ | 25.0 | Batch Furnace | 540 | 160 | 15 | 7 |
| A4 | 640 | 20 | 20 | ○ | 25.0 | Batch Furnace | 540 | 160 | 15 | 3.6 |
| A5 | 640 | 20 | 20 | ○ | 25.0 | Batch Furnace | 520 | 160 | 15 | 20 |
| A6 | 640 | 20 | 20 | ○ | 25.0 | Batch Furnace | 520 | 30 | 15 | 20 |
| A7 | 640 | 20 | 20 | ○ | 25.0 | Continuous Furnace | 600 | 5 | 2 | 10 |
| A8 | 640 | 20 | 20 | ○ | 25.0 | Continuous Furnace | 600 | 5 | 1.2 | 10 |
| A9 | 680 | 20 | 20 | ○ | 25.0 | Batch Furnace | 540 | 80 | 15 | 20 |
| A10 | 640 | 20 | 20 | — | 25.5 | Batch Furnace | 540 | 80 | 15 | 20 |
| A11 | 640 | 20 | 20 | — | 25.5 | Batch Furnace | 540 | 80 | 15 | 20 |
| A12 | 640 | 20 | 20 | ○ (Cold Working Ratio 8.5%) | 24.5 | Batch Furnace | 540 | 80 | 15 | 20 |

TABLE 5-continued

| Step No. | Hot Extrusion: Temperature (° C.) | Hot Extrusion: Cooling Rate from 575° C. to 510° C. (° C./min) | Hot Extrusion: Cooling Rate from 470° C. to 380° C. (° C./min) | Combined Operation of Drawing and Straightness Correction before Heat Treatment | Diameter of Extuder Material before Heat Treatment (mm) | Heat Treatment (Annealing): Kind of Furnace | Heat Treatment (Annealing): Temperature (° C.) | Heat Treatment (Annealing): Time (min) | Heat Treatment (Annealing): Cooling Rate from 575° C. to 510° C. (° C./min) | Heat Treatment (Annealing): Cooling Rate from 470° C. to 380° C. (° C./min) |
|---|---|---|---|---|---|---|---|---|---|---|
| AH1 | 640 | 20 | 20 | Only Correction | 25.5 | | — | — | — | — |
| AH2 | 640 | 20 | 20 | ○ | 25.0 | | — | — | — | — |
| AH3 | 640 | 20 | 20 | ○ | 25.0 | Batch Furnace | 540 | 160 | 2.4 | 1.8 |
| AH4 | 640 | 20 | 20 | ○ | 25.0 | Batch Furnace | 540 | 160 | 1.5 | 1 |
| AH5 | 640 | 20 | 20 | ○ | 25.0 | Batch Furnace | 635 | 60 | 15 | 10 |
| AH6 | 640 | 20 | 20 | ○ | 25.0 | Batch Furnace | 500 | 160 | — | 20 |
| AH7 | 640 | 20 | 20 | ○ | 25.0 | Continuous Furnace | 600 | 5 | 8 | 10 |
| AH8 | 640 | 20 | 20 | ○ | 25.0 | Continuous Furnace | 600 | 10 | 1.8 | 1.6 |
| AH9 | 580 | 20 | 20 | Extrusion unable to be performed to the end. | | | | | | |

TABLE 6

| Step NO. | Note |
|---|---|
| Al | |
| A2 | |
| A3 | |
| A4 | The cooling rate from 470° C. to 380° C. was close to 3 ° C./min |
| A5 | The temperature was relatively low, but the holding time was relatively long |
| A6 | The temperature was relatively low, and the holding time was relatively short |
| A7 | The temperature was high, but the cooling rate from 575° C. to 510° C. was relatively low |
| A8 | The temperature was high, but the cooling rate from 575° C. to 510° C. was relatively low |
| A9 | |
| A10 | Combined drawing and straightness correction were performed after a heat treatment |
| A11 | Combined drawing and straightness correction were performed after a heat treatment (cold rolling reduction: 8.5%) |
| A12 | The step was substantially the same as Step No. Al |
| AH1 | |
| AH2 | |
| AH3 | Due to furnace cooling, the cooling rate was low |
| AH4 | Due to furnace cooling, the cooling rate was low |
| AHS | The temperature was high, and a phase was coarsened |
| AH6 | The temperature was low |
| AH7 | The temperature was high, and the cooling rate from 575° C. to 510° C. was high |
| AH8 | The cooling rate from 470° C. to 380° C. was low |
| AH9 | |

TABLE 7

| Step No. | Material | Low-Temperature Annealing Temperature (° C.) | Time (min) | Value of Conditional Expression |
|---|---|---|---|---|
| B1 | Rod Material obtained in Step A10 | 275 | 180 | 738 |
| B2 | | 320 | 75 | 866 |
| B3 | | 290 | 75 | 606 |
| BH1 | | 220 | 120 | — |
| BH2 | | 370 | 20 | — |
| BH3 | | 320 | 180 | 1342 |

Conditional Expression: $(T-220) \times (t)^{1/2}$
T: Temperature (° C.),
t: Time (min)

TABLE 8

| Step No. | Hot Extrusion Temperature (° C.) | Cooling Rate from 575° C. to 510° C. (° C./min) | Cooling Rate from 470° C. to 380° C. (° C./min) | Combined Operation of Drawing and Straightness Correction | Diameter of Extuder Material (mm) | Heat Treatment (Annealing) Temperature (° C.) | Time (min) | Cooling Rate from 575° C. to 510° C. (° C./min) | Cooling Rate from 470° C. to 380° C. (° C./min) |
|---|---|---|---|---|---|---|---|---|---|
| C0 | 640 | 15 | 15 | — | 50 | — | — | — | — |
| C1 | 640 | 15 | 15 | — | 50 | 560 | 60 | 15 | 12 |
| C2 | 640 | 15 | 15 | — | 50 | 560 | 60 | 15 | 5 |
| CH1 | 640 | 15 | 15 | — | 50 | 560 | 60 | 15 | 1.6 |
| CH2 | 760 | 15 | 15 | — | 50 | 560 | 60 | 15 | 12 |

TABLE 9

| Step No. | Material | Hot Forging Temperature (° C.) | Cooling Rate from 575° C. to 510° C. (° C./min) | Cooling Rate from 470° C. to 380° C. (° C./min) | Heat Treatment (Annealing) Kind of Furnace | Temperature (° C.) | Time (min) | Cooling Rate from 575° C. to 510° C. (° C./min) | Cooling Rate from 470° C. to 380° C. (° C./min) |
|---|---|---|---|---|---|---|---|---|---|
| D1 | C0 | 690 | 20 | 20 | Batch Furnace | 540 | 60 | 15 | 15 |
| D2 | C0 | 690 | 20 | 20 | Batch Furnace | 540 | 60 | 15 | 8 |
| D3 | C0 | 690 | 20 | 20 | Batch Furnace | 540 | 60 | 6 | 4.5 |
| D4 | C0 | 690 | 20 | 20 | Batch Furnace | 520 | 30 | 15 | 15 |
| D5 | C0 | 690 | 20 | 20 | Continuous Furnace | 600 | 3 | 2 | 15 |
| D6 | C0 | 690 | 20 | 20 | Continuous Furnace | 565 | 3 | 1 | 15 |
| D7 | C0 | 690 | 1.5 | 10 | | — | — | — | — |
| DH1 | C0 | 690 | 20 | 20 | | — | — | — | — |
| DH2 | C0 | 690 | 20 | 20 | Batch Furnace | 540 | 60 | 6 | 2 |
| DH3 | C0 | 690 | 20 | 20 | Continuous Furnace | 600 | 3 | 2 | 1.8 |
| DH4 | C0 | 690 | 20 | 20 | Continuous Furnace | 600 | 2 | 5 | 15 |
| DH5 | C0 | 690 | 3.5 | 10 | | — | — | — | — |

TABLE 10

| Step No. | Note |
|---|---|
| Dl | — |
| D2 | — |
| D3 | — |
| D4 | The temperature was relatively low, and the holding time was relatively short. |
| D5 | The cooling rate from 575° C. to 510° C. was relatively low. |
| D6 | The cooling rate from 575° C. to 510° C. was relatively low. |
| D7 | The cooling rate from 575° C. to 510° C. during hot forging was relatively low. |

TABLE 10-continued

| Step No. | Note |
|---|---|
| DH1 | — |
| DH2 | Due to furnace cooling, the cooling rate from 470° C. to 380° C. was low. |
| DH3 | The cooling rate from 470° C. to 380° C. was low. |
| DH4 | The cooling rate from 575° C. to 510° C. was high. |
| DH5 | The cooling rate from 575° C. to 510° C. during hot forging was high. |

TABLE 11

| | Hot Extrusion | | | | Diameter | Heat Treatment (Annealing) | | | | |
|---|---|---|---|---|---|---|---|---|---|---|
| Step No. | Temperature (° C.) | Cooling Rate from 575° C. to 510° C. (° C./min) | Cooling Rate from 470° C. to 380° C. (° C./min) | Straightness Correction | of Extuder Material after Correction (mm) | Temperature (° C.) | Time (min) | Cooling Rate from 575° C. to 510° C. (° C./min) | Cooling Rate from 470° C. to 380° C. (° C./min) | Note |
| E1 | 640 | 20 | 20 | ○ | 25 | 540 | 80 | 15 | 15 | |
| E2 | 640 | 20 | 20 | ○ | 40 | — | — | — | — | Used as Material for Forging Abrasion Test also Performed |
| E3 | 640 | 20 | 20 | ○ | 40 | 540 | 80 | 15 | 15 | Abrasion Test also Performed |
| EH1 | 640 | 20 | 20 | ○ | 25 | — | — | — | — | — |

TABLE 12

| | | Hot Forging | | | Heat Treatment (Annealing) | | | | | |
|---|---|---|---|---|---|---|---|---|---|---|
| Step No. | Material | Temperature (° C.) | Cooling Rate from 575° C. to 510° C. (° C./min) | Cooling Rate from 470° C. to 380° C. (° C./min) | Kind of Furnace | Temperature (° C.) | Time (min) | Cooling Rate from 575° C. to 510° C. (° C./min) | Cooling Rate from 470° C. to 380° C. (° C./min) | Note |
| F1 | E2 | 690 | 20 | 18 | Batch Furnace | 560 | 50 | 50 | 10 | |
| F2 | E2 | 690 | 20 | 18 | Continuous Furnace | 590 | 5 | 1.8 | 10 | |
| F3 | E2 | 690 | 20 | 18 | Continuous Furnace | 560 | 5 | 1.0 | 10 | |
| F4 | Continuously Cast Rod | 690 | 20 | 18 | Batch Furnace | 560 | 50 | 20 | 20 | |
| F5 | Continuously Cast Rod | 690 | 20 | 18 | Continuous Furnace | 570 | 5 | 1.2 | 10 | Cooling rate from 470° C. to 380° C. was relatively low |
| FH1 | E2 | 690 | 20 | 18 | | — | — | — | — | |
| FH2 | E2 | 690 | 20 | 18 | Continuous Furnace | 600 | 5 | 1.8 | 1.5 | Cooling rate from 470° C. to 380° C. was low |
| FH3 | Continuously Cast Rod | 690 | 20 | 18 | | — | — | — | — | |

Regarding the above-described test materials, metallographic structure observation, corrosion resistance (dezincification corrosion test/dipping test), machinability, mechanical properties at a normal temperature and a high temperature, cavitation resistance, erosion-corrosion resistance, and wear resistance were evaluated in the following procedure.

In the above-described steps, the alloys having a f2 value of higher than 62.7 were extruded again at an increased temperature of 760° C. and then were evaluated.

(Observation of Metallographic Structure)

The metallographic structure was observed using the following method and area ratios (%) of α phase, κ phase, β phase, γ phase, and μ phase were measured by image analysis. Note that α' phase, β' phase, and γ' phase were included in α phase, β phase, and γ phase respectively.

Each of the test materials, rod material or forged product, was cut in a direction parallel to the longitudinal direction or parallel to the flowing direction of the metallographic structure. Next, the surface was polished (mirror-polished) and was etched with a mixed solution of hydrogen peroxide and ammonia water. For etching, an aqueous solution obtained by mixing 3 mL of 3 vol % hydrogen peroxide water and 22 mL of 14 vol % ammonia water was used. At room temperature of about 15° C. to about 25° C., the metal's polished surface was dipped in the aqueous solution for about 2 seconds to about 5 seconds.

Using a metallographic microscope, the metallographic structure was observed mainly at a magnification of 500-fold and, depending on the conditions of the metallographic structure, at a magnification of 1000-fold. In micrographs of five visual fields, respective phases (α phase, κ phase, β phase, γ phase, and μ phase) were manually painted using image analyzing software "WinROOF2013". Next, the micrographs were binarized using image analyzing software "WinROOF 2013" to obtain the area ratios of the respective phases. Specifically, the average value of the area ratios of the five visual fields for each phase was calculated and regarded as the proportion of the phase. Thus, the total of the area ratios of all the constituent phases was 100%.

The lengths of the long sides of γ phase and μ phase were measured using the following method. Using a 500-fold or 1000-fold metallographic micrograph, the maximum length of the long side of γ phase was measured in one visual field. This operation was performed in arbitrarily selected five visual fields, and the average maximum length of the long side of γ phase calculated from the lengths measured in the five visual fields was regarded as the length of the long side of γ phase. Likewise, by using a 500-fold or 1000-fold metallographic micrograph or using a 2000-fold or 5000-fold secondary electron micrograph (electron micrograph) according to the size of μ phase, the maximum length of the long side of μ phase in one visual field was measured. This operation was performed in arbitrarily selected five visual fields, and the average maximum length of the long sides of μ phase calculated from the lengths measured in the five visual fields was regarded as the length of the long side of μ phase.

Specifically, the evaluation was performed using an image that was printed out in a size of about 70 mm×about 90 mm. In the case of a magnification of 500-fold, the size of an observation field was 276 μm×220 μm.

When it was difficult to identify a phase, the phase was identified using an electron backscattering diffraction pattern (FE-SEM-EBSP) method at a magnification of 500-fold or 2000-fold.

In addition, in Examples in which the average cooling rates were made to vary, in order to determine whether or not μ phase, which mainly precipitates at a grain boundary, was present, a secondary electron image was obtained using JSM-7000F (manufactured by JEOL Ltd.) under the conditions of acceleration voltage: 15 kV and current value (set value: 15), and the metallographic structure was observed at a magnification of 2000-fold or 5000-fold. In cases where μ phase was able to be observed using the 2000-fold or 5000-fold secondary electron image but was not able to be observed using the 500-fold or 1000-fold metallographic micrograph, the μ phase was not included in the calculation of the area ratio. That is, μ phase that was able to be observed using the 2000-fold or 5000-fold secondary electron image but was not able to be observed using the 500-fold or 1000-fold metallographic micrograph was not included in the area ratio of μ phase. The reason for this is that, in most cases, the length of the long side of μ phase that is not able to be observed using the metallographic microscope is 5 μm or less, and the width of such μ phase is 0.3 μm or less. Therefore, such μ phase scarcely affects the area ratio.

The length of μ phase was measured in arbitrarily selected five visual fields, and the average value of the maximum lengths measured in the five visual fields was regarded as the length of the long side of μ phase as described above. The composition of μ phase was verified using an EDS, an accessory of JSM-7000F. Note that when μ phase was not able to be observed at a magnification of 500-fold or 1000-fold but the length of the long side of μ phase was measured at a higher magnification, in the measurement result columns of the tables, the area ratio of μ phase is indicated as 0%, but the length of the long side of μ phase is filled in.

(Observation of μ Phase)

Regarding μ phase, when cooling was performed in a temperature range of 470° C. to 380° C. at an average cooling rate of about 8° C./min after the heat treatment, the presence of μ phase was able to be verified. FIG. 1 shows an example of a secondary electron image of Test No. T123 (Alloy No. S03/Step No. A3). It was verified that μ phase was precipitated at a grain boundary of α phase (elongated grey white phase).

(Acicular κ Phase Present in α Phase)

Acicular κ phase (κ1 phase) present in α phase has a width of about 0.05 μm to about 0.5 μm and had an elongated linear shape or an acicular shape. When the width was 0.1 m or more, the presence of κ1 phase can be identified using a metallographic microscope.

Figure 2:
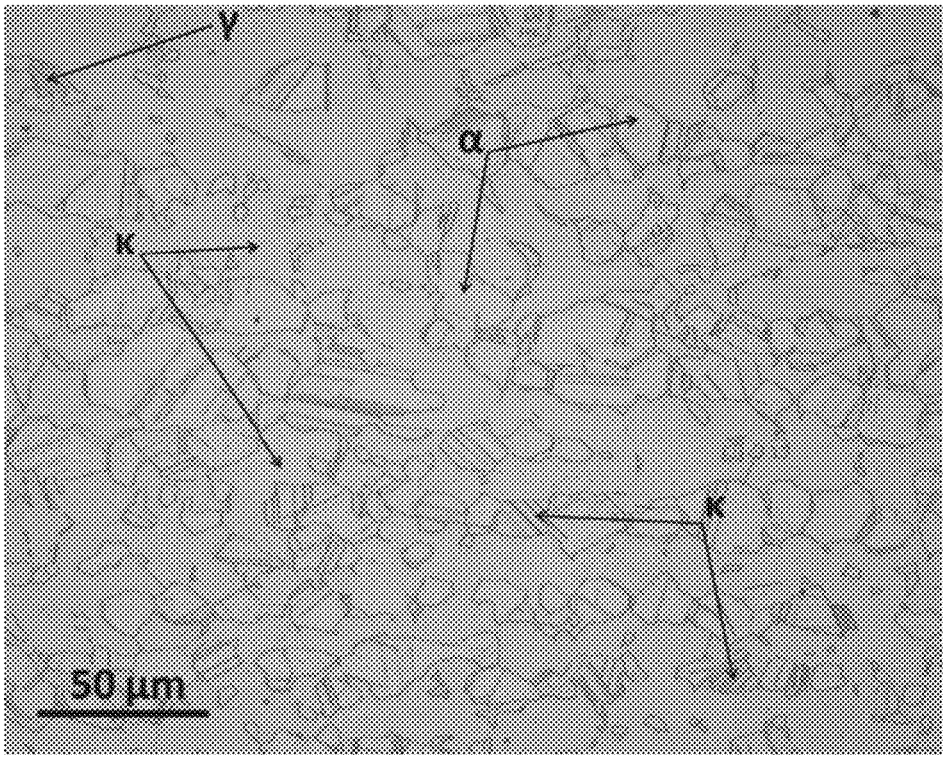
FIG. 2 is a metallographic micrograph of a metallographic structure of a free-cutting copper alloy (Test No. T03) according to Example 1.
Figure 3:
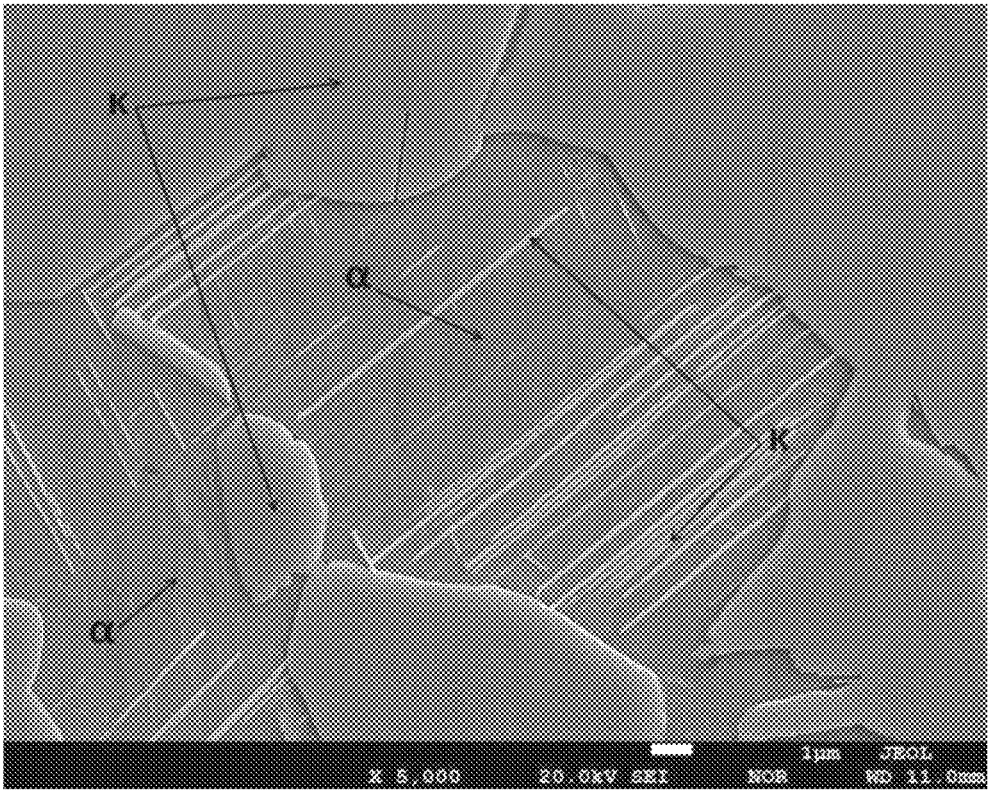
FIG. 3 is an electron micrograph of a metallographic structure of a free-cutting copper alloy (Test No. T03) according to Example 1.

FIG. 2 shows a metallographic micrograph of Test No. T03 (Alloy No. S01/Step No. A1) as a representative metallographic micrograph. FIG. 3 shows an electron micrograph of Test No. T03 (Alloy No. S01/Step No. A1) as a representative electron micrograph of acicular κ phase present in α phase. Observation points of FIGS. 2 and 3 were not the same. In a copper alloy, κ phase may be confused with twin crystal present in α phase. However, the width of κ phase is narrow, and twin crystal consists of a pair of crystals, and thus κ phase present in α phase can be distinguished from twin crystal present in α phase. In the metallographic micrograph of FIG. 2, a phase having an elongated, linear, and acicular pattern is observed in α phase. In the secondary electron image (electron micrograph) of FIG. 3, the pattern present in α phase can be clearly identified as κ phase. The thickness of κ phase was about 0.1 to about 0.2 μm.

The amount (number) of acicular κ phase in α phase was determined using the metallographic microscope. The micrographs of the five visual fields taken at a magnification of 500-fold or 1000-fold for the determination of the metallographic structure constituent phases (metallographic structure observation) were used. In an enlarged visual field having a length of about 70 mm and a width of about 90 mm, the number of acicular κ phases was counted, and the average value of five visual fields was obtained. When the average number of acicular κ phase in the five visual fields is 5 or more and less than 49, it was determined that acicular κ phase was present, and "Δ" was indicated. When the average number of acicular κ phase in the five visual fields was more than 50, it was determined that a large amount of acicular κ phase was present, and "O" was indicated. When the average number of acicular κ phase in the five visual fields was 4 or less, it was determined that almost no acicular κ phase was present, and "X" was indicated. The number of acicular κ1 phases that was unable to be observed using the images was not counted.

(Amounts of Sn and P in κ Phase)

The amount of Sn and the amount of P contained in κ phase were measured using an X-ray microanalyzer. The measurement was performed using "JXA-8200" (manufactured by JEOL Ltd.) under the conditions of acceleration voltage: 20 kV and current value: $3.0\times10^{-8}$ A.

Regarding Test No. T03 (Alloy No. S01/Step No. A1), Test No. T27 (Alloy No. S01/Step No. BH3), and Test No. T01 (Alloy No. S01/Step No. AH1), the quantitative analysis of the concentrations of Sn, Cu, Si, and P in the respective phases was performed using the X-ray microanalyzer, and the results thereof are shown in Tables 13 to 15.

Regarding μ phase, a portion in which the length of the short side in the visual field was long was measured using an EDS, an accessory of JSM-7000F.

TABLE 13

Test No. T03 (Alloy No. S01: 77.5Cu—3.37Si—0.48Sn—0.09P/Step No. A1) (mass %)

| | Cu | Si | Sn | P | Zn |
|---|---|---|---|---|---|
| α Phase | 77.0 | 2.8 | 0.38 | 0.06 | Balance |
| κ Phase | 78.0 | 4.0 | 0.52 | 0.12 | Balance |
| γ Phase | 76.0 | 6.1 | 4.2 | 0.17 | Balance |
| μ Phase | — | — | — | — | — |

TABLE 14

Test No. T27 (Alloy No. S01: 77.5Cu—3.37Si—0.48Sn—0.09P/Step No. BH3) (mass %)

| | Cu | Si | Sn | P | Zn |
|---|---|---|---|---|---|
| α Phase | 77.0 | 2.7 | 0.37 | 0.06 | Balance |
| κ Phase | 78.0 | 3.9 | 0.53 | 0.12 | Balance |
| γ Phase | 75.5 | 6.0 | 4.0 | 0.16 | Balance |
| μ Phase | 82.0 | 7.5 | 0.65 | 0.22 | Balance |

TABLE 15

Test No. TO1 (Alloy No. S01: 77.5Cu—3.37Si—0.48Sn—0.09P/Step No. AH1) (mass %)

| | Cu | Si | Sn | P | Zn |
|---|---|---|---|---|---|
| α Phase | 77.0 | 2.8 | 0.32 | 0.06 | Balance |
| κ Phase | 78.0 | 4.1 | 0.41 | 0.12 | Balance |
| γ Phase | 76.0 | 6.2 | 4.9 | 0.19 | Balance |
| μ Phase | — | — | — | — | — |

Based on the above-described measurement results, the following findings were obtained.

1) The amount of Sn distributed in κ phase is about 1.3 times that in α phase. Specifically, when the proportion of γ phase decreases, the Sn concentration in κ phase increases from 0.41 mass % to 0.53 mass % by about 1.3 times.

2) The Sn concentration in γ phase is about 11 to about 15 times the Sn concentration in α phase.

3) The Si concentrations in κ phase, γ phase, and μ phase are about 1.6 times, about 2.2 times, and about 2.7 times the Si concentration in α phase, respectively.

4) The Cu concentration in μ phase is higher than that in α phase, κ phase, γ phase, or μ phase.

5) As the proportion of γ phase increases, the Sn concentration in κ phase necessarily decreases.

6) The amount of P distributed in κ phase is about 2 times that in α phase.

7) The P concentrations in γ phase and μ phase are about 3 times and about 4 times the P concentration in α phase.

(Mechanical Properties)

(Tensile Strength)

Each of the test materials was processed into a No. 10 specimen according to JIS Z 2241, and the tensile strength thereof was measured. If the tensile strength of a hot extruded material or hot forged material is 540 N/mm$^2$ or higher and preferably 560 N/mm$^2$ or higher, the material can be regarded as a free-cutting copper alloy of the highest quality, and with such a material, a reduction in the thickness and weight of members used in various fields can be realized.

The finished surface roughness of the tensile test specimen affects elongation and tensile strength. Therefore, the tensile test specimen was prepared so as to satisfy the following conditions.

(Conditions of Finished Surface Roughness of Tensile Test Specimen)

The difference between the maximum value and the minimum value on the Z-axis is 2 μm or less in a cross-sectional curve corresponding to a standard length of 4 mm at any position between gauge marks on the tensile test specimen. The cross-sectional curve refers to a curve obtained by applying a low-pass filter of a cut-off value λs to a measured cross-sectional curve.

(High Temperature Creep)

A flanged specimen having a diameter of 10 mm according to JIS Z 2271 was prepared from each of the specimens. In a state where a load corresponding to 0.2% proof stress at room temperature was applied to the specimen, a creep strain after being kept for 100 hours at 150° C. was measured. If the creep strain is 0.4% or lower after the test piece is held at 150° C. for 100 hours in a state where a load corresponding to 0.2% plastic deformation is applied, the specimen is regarded to have good high-temperature creep. In the case where this creep strain is 0.3% or lower, the alloy is regarded to be of the highest quality among copper alloys, and such material can be used as a highly reliable material in, for example, valves used under high temperature or in automobile components used in a place close to the engine room.

(Impact Resistance)

In an impact test, an U-notched specimen (notch depth: 2 mm, notch bottom radius: 1 mm) according to JIS Z 2242 was taken from each of the extruded rod materials, the forged materials, and alternate materials thereof, the cast materials, and the continuously cast rod materials. Using an impact blade having a radius of 2 mm, a Charpy impact test was performed to measure the impact value.

The relation between the impact value obtained from the V-notched specimen and the impact value obtained from the U-notched specimen is as follows.

$$(V\text{-Notch Impact Value})=0.8\times(U\text{-Notch Impact Value})-3$$

(Machinability)

The machinability was evaluated as follows in a machining test using a lathe.

Hot extruded rod materials having a diameter of 50 mm, 40 mm, or 25.5 mm and a cold drawn material having a diameter of 25 mm (24.4 mm) were machined to prepare test materials having a diameter of 18 mm. A forged material was machined to prepare a test material having a diameter of 14.5 mm. A point nose straight tool, in particular, a tungsten carbide tool not equipped with a chip breaker was attached to the lathe. Using this lathe, the circumference of the test material having a diameter of 18 mm or a diameter of 14.5 mm was machined under dry conditions at rake angle: −6 degrees, nose radius: 0.4 mm, machining speed: 150 m/min, machining depth: 1.0 mm, and feed rate: 0.11 mm/rev.

A signal emitted from a dynamometer (AST tool dynamometer AST-TL1003, manufactured by Mihodenki Co., Ltd.) that is composed of three portions attached to the tool was electrically converted into a voltage signal, and this voltage signal was recorded on a recorder. Next, this signal was converted into cutting resistance (N). Accordingly, the machinability of the alloy was evaluated by measuring the cutting resistance, in particular, the principal component of cutting resistance showing the highest value during machining.

Concurrently, chips were collected, and the machinability was evaluated based on the chip shape. The most serious problem during actual machining is that chips become entangled with the tool or become bulky. Therefore, when all the chips that were generated had a chip shape with one winding or less, it was evaluated as "O" (good). When the chips had a chip shape with more than one winding and three windings or less, it was evaluated as "Δ" (fair). When a chip having a shape with more than three windings was included, it was evaluated as "X" (poor). This way, the evaluation was performed in three grades.

The cutting resistance depends on the strength of the material, for example, shear stress, tensile strength, or 0.2% proof stress, and as the strength of the material increases, the cutting resistance tends to increase. Cutting resistance that is higher than the cutting resistance of a free-cutting brass rod including 1% to 4% of Pb by about 10%, the cutting resistance is sufficiently acceptable for practical use. In the embodiment, the cutting resistance was evaluated based on whether it had 125 N (boundary value). Specifically, when the cutting resistance was lower than 125 N, the machinability was evaluated as excellent (evaluation: O). When the cutting resistance was 125 N or higher and lower than 150 N, the machinability was evaluated as "acceptable (Δ)". When the cutting resistance was 150 N or higher, the cutting resistance was evaluated as "unacceptable (X)". Incidentally, when Step No. F1 was performed on a 58 mass % Cu-42 mass % Zn alloy to prepare a sample and this sample was evaluated, the cutting resistance was 185 N.

As an overall evaluation of machinability, a material whose chip shape was excellent (evaluation: O) and the cutting resistance was low (evaluation: O), the machinability was evaluated as excellent. When either the chip shape or the cutting resistance is evaluated as Δ or acceptable, the machinability was evaluated as good under some conditions. When either the chip shape or cutting resistance was evaluated as Δ or acceptable and the other was evaluated as X or unacceptable, the machinability was evaluated as unacceptable (poor). It should be noted that the tables of the examples do not contain comprehensive machinability evaluation.

(Hot Working Test)

The rod materials having a diameter of 50 mm, 40 mm, and 25.6 mm were machined to prepare test materials having a diameter of 15 mm and a length of 25 mm. The test materials were held at 740° C. or 635° C. for 20 minutes. Next, the test materials were horizontally set and compressed to a thickness of 5 mm at a high temperature using an Amsler testing machine having a hot compression capacity of 10 ton and equipped with an electric furnace at a strain rate of 0.02/sec and a working ratio of 80%.

Hot workability was evaluated using a magnifying glass at a magnification of 10-fold, and when cracks having an opening of 0.2 mm or more were observed, it was regarded that cracks occurred. When cracking did not occur under two conditions of 740° C. and 635° C., it was evaluated as "O" (good). When cracking occurred at 740° C. but did not occur at 635° C., it was evaluated as "Δ" (fair). When cracking did not occur at 740° C. and occurred at 635° C., it was evaluated as "▲" (fair).

When cracking occurred at both of the temperatures, 740° C. and 635° C., it was evaluated as "X" (poor). When cracking did not occur under two conditions of 740° C. and 635° C., even if the material's temperature decreases to some extent during actual hot extrusion or hot forging, or even if the material comes into contact with a mold or a die even for a moment and the material's temperature decreases, there is no problem in practical use as long as hot extrusion or hot forging is performed at an appropriate temperature. When cracking occurred at either temperature of 740° C. or 635° C., although there is a restriction in practical use, it is determined that hot working is possible if it is performed in a more narrowly controlled temperature range. When cracking occurred at both temperatures of 740° C. and 635° C., it is determined that there is a problem in practical use.

(Dezincification Corrosion Tests 1 and 2)

When the test material was an extruded material, the test material was embedded in a phenol resin material such that an exposed sample surface of the test material was perpendicular to the extrusion direction. When the test material was a cast material (cast rod), the test material was embedded in a phenol resin material such that an exposed sample surface of the test material was perpendicular to the longitudinal direction of the cast material. When the test material was a forged material, the test material was embedded in a phenol resin material such that an exposed sample surface of the test material was perpendicular to the flowing direction of forging.

The sample surface was polished with emery paper up to grit 1200, was ultrasonically cleaned in pure water, and then was dried with a blower. Next, each of the samples was dipped in a prepared dipping solution.

After the end of the test, the samples were embedded in a phenol resin material again such that the exposed surface is maintained to be perpendicular to the extrusion direction, the longitudinal direction, or the flowing direction of forging. Next, the sample was cut such that the cross-section of a corroded portion was the longest cut portion. Next, the sample was polished.

Using a metallographic microscope, corrosion depth was observed in 10 visual fields (arbitrarily selected 10 visual fields) of the microscope at a magnification of 500-fold. The deepest corrosion point was recorded as the maximum dezincification corrosion depth.

In the dezincification corrosion test 1, the following test solution 1 was prepared as the dipping solution, and the above-described operation was performed. In the dezincification corrosion test 2, the following test solution 2 was prepared as the dipping solution, and the above-described operation was performed.

The test solution 1 is a solution for performing an accelerated test in a harsh corrosion environment simulating an environment in which an excess amount of a disinfectant which acts as an oxidant is added such that pH is significantly low. When this solution is used, it is presumed that this test is an about 75 to 100 times accelerated test performed in such a harsh corrosion environment. As the embodiment aims at obtaining excellent corrosion resistance under a harsh environment, if the maximum corrosion depth is 80 μm or less, corrosion resistance is excellent. If excellent corrosion resistance is required, it is presumed that the maximum corrosion depth is preferably 60 μm or less and more preferably 40 μm or less.

The test solution 2 is a solution for performing an accelerated test in a harsh corrosion environment, for simulating water quality that makes corrosion advance fast in which the chloride ion concentration is high and pH is low. When this solution is used, it is presumed that corrosion is accelerated about 30 to 50 times in such a harsh corrosion environment. If the maximum corrosion depth is 50 μm or less, corrosion resistance is good. When excellent corrosion resistance is required, it is presumed that the maximum corrosion depth is preferably 35 μm or less and more preferably 25 μm or less. The Examples of the instant invention were evaluated based on these presumed values.

In the dezincification corrosion test 1, hypochlorous acid water (concentration: 30 ppm, pH=6.8, water temperature: 40° C.) was used as the test solution 1. Using the following method, the test solution 1 was adjusted. Commercially available sodium hypochlorite (NaClO) was added to 40 L of distilled water and was adjusted such that the residual chlorine concentration measured by iodometric titration was 30 mg/L. Residual chlorine decomposes and decreases in amount over time. Therefore, while continuously measuring the residual chlorine concentration using a voltammetric method, the amount of sodium hypochlorite added was electronically controlled using an electromagnetic pump. In order to reduce pH to 6.8, carbon dioxide was added while adjusting the flow rate thereof. The water temperature was adjusted to 40° C. using a temperature controller. While maintaining the residual chlorine concentration, pH, and the water temperature to be constant, the sample was held in the test solution 1 for 2 months. Next, the sample was taken out from the aqueous solution, and the maximum value (maximum dezincification corrosion depth) of the dezincification corrosion depth was measured.

In the dezincification corrosion test 2, a test water including components shown in Table 16 was used as the test solution 2. The test solution 2 was adjusted by adding a commercially available chemical agent to distilled water. Simulating highly corrosive tap water, 80 mg/L of chloride ions, 40 mg/L of sulfate ions, and 30 mg/L of nitrate ion were added. The alkalinity and hardness were adjusted to 30 mg/L and 60 mg/L, respectively, based on Japanese general tap water. In order to reduce pH to 6.3, carbon dioxide was added while adjusting the flow rate thereof. In order to saturate the dissolved oxygen concentration, oxygen gas was continuously added. The water temperature was adjusted to 25° C. which is the same as room temperature. While maintaining pH and the water temperature to be constant and maintaining the dissolved oxygen concentration in the saturated state, the sample was held in the test solution 2 for 3 months. Next, the sample was taken out from the aqueous solution, and the maximum value (maximum dezincification corrosion depth) of the dezincification corrosion depth was measured.

TABLE 16

(Units of Items other than pH: mg/L)

| Mg | Ca | Na | K | $NO^{3-}$ | $SO_4^{2-}$ | Cl | Alkalinity | Hardness | pH |
|---|---|---|---|---|---|---|---|---|---|
| 10.1 | 7.3 | 55 | 19 | 30 | 40 | 80 | 30 | 60 | 6.3 |

(Dezincification Corrosion Test 3: Dezincification Corrosion Test According to ISO 6509)

This test is adopted in many countries as a dezincification corrosion test method and is defined by JIS H 3250 of JIS Standards.

As in the case of the dezincification corrosion tests 1 and 2, the test material was embedded in a phenol resin material. For example, the test material was embedded in a phenol resin material such that the exposed sample surface was perpendicular to the extrusion direction of the extruded material. The sample surface was polished with emery paper up to grit 1200, was ultrasonically cleaned in pure water, and then was dried.

Each of the samples was dipped in an aqueous solution (12.7 g/L) of 1.0% cupric chloride dihydrate ($CuCl_2.2H_2O$) and was held under a temperature condition of 75° C. for 24 hours. Next, the sample was taken out from the aqueous solution.

The samples were embedded in a phenol resin material again such that the exposed surfaces were maintained to be perpendicular to the extrusion direction, the longitudinal direction, or the flowing direction of forging. Next, the samples were cut such that the longest possible cross-section of a corroded portion could be obtained. Next, the samples were polished.

Using a metallographic microscope, corrosion depth was observed in 10 visual fields of the microscope at a magnification of 100-fold to 500-fold. The deepest corrosion point was recorded as the maximum dezincification corrosion depth.

When the maximum corrosion depth in the test according to ISO 6509 is 200 μm or less, there was no problem for practical use regarding corrosion resistance. When particularly excellent corrosion resistance is required, it is presumed that the maximum corrosion depth is preferably 100 μm or less and more preferably 50 μm or less.

In this test, when the maximum corrosion depth was more than 200 μm, it was evaluated as "X" (poor). When the maximum corrosion depth was more than 50 μm and 200 μm or less, it was evaluated as "Δ" (fair). When the maximum corrosion depth was 50 μm or less, it was strictly evaluated as "O" (good). In the embodiment, a strict evaluation criterion was adopted because the alloy was assumed to be used in a harsh corrosion environment, and only when the evaluation was "O", it was determined that corrosion resistance was excellent.

(Abrasion Test)

In two tests including an Amsler abrasion test under a lubricating condition and a ball-on-disk abrasion test under a dry condition, wear resistance was evaluated. As samples, alloys prepared in Steps No. C0, C1, CH1, E2, and E3 were used.

The Amsler abrasion test was performed using the following method. At room temperature, each of the samples was machined to prepare an upper specimen having a diameter 32 mm. In addition, a lower specimen (surface hardness: HV184) having a diameter of 42 mm formed of austenitic stainless steel (SUS304 according to JIS G 4303) was prepared. By applying 490 N of load, the upper specimen and the lower specimen were brought into contact with each other. For an oil droplet and an oil bath, silicone oil was used. In a state where the upper specimen and the lower specimen were brought into contact with the load being applied, the upper specimen and the lower specimen were rotated under the conditions that the rotation speed of the upper specimen was 188 rpm and the rotation speed of the lower specimen was 209 rpm. Due to a difference in circumferential speed between the upper specimen and the lower specimen, a sliding speed was 0.2 m/sec. By making the diameters and the rotation speeds of the upper specimen and the lower specimen different from each other, the specimen was made to wear. The upper specimen and the lower specimen were rotated until the number of times of rotation of the lower specimen reached 250000.

After the test, the change in the weight of the upper specimen was measured, and wear resistance was evaluated based on the following criteria. When the decrease in the weight of the upper specimen caused by abrasion was 0.25 g or less, it was evaluated as "◎" (excellent). When the decrease in the weight of the upper specimen was more than 0.25 g and 0.5 g or less, it was evaluated as "O" (good). When the decrease in the weight of the upper specimen was more than 0.5 g and 1.0 g or less, it was evaluated as "Δ" (fair). When the decrease in the weight of the upper specimen was more than 1.0 g, it was evaluated as "X" (poor). The wear resistance was evaluated in these four grades. In addition, when the weight of the lower specimen decreased by 0.025 g or more, it was evaluated as "X".

Incidentally, the abrasion loss (a decrease in weight caused by abrasion) of a free-cutting brass 59Cu-3Pb-38Zn including Pb under the same test conditions was 12 g.

The ball-on-disk abrasion test was performed using the following method. A surface of the specimen was polished with a #2000 sandpaper. A steel ball having a diameter of 10 mm formed of austenitic stainless steel (SUS304 according to JIS G 4303) was pressed against the specimen and was slid thereon under the following conditions.

(Conditions)

Room temperature, no lubrication, load: 49 N, sliding diameter: 10 mm, sliding speed: 0.1 m/sec, sliding distance: 120 m After the test, the change in the weight of the specimen was measured, and wear resistance was evaluated based on the following criteria. When a decrease in the weight of the specimen caused by abrasion was 4 mg or less, it was evaluated as "◎" (excellent). When a decrease in the weight of the specimen was more than 4 mg and 8 mg or less, it was evaluated as "O" (good). When a decrease in the weight of the specimen was more than 8 mg and 20 mg or less, it was evaluated as "Δ" (fair). When a decrease in the weight of the specimen was more than 20 mg, it was evaluated as "X" (poor). The wear resistance was evaluated in these four grades.

Incidentally, the abrasion loss of a free-cutting brass 59Cu-3Pb-38Zn including Pb under the same test conditions was 80 mg.

(Cavitation Resistance)

Cavitation refers to a phenomenon in which the formation and elimination of bubbles occurs within a short period of time due to a difference in pressure in the flow of liquid. Cavitation resistance refer to resistance to damages caused by the formation and elimination of bubbles.

Cavitation resistance were evaluated using a direct magnetostriction vibration test. The sample was cut into a diameter of 16 mm by cutting, and subsequently an exposure test surface was polished with waterproof abrasive paper of #1200. As a result, a sample was prepared. The sample was attached to a horn at a tip of a vibrator. The sample was ultrasonically vibrated in a test solution under conditions of vibration frequency: 18 kHz, amplitude: 40 μm, and test time: 2 hours. As a test solution in which the sample surface was dipped, ion exchange water was used. A beaker to which ion exchange water was added was cooled such that the water temperature was 20° C.±2° C. (18° C. to 22° C.). The weight of the sample was measured before and after the test, and cavitation resistance were evaluated based on a difference in weight. When the difference in weight (decrease in weight) was more than 0.03 g, the surface was damaged, and cavitation resistance were determined to be significantly poor. When the difference in weight (decrease in weight) was more than 0.005 g and 0.03 g or less, surface damages were small, and cavitation resistance were determined to be good. However, in the embodiment, excellent cavitation resistance are desired. Therefore, a difference of more than 0.005 g and 0.03 g or less was determined to be poor. When the difference in weight (decrease in weight) was 0.005 g or less, there were substantially no surface damages, and cavitation resistance were determined to be excellent. When the difference in weight (decrease in weight) was 0.003 g or less, cavitation resistance were determined to be particularly excellent.

Incidentally, when a free-cutting brass 59Cu-3Pb-38Zn including Pb was tested under the same test conditions, a decrease in weight was 0.10 g.

(Erosion-Corrosion Resistance)

Erosion-corrosion refers to a phenomenon in which local corrosion rapidly progresses due to a combination of a chemical corrosion phenomenon caused by fluid and a physical scraping phenomenon. Erosion-corrosion resistance refers to resistance to this corrosion.

The sample surface was made to have a flat true circular shape having a diameter of 20 mm, and subsequently was further polished with emery paper of #2000. As a result, the sample was prepared. Using a nozzle having an aperture of 1.6 mm, test water was brought into contact with the sample at a flow rate of about 9 m/sec (test method 1) or about 7 m/sec (test method 2). Specifically, the water was brought into contact with the center of the sample surface from a direction perpendicular to the sample surface. In addition, the distance between a nozzle tip and the sample surface was 0.4 mm. After bringing the test water into contact with the sample under the above-described conditions for 336 hours, a decrease in corrosion was measured.

As the test water, hypochlorous acid water (concentration: 30 ppm, pH=7.0, water temperature: 40° C.) was used. The test water was prepared using the following method. Commercially available sodium hypochlorite (NaClO) was poured into 40 L of distilled water. The amount of sodium hypochlorite was adjusted such that the residual chlorine concentration measured by iodometric titration was 30 mg/L. The residual chlorine is decomposed and decreases in amount over time. Therefore, while continuously measuring the residual chlorine concentration using a voltammetric method, the addition amount of sodium hypochlorite was electronically controlled using an electromagnetic pump. In order to reduce pH to 7.0, carbon dioxide was added while adjusting the flow rate thereof. The water temperature was adjusted to 40° C. using a temperature controller. This way, the residual chlorine concentration, pH, and the water temperature were maintained to be constant.

In the test method 1, when the decrease in corrosion was more than 100 mg, erosion-corrosion resistance was evaluated to be poor. When the decrease in corrosion was more than 60 mg and 100 mg or less, erosion-corrosion resistance was evaluated to be good. When the decrease in corrosion was more than 35 mg and 60 mg or less, erosion-corrosion resistance was evaluated to be excellent. When the decrease in corrosion was 35 mg or less, erosion-corrosion resistance was evaluated to be particularly excellent.

Likewise, in the test method 2, when the decrease in corrosion was more than 70 mg, erosion-corrosion resistance was evaluated to be poor. When the decrease in corrosion was more than 45 mg and 70 mg or less, erosion-corrosion resistance was evaluated to be good. When the decrease in corrosion was more than 30 mg and mg or less, erosion-corrosion resistance was evaluated to be excellent. When the decrease in corrosion was 30 mg or less, erosion-corrosion resistance was evaluated to be particularly excellent.

The evaluation results are shown in Tables 17 to 52.

Tests No. T01 to T156 are the results of the experiment performed on the actual production line. Tests No. T201 to T262 are the results corresponding to Examples in the laboratory experiment. Tests No. T301 to T340 are the results corresponding to Comparative Examples in the laboratory experiment.

Regarding the tests in which "EH1, E2" or "E1, E3" is described in Step No., the abrasion test was performed using the sample prepared in Step No. E2 or E3. The corrosion test other than the abrasion test, all the tests of the mechanical properties and the like, and the inspection of the metallographic structure were performed using the sample prepared in Step No. EH1 or E1.

In samples described as "extrusion cracking" in "Note", a predetermined amount was not able to be extruded. After removing cracked portions of the surface, the test was performed.

TABLE 17

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T01 | S01 | AH1 | 37.6 | 4.8 | 0 | 0 | 95.2 | 100 | 4.8 | 52.6 | 84 | 0 | x | 0.41 | 0.12 |
| T02 | S01 | AH2 | 37.5 | 4.9 | 0 | 0 | 95.1 | 100 | 4.9 | 52.7 | 86 | 0 | x | 0.40 | 0.12 |
| T03 | S01 | A1 | 48.6 | 0.5 | 0 | 0 | 99.5 | 100 | 0.5 | 55.3 | 20 | 0 | ○ | 0.52 | 0.12 |
| T04 | S01 | A2 | 48.5 | 0.4 | 0 | 0 | 99.6 | 100 | 0.4 | 54.7 | 20 | 0 | ○ | 0.52 | 0.12 |
| T05 | S01 | A3 | 49.0 | 0.5 | 0 | 0 | 99.5 | 100 | 0.5 | 55.7 | 18 | 1 | ○ | 0.52 | 0.12 |
| T06 | S01 | A4 | 48.4 | 0.5 | 0 | 0.4 | 99.1 | 100 | 0.9 | 55.3 | 22 | 10 | ○ | 0.52 | 0.12 |
| T07 | S01 | AH3 | 48.0 | 0.4 | 0 | 1.5 | 98.1 | 100 | 1.9 | 54.9 | 20 | 22 | ○ | 0.53 | 0.12 |
| T08 | S01 | AH4 | 47.0 | 0.3 | 0 | 4.4 | 95.3 | 100 | 4.7 | 54.8 | 19 | 40 or more | | 0.51 | 0.13 |
| T09 | S01 | A5 | 48.1 | 0.7 | 0 | 0 | 99.3 | 100 | 0.7 | 55.5 | 26 | 0 | ○ | 0.51 | 0.12 |
| T10 | S01 | A6 | 45.3 | 1.5 | 0 | 0 | 98.5 | 100 | 1.5 | 54.9 | 40 | 0 | Δ | 0.49 | 0.12 |
| T11 | S01 | AH5 | 46.2 | 1.3 | 0 | 0 | 98.7 | 100 | 1.3 | 55.4 | 50 | 0 | x | 0.49 | 0.12 |
| T12 | S01 | AH6 | 44.2 | 2.3 | 0 | 0 | 97.7 | 100 | 2.3 | 55.5 | 56 | 0 | x | 0.46 | 0.12 |
| T13 | S01 | AH7 | 46.8 | 1.8 | 0 | 0 | 98.2 | 100 | 1.8 | 57.2 | 46 | 0 | Δ | 0.48 | 0.12 |
| T14 | S01 | A7 | 47.9 | 1.1 | 0 | 0 | 98.9 | 100 | 1.1 | 56.6 | 38 | 0 | ○ | 0.50 | 0.12 |
| T15 | S01 | A8 | 48.3 | 0.7 | 0 | 0 | 99.3 | 100 | 0.7 | 55.7 | 32 | 0 | ○ | 0.51 | 0.12 |
| T16 | S01 | AH8 | 47.5 | 0.8 | 0 | 2.4 | 96.8 | 100 | 3.2 | 56.4 | 36 | 40 or more | | 0.52 | 0.12 |
| T17 | S01 | A9 | 48.3 | 0.9 | 0 | 0 | 99.1 | 100 | 0.9 | 56.4 | 34 | 0 | ○ | 0.50 | 0.12 |

TABLE 18

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509 | Impact Value (J/cm$^2$) | Tensile Strength (N/mm$^2$) | Strength Index | 150° C. Creep Strain (%) |
|---|---|---|---|---|---|---|---|---|---|---|---|---|
| T01 | S01 | AH1 | 108 | ○ | ○ | 114 | 70 | ○ | 15.7 | 552 | 671 | 0.44 |
| T02 | S01 | AH2 | 109 | ○ | — | 118 | 72 | — | 12.8 | 605 | 712 | — |
| T03 | S01 | A1 | 113 | ○ | ○ | 30 | 18 | ○ | 17.9 | 631 | 758 | 0.12 |
| T04 | S01 | A2 | 112 | ○ | — | 30 | 20 | — | 18.1 | 629 | 757 | — |
| T05 | S01 | A3 | 113 | ○ | — | 34 | 22 | — | 17.7 | 628 | 754 | 0.14 |
| T06 | S01 | A4 | 113 | ○ | — | 58 | 34 | ○ | 17.2 | 619 | 744 | 0.22 |
| T07 | S01 | AH3 | 115 | ○ | — | 74 | 44 | — | 16.0 | 606 | 726 | 0.38 |
| T08 | S01 | AH4 | 115 | ○ | — | 100 | 60 | ○ | 13.1 | 581 | 690 | 0.47 |
| T09 | S01 | A5 | 113 | ○ | — | 42 | 30 | ○ | 17.6 | 626 | 752 | 0.14 |
| T10 | S01 | A6 | 114 | ○ | — | 66 | 42 | ○ | 16.6 | 614 | 736 | 0.22 |
| T11 | S01 | AH5 | 117 | ○ | — | 82 | 50 | — | 16.0 | 585 | 705 | — |
| T12 | S01 | AH6 | 116 | ○ | — | 96 | 56 | ○ | 14.4 | 596 | 710 | 0.34 |
| T13 | S01 | AH7 | 113 | ○ | — | 76 | 46 | — | 15.2 | 611 | 728 | — |
| T14 | S01 | A7 | 112 | ○ | — | 66 | 38 | — | 16.7 | 623 | 746 | 0.30 |

TABLE 18-continued

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509 | Impact Value (J/cm$^2$) | Tensile Strength (N/mm$^2$) | Strength Index | 150° C. Creep Strain (%) |
|---|---|---|---|---|---|---|---|---|---|---|---|---|
| T15 | S01 | A8 | 113 | ○ | — | 48 | 30 | — | 17.5 | 626 | 752 | 0.14 |
| T16 | S01 | AH8 | 114 | ○ | — | 106 | 66 | ○ | 14.5 | 597 | 711 | 0.38 |
| T17 | S01 | A9 | 113 | ○ | — | 56 | 32 | ○ | 17.0 | 625 | 749 | 0.16 |

TABLE 19

| Test No. | Alloy No. | Step No. | Wear Resistance: Amsler Abrasion Test | Wear Resistance: Ball-On-Disk Abrasion Test | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|---|
| T01 | S01 | AH1 | | | 0.0061 | 105 | 72 |
| T02 | S01 | AH2 | | | — | — | — |
| T03 | S01 | A1 | | | 0.0031 | 63 | 40 |
| T04 | S01 | A2 | | | 0.0031 | 61 | 44 |
| T05 | S01 | A3 | | | — | — | — |
| T06 | S01 | A4 | | | — | 62 | 43 |
| T07 | S01 | AH3 | | | 0.0032 | 74 | 56 |
| T08 | S01 | AH4 | | | 0.0060 | 97 | 75 |
| T09 | S01 | A5 | | | — | 69 | — |
| T10 | S01 | A6 | | | — | — | — |
| T11 | S01 | AH5 | | | — | — | — |
| T12 | S01 | AH6 | | | 0.0050 | 84 | 53 |
| T13 | S01 | AH7 | | | — | — | — |
| T14 | S01 | A7 | | | 0.0034 | 66 | 44 |
| T15 | S01 | A8 | | | 0.0032 | 63 | 40 |
| T16 | S01 | AH8 | | | — | — | — |
| T17 | S01 | A9 | | | 0.0032 | 66 | 46 |

TABLE 20

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T18 | S01 | AH9 | Extrusion unable to be performed to the end | | | | | | | | | | | | |
| T19 | S01 | A10 | 48.6 | 0.5 | 0 | 0 | 99.5 | 100 | 0.5 | 55.3 | 20 | 0 | ○ | 0.52 | 0.12 |
| T20 | S01 | A11 | 48.7 | 0.4 | 0 | 0 | 99.6 | 100 | 0.4 | 54.9 | 22 | 0 | ○ | 0.52 | 0.12 |
| T21 | S01 | A12 | 48.6 | 0.5 | 0 | 0 | 99.5 | 100 | 0.5 | 55.3 | 20 | 0 | ○ | 0.52 | 0.12 |
| T22 | S01 | B1 | 49.0 | 0.5 | 0 | 0 | 99.5 | 100 | 0.5 | 55.7 | 22 | 2 | ○ | 0.52 | 0.12 |
| T23 | S01 | B2 | 48.8 | 0.4 | 0 | 0 | 99.6 | 100 | 0.4 | 55.0 | 22 | 2 | ○ | 0.52 | 0.12 |
| T24 | S01 | B3 | 48.7 | 0.4 | 0 | 0 | 99.6 | 100 | 0.4 | 54.9 | 26 | 1 | ○ | 0.52 | 0.12 |
| T25 | S01 | BH1 | 48.5 | 0.5 | 0 | 0 | 99.5 | 100 | 0.5 | 55.2 | 22 | 0 | ○ | 0.52 | 0.12 |
| T26 | S01 | BH2 | 48.2 | 0.3 | 0 | 1.8 | 97.9 | 100 | 2.1 | 54.8 | 18 | 34 | ○ | 0.53 | 0.12 |
| T27 | S01 | BH3 | 48.0 | 0.4 | 0 | 2.6 | 97.0 | 100 | 3.0 | 55.5 | 20 | 40 or more | ○ | 0.53 | 0.12 |
| T28 | S01 | C0 | 38.0 | 5.3 | 0 | 0 | 94.7 | 100 | 5.3 | 53.7 | 92 | 0 | x | 0.39 | 0.12 |
| T29 | S01 | C1 | 48.1 | 0.9 | 0 | 0 | 99.1 | 100 | 0.9 | 56.2 | 28 | 0 | ○ | 0.50 | 0.12 |
| T30 | S01 | C2 | 48.0 | 0.8 | 0 | 0 | 99.2 | 100 | 0.8 | 55.8 | 30 | 8 | ○ | 0.51 | 0.12 |
| T31 | S01 | CH1 | 47.4 | 0.8 | 0 | 2.0 | 97.2 | 100 | 2.8 | 56.1 | 26 | 32 | ○ | 0.52 | 0.12 |
| T32 | 501 | CH2 | 47.4 | 1.4 | 0 | 0 | 98.6 | 100 | 1.4 | 56.9 | 52 | 0 | ○ | 0.49 | 0.12 |
| T33 | S01 | DH1 | 38.3 | 4.7 | 0 | 0 | 95.3 | 100 | 4.7 | 53.2 | 90 | 0 | x | 0.41 | 0.12 |
| T34 | S01 | D1 | 49.2 | 0.4 | 0 | 0 | 99.6 | 100 | 0.4 | 55.5 | 22 | 0 | ○ | 0.52 | 0.12 |

TABLE 21

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509 | Impact Value (J/cm$^2$) | Tensile Strength (N/mm$^2$) | Strength Index | 150° C. Creep Strain (%) |
|---|---|---|---|---|---|---|---|---|---|---|---|---|
| T18 | S01 | AH9 | Extrusion unable to be performed to the end | | | | | | | | | |
| T19 | S01 | A10 | 114 | ○ | — | 34 | 20 | ○ | 16.6 | 640 | 762 | 0.12 |
| T20 | S01 | A11 | 115 | ○ | — | 36 | 22 | — | 14.2 | 670 | 783 | — |
| T21 | S01 | A12 | 114 | ○ | — | 36 | 20 | ○ | 17.8 | 640 | 767 | 0.12 |
| T22 | S01 | B1 | 114 | ○ | — | 38 | 24 | ○ | 16.4 | 647 | 769 | 0.13 |
| T23 | S01 | B2 | 114 | ○ | — | 40 | 26 | — | 16.7 | 648 | 771 | 0.12 |
| T24 | S01 | B3 | 115 | ○ | — | 38 | 24 | — | 16.8 | 648 | 771 | — |
| T25 | S01 | BH1 | 114 | ○ | — | 34 | 22 | — | 16.6 | 647 | 769 | — |
| T26 | S01 | BH2 | 113 | ○ | — | 84 | 50 | ○ | 14.0 | 623 | 736 | — |
| T27 | S01 | BH3 | 115 | ○ | — | 98 | 56 | ○ | 12.7 | 608 | 715 | 0.40 |
| T28 | S01 | C0 | 108 | ○ | ○ | 126 | 72 | Δ | 15.7 | 548 | 667 | 0.44 |
| T29 | S01 | C1 | 111 | ○ | — | 44 | 28 | ○ | 19.2 | 582 | 713 | 0.16 |
| T30 | S01 | C2 | 110 | ○ | — | 60 | 36 | ○ | 19.5 | 582 | 715 | — |
| T31 | S01 | CH1 | 110 | ○ | — | 88 | 54 | — | 16.3 | 558 | 679 | — |
| T32 | S01 | CH2 | 110 | ○ | — | 94 | 50 | ○ | 17.9 | 569 | 696 | 0.34 |
| T33 | S01 | DH1 | 108 | ○ | | 118 | 68 | — | 16.2 | 555 | 676 | 0.41 |
| T34 | S01 | D1 | 112 | ○ | | 32 | 20 | — | 20.1 | 597 | 731 | 0.11 |

TABLE 22

| Test No. | Alloy No. | Step No. | Wear Resistance: Amsler Abrasion Test | Wear Resistance: Ball-on-Disk Abrasion Test | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|---|
| T18 | S01 | AH9 | Extrusion unable to be performed to the end | | | | |
| T19 | S01 | A10 | | | — | — | — |
| T20 | S01 | A11 | | | 0.0031 | 62 | 41 |
| T21 | S01 | A12 | | | 0.0031 | 63 | 45 |
| T22 | S01 | B1 | | | 0.0031 | 64 | — |
| T23 | S01 | B2 | | | — | 62 | — |
| T24 | S01 | B3 | | | — | — | — |
| T25 | S01 | BH1 | | | — | — | — |
| T26 | S01 | BH2 | | | — | — | — |
| T27 | S01 | BH3 | | | 0.0050 | 88 | 71 |
| T28 | S01 | C0 | ○ | ○ | 0.0060 | 108 | 74 |
| T29 | S01 | C1 | ◎ | ◎ | 0.0033 | 63 | 44 |
| T30 | S01 | C2 | | | — | 64 | 43 |
| T31 | S01 | CH1 | ○ | Δ | — | 76 | 52 |
| T32 | S01 | CH2 | | | 0.0038 | 73 | 49 |
| T33 | S01 | DH1 | | | 0.0059 | 106 | 73 |
| T34 | S01 | D1 | | | 0.0030 | 64 | 45 |

TABLE 23

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T35 | S01 | D2 | 49.0 | 0.3 | 0 | 0 | 99.7 | 100 | 0.3 | 54.7 | 18 | 1 | ○ | 0.52 | 0.12 |
| T36 | S01 | D3 | 49.3 | 0.4 | 0 | 0.3 | 99.3 | 100 | 0.7 | 55.7 | 24 | 16 | ○ | 0.52 | 0.12 |
| T37 | S01 | DH2 | 49.0 | 0.3 | 0 | 1.1 | 98.6 | 100 | 1.4 | 55.3 | 20 | 24 | ○ | 0.53 | 0.12 |
| T38 | S01 | D4 | 47.4 | 1.4 | 0 | 0 | 98.6 | 100 | 1.4 | 56.9 | 44 | 0 | Δ | 0.49 | 0.12 |
| T39 | S01 | D5 | 48.5 | 0.9 | 0 | 0 | 99.1 | 100 | 0.9 | 56.6 | 38 | 0 | ○ | 0.50 | 0.12 |
| T40 | S01 | D6 | 48.9 | 0.6 | 0 | 0 | 99.4 | 100 | 0.6 | 56.0 | 30 | 0 | ○ | 0.51 | 0.12 |
| T41 | S01 | DH3 | 48.4 | 1.1 | 0 | 2.0 | 96.9 | 100 | 3.1 | 58.1 | 40 | 30 | ○ | 0.50 | 0.12 |
| T42 | S01 | DH4 | 47.2 | 1.8 | 0 | 0 | 98.2 | 100 | 1.8 | 57.6 | 44 | 0 | ○ | 0.48 | 0.12 |
| T43 | S01 | D7 | 48.0 | 1.5 | 0 | 0 | 98.5 | 100 | 1.5 | 57.7 | 42 | 0 | ○ | 0.48 | 0.12 |
| T44 | S01 | DH5 | 45.2 | 3.3 | 0 | 0 | 96.7 | 100 | 3.3 | 58.4 | 60 | 0 | Δ | 0.43 | 0.12 |

TABLE 23-continued

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T45 | S01 | EH1, E2 | 37.4 | 5.2 | 0 | 0 | 94.8 | 100 | 5.2 | 53.0 | 90 | 0 | x | 0.40 | 0.12 |
| T46 | S01 | E1, E3 | 47.8 | 0.8 | 0 | 0 | 99.2 | 100 | 0.8 | 55.6 | 24 | 0 | ○ | 0.51 | 0.12 |
| T47 | S01 | FH1 | 42.1 | 4.7 | 0 | 0 | 95.3 | 100 | 4.7 | 57.2 | 82 | 0 | x | 0.41 | 0.12 |
| T48 | S01 | F1 | 48.7 | 0.4 | 0 | 0 | 99.6 | 100 | 0.4 | 54.9 | 22 | 0 | ○ | 0.52 | 0.12 |
| T49 | S01 | F2 | 48.5 | 0.8 | 0 | 0 | 99.2 | 100 | 0.8 | 56.3 | 34 | 0 | ○ | 0.51 | 0.12 |
| T50 | S01 | F3 | 48.6 | 0.6 | 0 | 0 | 99.4 | 100 | 0.6 | 55.7 | 30 | 0 | ○ | 0.51 | 0.12 |
| T51 | S01 | FH2 | 48.5 | 0.8 | 0 | 1.8 | 97.4 | 100 | 2.6 | 57.2 | 36 | 24 | ○ | 0.51 | 0.12 |

15

TABLE 24

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509 | Impact Value (J/cm$^2$) | Tensile Strength (N/mm$^2$) | Strength Index | 150° C. Creep Strain (%) |
|---|---|---|---|---|---|---|---|---|---|---|---|---|
| T35 | S01 | D2 | 112 | ○ | — | 32 | 22 | — | 20.4 | 595 | 730 | 0.11 |
| T36 | S01 | D3 | 112 | ○ | — | 68 | 42 | — | 19.2 | 586 | 718 | — |
| T37 | S01 | DH2 | 113 | ○ | — | 76 | 46 | ○ | 18.2 | 576 | 704 | 0.30 |
| T38 | S01 | D4 | 116 | ○ | — | 70 | 42 | ○ | 18.2 | 577 | 705 | 0.21 |
| T39 | S01 | D5 | 110 | ○ | — | 56 | 36 | — | 19.1 | 590 | 721 | — |
| T40 | S01 | D6 | 111 | ○ | — | 46 | 28 | ○ | 19.7 | 593 | 726 | — |
| T41 | S01 | DH3 | 112 | ○ | — | 100 | 62 | — | 16.1 | 564 | 685 | — |
| T42 | S01 | DH4 | 110 | ○ | — | 78 | 48 | ○ | 17.3 | 578 | 702 | — |
| T43 | S01 | D7 | 110 | ○ | — | 68 | 44 | — | 17.7 | 580 | 706 | — |
| T44 | S01 | DH5 | 108 | ○ | — | 92 | 64 | ○ | 16.5 | 572 | 694 | 0.44 |
| T45 | S01 | EH1, E2 | 108 | ○ | ○ | 120 | 72 | ○ | 16.1 | 549 | 669 | 0.45 |
| T46 | S01 | E1, E3 | 111 | ○ | — | 40 | 24 | ○ | 19.5 | 585 | 718 | 0.15 |
| T47 | S01 | FH1 | 107 | ○ | — | 116 | 64 | ○ | 15.9 | 553 | 672 | 0.42 |
| T48 | S01 | F1 | 112 | ○ | — | 32 | 20 | ○ | 20.3 | 594 | 729 | 0.11 |
| T49 | S01 | F2 | 111 | ○ | — | 52 | 34 | ○ | 19.3 | 591 | 723 | — |
| T50 | S01 | F3 | 111 | ○ | — | 44 | 30 | — | 19.8 | 593 | 726 | 0.13 |
| T51 | S01 | FH2 | 113 | ○ | — | 86 | 54 | ○ | 16.5 | 568 | 690 | 0.40 |

TABLE 25

| | | | Wear Resistance | | Cavitation | Erosion-Corrosion | Erosion-Corrosion |
|---|---|---|---|---|---|---|---|
| Test No. | Alloy No. | Step No. | Amsler Abrasion Test | Ball-on-Disk Abrasion Test | Resistance (Decrease in Weight) (g) | Resistance 1 (Decrease in Weight) (mg) | Resistance 2 (Decrease in Weight) (mg) |
| T35 | S01 | D2 | | | — | 61 | 46 |
| T36 | S01 | D3 | | | — | — | — |
| T37 | S01 | DH2 | | | 0.0033 | — | 58 |
| T38 | S01 | D4 | | | 0.0042 | 77 | 62 |
| T39 | S01 | D5 | | | — | 63 | — |
| T40 | S01 | D6 | | | — | 61 | — |
| T41 | S01 | DH3 | | | — | — | — |
| T42 | S01 | DH4 | | | — | — | — |
| T43 | S01 | D7 | | | — | — | — |
| T44 | S01 | DH5 | | | — | 92 | 64 |
| T45 | S01 | EH1, E2 | | | 0.0061 | 109 | 72 |
| T46 | S01 | E1, E3 | | | 0.0033 | 61 | 45 |
| T47 | S01 | FH1 | | | 0.0006 | 108 | 71 |
| T48 | S01 | F1 | | | 0.0031 | 63 | 44 |
| T49 | S01 | F2 | | | 0.0032 | 63 | — |
| T50 | S01 | F3 | | | 0.0031 | 62 | — |
| T51 | S01 | FH2 | | | — | 70 | 54 |

TABLE 26

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T60 | S02 | AH1 | 39.9 | 5.2 | 0 | 0 | 94.8 | 100 | 5.2 | 55.6 | 88 | 0 | ○ | 0.55 | 0.15 |
| T61 | S02 | AH2 | 39.5 | 5.3 | 0 | 0 | 94.7 | 100 | 5.3 | 55.3 | 90 | 0 | ○ | 0.55 | 0.15 |
| T62 | S02 | A1 | 52.4 | 0.5 | 0 | 0 | 99.5 | 100 | 0.5 | 59.3 | 22 | 0 | ○ | 0.70 | 0.14 |
| T63 | S02 | A2 | 52.0 | 0.5 | 0 | 0 | 99.5 | 100 | 0.5 | 58.8 | 22 | 0 | ○ | 0.70 | 0.14 |
| T64 | S02 | A3 | 52.5 | 0.7 | 0 | 0 | 99.3 | 100 | 0.7 | 60.1 | 20 | 1 | ○ | 0.69 | 0.14 |
| T65 | S02 | A4 | 52.4 | 0.7 | 0 | 0.3 | 99.0 | 100 | 1.0 | 60.2 | 26 | 10 | ○ | 0.69 | 0.14 |
| T66 | S02 | AH3 | 52.0 | 0.7 | 0 | 1.3 | 98.0 | 100 | 2.0 | 60.2 | 24 | 28 | ○ | 0.70 | 0.14 |
| T67 | S02 | AH4 | 50.7 | 0.5 | 0 | 4.0 | 95.5 | 100 | 4.5 | 59.5 | 22 | 40 or more | ○ | 0.68 | 0.15 |
| T68 | S02 | A5 | 52.0 | 0.7 | 0 | 0 | 99.3 | 100 | 0.7 | 59.6 | 32 | 0 | ○ | 0.69 | 0.14 |
| T69 | S02 | A6 | 49.3 | 1.5 | 0 | 0 | 98.5 | 100 | 1.5 | 59.1 | 46 | 0 | Δ | 0.66 | 0.14 |
| T70 | S02 | AH5 | 49.0 | 1.5 | 0 | 0 | 98.5 | 100 | 1.5 | 58.8 | 50 | 0 | x | 0.66 | 0.14 |
| T71 | S02 | AH6 | 47.6 | 2.7 | 0 | 0 | 97.3 | 100 | 2.7 | 59.8 | 60 | 0 | x | 0.62 | 0.14 |
| T72 | S02 | AH7 | 48.8 | 1.8 | 0 | 0 | 98.2 | 100 | 1.8 | 59.3 | 48 | 0 | Δ | 0.65 | 0.14 |
| T73 | S02 | A7 | 50.6 | 1.3 | 0 | 0 | 98.7 | 100 | 1.3 | 60.0 | 36 | 0 | ○ | 0.67 | 0.14 |
| T74 | S02 | A8 | 52.0 | 0.8 | 0 | 0 | 99.2 | 100 | 0.8 | 60.0 | 32 | 0 | ○ | 0.69 | 0.14 |
| T75 | S02 | AH8 | 50.8 | 1.1 | 0 | 2.2 | 96.7 | 100 | 3.3 | 60.7 | 34 | 40 or more | ○ | 0.69 | 0.15 |
| T76 | S02 | A9 | 51.5 | 1.0 | 0 | 0 | 99.0 | 100 | 1.0 | 60.1 | 36 | 0 | ○ | 0.68 | 0.14 |

TABLE 27

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T60 | S02 | AH1 | 107 | ○ | ○ | 118 | 70 | ○ | 13.2 | 550 | 659 | 0.48 |
| T61 | S02 | AH2 | 107 | ○ | — | 120 | 74 | — | 10.3 | 599 | 695 | — |
| T62 | S02 | A1 | 113 | ○ | ○ | 32 | 20 | ○ | 15.2 | 630 | 747 | 0.13 |
| T63 | S02 | A2 | 113 | ○ | — | 32 | 24 | — | 15.3 | 627 | 744 | — |
| T64 | S02 | A3 | 113 | ○ | — | 36 | 28 | — | 14.8 | 626 | 741 | — |
| T65 | S02 | A4 | 113 | ○ | — | 62 | 38 | — | 14.5 | 618 | 733 | — |
| T66 | S02 | AH3 | 112 | ○ | — | 82 | 50 | — | 13.0 | 602 | 710 | — |
| T67 | S02 | AH4 | 115 | ○ | — | 102 | 68 | ○ | 11.4 | 576 | 678 | 0.47 |
| T68 | S02 | A5 | 113 | ○ | — | 50 | 30 | — | 14.9 | 626 | 741 | 0.15 |
| T69 | S02 | A6 | 114 | ○ | — | 70 | 48 | — | 14.0 | 613 | 725 | — |
| T70 | S02 | AH5 | 117 | ○ | — | 84 | 52 | — | 14.1 | 599 | 712 | — |
| T71 | S02 | AH6 | 113 | ○ | — | 104 | 62 | — | 12.2 | 604 | 709 | — |
| T72 | S02 | AH7 | 114 | ○ | — | 78 | 48 | — | 13.6 | 610 | 721 | 0.36 |
| T73 | S02 | A7 | 112 | ○ | — | 60 | 38 | — | 14.1 | 621 | 733 | — |
| T74 | S02 | A8 | 113 | ○ | — | 48 | 32 | — | 14.7 | 625 | 740 | — |
| T75 | S02 | AH8 | 114 | ○ | — | 86 | 54 | ○ | 11.9 | 590 | 693 | — |
| T76 | S02 | A9 | 113 | ○ | — | 58 | 36 | — | 14.4 | 623 | 737 | 0.18 |

TABLE 28

| Test No. | Alloy No. | Step No. | Wear Resistance: Amsler Abrasion Test | Wear Resistance: Ball-On-Disk Abrasion Test | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|---|
| T60 | S02 | AH1 | | | 0.0060 | 70 | 52 |
| T61 | S02 | AH2 | | | — | — | — |
| T62 | S02 | A1 | | | 0.0020 | 33 | 24 |
| T63 | S02 | A2 | | | — | — | — |
| T64 | S02 | A3 | | | — | — | — |
| T65 | S02 | A4 | | | — | — | — |
| T66 | S02 | AH3 | | | — | — | — |
| T67 | S02 | AH4 | | | 0.0040 | 54 | 50 |
| T68 | S02 | A5 | | | 0.0020 | 33 | 25 |
| T69 | S02 | A6 | | | — | — | — |
| T70 | S02 | AH5 | | | 0.0030 | — | — |

TABLE 28-continued

| Test No. | Alloy No. | Step No. | Wear Resistance: Amsler Abrasion Test | Wear Resistance: Ball-On-Disk Abrasion Test | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|---|
| T71 | S02 | AH6 | | | — | — | — |
| T72 | S02 | AH7 | | | 0.0030 | 45 | 34 |
| T73 | S02 | A7 | | | — | — | — |
| T74 | S02 | A8 | | | — | 31 | 27 |
| T75 | S02 | AH8 | | | — | — | — |
| T76 | S02 | A9 | | | 0.0030 | 37 | 30 |

15

TABLE 29

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T77 | S02 | AH9 | Extrusion unable to be performed to the end | | | | | | | | | | | | |
| T78 | S02 | A10 | 52.4 | 0.6 | 0 | 0 | 99.4 | 100 | 0.6 | 59.7 | 22 | 0 | ○ | 0.70 | 0.14 |
| T79 | S02 | A11 | 52.0 | 0.5 | 0 | 0 | 99.5 | 100 | 0.5 | 58.8 | 20 | 0 | ○ | 0.70 | 0.14 |
| T80 | S02 | A12 | 52.4 | 0.7 | 0 | 0 | 99.3 | 100 | 0.7 | 60.0 | 24 | 0 | ○ | 0.69 | 0.14 |
| T81 | S02 | B1 | 52.4 | 0.5 | 0 | 0 | 99.5 | 100 | 0.5 | 59.3 | 20 | 1 | ○ | 0.70 | 0.14 |
| T82 | S02 | B2 | 52.0 | 0.7 | 0 | 0 | 99.3 | 100 | 0.7 | 59.5 | 24 | 2 | ○ | 0.69 | 0.14 |
| T83 | S02 | B3 | 52.1 | 0.7 | 0 | 0 | 99.3 | 100 | 0.7 | 59.6 | 24 | 2 | ○ | 0.69 | 0.14 |
| T84 | S02 | BH1 | 52.2 | 0.6 | 0 | 0 | 99.4 | 100 | 0.6 | 59.5 | 20 | 0 | ○ | 0.70 | 0.14 |
| T85 | S02 | BH2 | 51.1 | 0.5 | 0 | 1.7 | 97.8 | 100 | 2.2 | 58.7 | 24 | 24 | ○ | 0.71 | 0.15 |
| T86 | S02 | BH3 | 50.2 | 0.4 | 0 | 2.5 | 97.1 | 100 | 2.9 | 57.8 | 22 | 40 or more | ○ | 0.73 | 0.15 |
| T87 | S02 | C0 | 40.0 | 5.5 | 0 | 0 | 94.5 | 100 | 5.5 | 56.1 | 92 | 0 | x | 0.54 | 0.15 |
| T88 | S02 | C1 | 52.3 | 0.9 | 0 | 0 | 99.1 | 100 | 0.9 | 60.6 | 32 | 0 | ○ | 0.68 | 0.14 |
| T89 | S02 | C2 | 52.0 | 0.9 | 0 | 0 | 99.1 | 100 | 0.9 | 60.3 | 34 | 10 | ○ | 0.68 | 0.14 |
| T90 | S02 | CH1 | 50.6 | 0.8 | 0 | 1.8 | 97.4 | 100 | 2.6 | 59.4 | 30 | 32 | ○ | 0.70 | 0.15 |
| T91 | S02 | CH2 | 51.3 | 1.5 | 0 | 0 | 98.5 | 100 | 1.5 | 61.2 | 54 | 0 | ○ | 0.66 | 0.14 |
| T92 | S02 | DH1 | 40.4 | 4.9 | 0 | 0 | 95.1 | 100 | 4.9 | 55.7 | 84 | 0 | x | 0.56 | 0.15 |
| T93 | S02 | D1 | 52.5 | 0.5 | 0 | 0 | 99.5 | 100 | 0.5 | 59.4 | 16 | 0 | ○ | 0.70 | 0.14 |

TABLE 30

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T77 | S02 | AH9 | Extrusion unable to be performed to the end | | | | | | | | | |
| T78 | S02 | A10 | 114 | ○ | — | 32 | 22 | — | 13.6 | 645 | 756 | 0.14 |
| T79 | S02 | A11 | 115 | ○ | — | 32 | 20 | ○ | 12.4 | 676 | 782 | — |
| T80 | S02 | A12 | 114 | ○ | — | 36 | 24 | — | 14.5 | 640 | 754 | — |
| T81 | S02 | B1 | 114 | ○ | — | 34 | 22 | — | 13.8 | 654 | 765 | — |
| T82 | S02 | B2 | 114 | ○ | — | 38 | 26 | — | 13.6 | 653 | 763 | 0.15 |
| T83 | S02 | B3 | 114 | ○ | — | 40 | 24 | — | 13.6 | 653 | 763 | — |
| T84 | S02 | BH1 | 114 | ○ | — | 34 | 22 | — | 13.3 | 653 | 763 | — |
| T85 | S02 | BH2 | 113 | ○ | — | 74 | 44 | ○ | 11.8 | 629 | 732 | — |
| T86 | S02 | BH3 | 112 | ○ | — | 88 | 50 | ○ | 11.4 | 618 | 719 | 0.42 |
| T87 | S02 | C0 | 106 | ○ | ○ | 128 | 74 | — | 11.8 | 542 | 645 | 0.50 |
| T88 | S02 | C1 | 111 | ○ | — | 50 | 32 | ○ | 15.6 | 579 | 697 | 0.16 |
| T89 | S02 | C2 | 110 | ○ | — | 58 | 40 | — | 15.9 | 578 | 698 | — |
| T90 | S02 | CH1 | 109 | ○ | — | 86 | 52 | ○ | 13.7 | 558 | 669 | — |
| T91 | S02 | CH2 | 110 | ○ | — | 82 | 54 | — | 14.0 | 570 | 682 | — |
| T92 | S02 | DH1 | 107 | ○ | — | 114 | 68 | — | 12.9 | 548 | 656 | 0.48 |
| T93 | S02 | D1 | 111 | ○ | — | 28 | 18 | — | 16.7 | 585 | 707 | 0.13 |

TABLE 31

| Test No. | Alloy No. | Step No. | Wear Resistance: Amsler Abrasion Test | Wear Resistance: Ball-On-Disk Abrasion Test | Erosion-Cavitation Resistance (Decrease in Weight) (g) | Erosion-Corrosion Resistance 1 (Decrease in Weight) (mg) | Corrosion Resistance 2 (Decrease in Weight) (mg) |
|---|---|---|---|---|---|---|---|
| T77 | S02 | AH9 | Extrusion unable to be performed to the end | | | | |
| T78 | S02 | A10 | | | 0.0020 | 31 | 23 |
| T79 | S02 | A11 | | | — | — | — |
| T80 | S02 | A12 | | | — | — | — |
| T81 | S02 | B1 | | | — | — | — |
| T82 | S02 | B2 | | | 0.0020 | 31 | 26 |
| T83 | S02 | B3 | | | — | — | — |
| T84 | S02 | BH1 | | | — | — | — |
| T85 | S02 | BH2 | | | — | — | — |
| T86 | S02 | BH3 | | | 0.0050 | 50 | 41 |
| T87 | S02 | C0 | ◎ | Δ | — | 71 | — |
| T88 | S02 | C1 | ◎ | ◎ | 0.0020 | 33 | 24 |
| T89 | S02 | C2 | | | — | — | — |
| T90 | S02 | CH1 | | | — | — | — |
| T91 | S02 | CH2 | | | — | — | — |
| T92 | S02 | DH1 | | | 0.0050 | — | 50 |
| T93 | S02 | D1 | | | 0.0020 | 32 | 23 |

TABLE 32

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T94 | S02 | D2 | 52.5 | 0.4 | 0 | 0 | 99.6 | 100 | 0.4 | 58.9 | 18 | 1 | ○ | 0.71 | 0.14 |
| T95 | S02 | D3 | 52.0 | 0.6 | 0 | 0.3 | 99.1 | 100 | 0.9 | 59.4 | 24 | 18 | ○ | 0.70 | 0.14 |
| T96 | S02 | DH2 | 51.8 | 0.5 | 0 | 1.0 | 98.5 | 100 | 1.5 | 59.1 | 22 | 22 | ○ | 0.71 | 0.14 |
| T97 | S02 | D4 | 48.3 | 1.3 | 0 | 0 | 98.7 | 100 | 1.3 | 57.6 | 46 | 0 | Δ | 0.67 | 0.15 |
| T98 | S02 | D5 | 50.4 | 1.0 | 0 | 0 | 99.0 | 100 | 1.0 | 58.9 | 34 | 0 | ○ | 0.68 | 0.14 |
| T99 | S02 | D6 | 52.4 | 0.6 | 0 | 0 | 99.4 | 100 | 0.6 | 59.7 | 28 | 0 | ○ | 0.70 | 0.14 |
| T100 | S02 | DH3 | 50.5 | 1.0 | 0 | 1.7 | 97.3 | 100 | 2.7 | 59.9 | 38 | 32 | ○ | 0.69 | 0.15 |
| T101 | S02 | DH4 | 50.0 | 1.9 | 0 | 0 | 98.1 | 100 | 1.9 | 60.8 | 44 | 0 | ○ | 0.65 | 0.14 |
| T102 | S02 | D7 | 50.4 | 1.6 | 0 | 0 | 98.4 | 100 | 1.6 | 60.5 | 40 | 0 | ○ | 0.66 | 0.14 |
| T103 | S02 | DH5 | 47.7 | 3.4 | 0 | 0 | 96.6 | 100 | 3.4 | 61.1 | 64 | 0 | Δ | 0.59 | 0.14 |
| T104 | S02 | EH1, E2 | 39.8 | 5.5 | 0 | 0 | 94.5 | 100 | 5.5 | 55.9 | 90 | 0 | x | 0.54 | 0.15 |
| T105 | S02 | E1, E3 | 52.4 | 0.8 | 0 | 0 | 99.2 | 100 | 0.8 | 60.4 | 24 | 0 | ○ | 0.69 | 0.14 |
| T106 | S02 | FH1 | 41.0 | 5.0 | 0 | 0 | 95.0 | 100 | 5.0 | 56.5 | 78 | 0 | x | 0.55 | 0.15 |
| T107 | S02 | F1 | 52.5 | 0.6 | 0 | 0 | 99.4 | 100 | 0.6 | 59.8 | 20 | 0 | ○ | 0.70 | 0.14 |
| T108 | S02 | F2 | 52.3 | 1.0 | 0 | 0 | 99.0 | 100 | 1.0 | 60.9 | 34 | 0 | ○ | 0.68 | 0.14 |
| T109 | S02 | F3 | 52.4 | 0.7 | 0 | 0 | 99.3 | 100 | 0.7 | 60.0 | 30 | 0 | ○ | 0.69 | 0.14 |
| T110 | S02 | FH2 | 52.0 | 0.9 | 0 | 1.6 | 97.5 | 100 | 2.5 | 61.1 | 38 | 28 | ○ | 0.69 | 0.14 |

TABLE 33

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact value (J/cm$^2$) | Tensile Strength (N/mm$^2$) | Strength Index | 150° C. Creep Strain (%) |
|---|---|---|---|---|---|---|---|---|---|---|---|---|
| T94 | S02 | D2 | 111 | ○ | — | 30 | 20 | — | 17.0 | 583 | 706 | — |
| T95 | S02 | D3 | 110 | ○ | — | 58 | 36 | — | 16.3 | 573 | 694 | — |
| T96 | S02 | DH2 | 110 | ○ | — | 66 | 44 | ○ | 15.2 | 561 | 678 | — |
| T97 | S02 | D4 | 113 | ○ | — | 70 | 44 | — | 16.2 | 570 | 691 | — |
| T98 | S02 | D5 | 110 | ○ | — | 56 | 36 | — | 16.2 | 578 | 699 | 0.18 |
| T99 | S02 | D6 | 111 | ○ | — | 42 | 28 | — | 16.5 | 581 | 703 | 0.14 |
| T100 | S02 | DH3 | 109 | ○ | — | 86 | 56 | — | 13.6 | 553 | 663 | — |
| 1101 | S02 | DH4 | 109 | ○ | — | 76 | 48 | — | 14.5 | 572 | 686 | — |
| T102 | S02 | D7 | 110 | ○ | — | 68 | 44 | — | 15.0 | 574 | 690 | — |
| T103 | S02 | DH5 | 109 | ○ | — | 102 | 66 | ○ | 13.0 | 560 | 669 | — |
| T104 | S02 | EH1, E2 | 106 | ○ | ○ | 122 | 72 | — | 11.9 | 542 | 645 | — |

TABLE 33-continued

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact value (J/cm$^2$) | Tensile Strength (N/mm$^2$) | Strength Index | 150° C. Creep Strain (%) |
|---|---|---|---|---|---|---|---|---|---|---|---|---|
| T105 | S02 | E1, E3 | 111 | ○ | — | 40 | 26 | — | 15.7 | 580 | 699 | 0.16 |
| T106 | S02 | FH1 | 107 | ○ | — | 112 | 68 | ○ | 12.7 | 545 | 652 | 0.49 |
| T107 | S02 | F1 | 111 | ○ | — | 32 | 20 | ○ | 16.5 | 581 | 703 | 0.14 |
| T108 | S02 | F2 | 111 | ○ | — | 52 | 32 | — | 15.7 | 578 | 697 | — |
| T109 | S02 | F3 | 111 | ○ | — | 46 | 28 | — | 16.3 | 580 | 702 | — |
| T110 | S02 | FH2 | 110 | ○ | — | 82 | 52 | ○ | 13.3 | 554 | 664 | — |

TABLE 34

| Test No. | Alloy No. | Step No. | Wear Resistance: Amsler Abrasion Test | Wear Resistance: Ball-On-Disk Abrasion Test | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|---|
| T94 | S02 | D2 | | | — | — | — |
| T95 | S02 | D3 | | | — | — | — |
| T96 | S02 | DH2 | | | — | — | — |
| T97 | S02 | D4 | | | 0.0020 | 33 | 27 |
| T98 | S02 | D5 | | | — | — | — |
| T99 | S02 | D6 | | | 0.0020 | 31 | 26 |
| T100 | S02 | DH3 | | | — | — | — |
| T101 | S02 | DH4 | | | — | 42 | 34 |
| T102 | S02 | D7 | | | 0.0030 | 35 | 28 |
| T103 | S02 | DH5 | | | 0.0040 | — | — |
| T104 | S02 | EH1, E2 | | | — | — | — |
| T105 | S02 | E1, E3 | | | 0.0020 | 31 | 27 |
| T106 | S02 | FH1 | | | 0.0050 | 67 | 48 |
| T107 | S02 | F1 | | | 0.0020 | 30 | 24 |
| T108 | S02 | F2 | | | — | — | — |
| T109 | S02 | F3 | | | — | — | — |
| T110 | S02 | FH2 | | | — | 52 | 36 |

TABLE 35

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T120 | S03 | AH1 | 30.0 | 4.9 | 0 | 0 | 95.1 | 100 | 4.9 | 43.3 | 84 | 0 | x | 0.35 | 0.11 |
| T121 | S03 | AH2 | 30.0 | 4.9 | 0 | 0 | 95.1 | 100 | 4.9 | 43.3 | 84 | 0 | x | 0.35 | 0.11 |
| T122 | S03 | A1 | 38.8 | 0.5 | 0 | 0 | 99.5 | 100 | 0.5 | 43.0 | 22 | 0 | ○ | 0.45 | 0.11 |
| T123 | S03 | A3 | 38.6 | 0.5 | 0 | 0 | 99.5 | 100 | 0.5 | 42.8 | 24 | 4 | ○ | 0.45 | 0.11 |
| T124 | S03 | A4 | 38.4 | 0.4 | 0 | 0.7 | 98.9 | 100 | 1.1 | 42.5 | 20 | 20 | ○ | 0.46 | 0.12 |
| T125 | S03 | AH3 | 37.8 | 0.4 | 0 | 2.5 | 97.1 | 100 | 2.9 | 42.8 | 20 | 36 | ○ | 0.47 | 0.12 |
| T126 | S03 | AH4 | 35.5 | 0.3 | 0 | 5.4 | 94.3 | 100 | 5.7 | 41.5 | 18 | 40 or more | ○ | 0.49 | 0.12 |
| T127 | S03 | A5 | 38.2 | 0.7 | 0 | 0 | 99.3 | 100 | 0.7 | 43.2 | 28 | 0 | ○ | 0.45 | 0.11 |
| T128 | S03 | A6 | 36.0 | 1.4 | 0 | 0 | 98.6 | 100 | 1.4 | 43.1 | 42 | 0 | Δ | 0.43 | 0.12 |
| T129 | S03 | AH5 | 35.6 | 1.8 | 0 | 0 | 98.2 | 100 | 1.8 | 43.6 | 56 | 0 | x | 0.42 | 0.11 |
| T130 | S03 | AH6 | 35.2 | 2.4 | 0 | 0 | 97.6 | 100 | 2.4 | 44.5 | 60 | 0 | x | 0.40 | 0.11 |
| T131 | S03 | AH7 | 35.4 | 1.6 | 0 | 0 | 98.4 | 100 | 1.6 | 43.0 | 50 | 0 | Δ | 0.42 | 0.12 |
| T132 | S03 | A7 | 37.4 | 1.2 | 0 | 0 | 98.8 | 100 | 1.2 | 44.0 | 40 | 0 | Δ | 0.43 | 0.11 |
| T133 | S03 | A8 | 38.5 | 0.8 | 0 | 0 | 99.2 | 100 | 0.8 | 43.9 | 28 | 0 | ○ | 0.44 | 0.11 |
| T134 | S03 | AH8 | 37.0 | 1.0 | 0 | 3.0 | 96.0 | 100 | 4.0 | 44.5 | 36 | 40 or more | ○ | 0.45 | 0.12 |
| T135 | S03 | A9 | 38.0 | 1.0 | 0 | 0 | 99.0 | 100 | 1.0 | 44.0 | 32 | 0 | ○ | 0.44 | 0.11 |
| T136 | S03 | A10 | 38.5 | 0.5 | 0 | 0 | 99.5 | 100 | 0.5 | 42.7 | 20 | 0 | ○ | 0.45 | 0.11 |
| T137 | S03 | A11 | 38.3 | 0.5 | 0 | 0 | 99.5 | 100 | 0.5 | 44.5 | 24 | 0 | ○ | 0.45 | 0.11 |
| T138 | S03 | A12 | 38.2 | 0.6 | 0 | 0 | 99.4 | 100 | 0.6 | 44.8 | 22 | 0 | ○ | 0.45 | 0.11 |

TABLE 36

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/nm$^2$) | Strength Index | 150° C. Creep Strain (%) |
|---|---|---|---|---|---|---|---|---|---|---|---|---|
| T120 | S03 | AH1 | 111 | ○ | ○ | 120 | 70 | ○ | 17.2 | 536 | 660 | 0.56 |
| T121 | S03 | AH2 | 112 | ○ | — | 120 | 70 | — | 17.2 | 536 | 660 | 0.56 |
| T122 | S03 | A1 | 118 | ○ | — | 34 | 20 | — | 24.1 | 611 | 758 | 0.12 |
| T123 | S03 | A3 | 118 | ○ | — | 38 | 24 | — | 23.9 | 611 | 758 | 0.14 |
| T124 | S03 | A4 | 117 | ○ | — | 60 | 34 | — | 22.6 | 601 | 743 | 0.23 |
| T125 | S03 | AH3 | 119 | ○ | — | 84 | 48 | ○ | 19.7 | 583 | 716 | 0.38 |
| T126 | S03 | AH4 | 121 | ○ | — | 84 | 50 | ○ | 16.0 | 555 | 676 | 0.49 |
| T127 | S03 | A5 | 117 | ○ | — | 44 | 26 | — | 23.5 | 609 | 755 | — |
| T128 | S03 | A6 | 121 | ○ | — | 68 | 44 | — | 21.9 | 590 | 730 | — |
| T129 | S03 | AH5 | 120 | ○ | — | 88 | 54 | — | 20.2 | 577 | 712 | — |
| T130 | S03 | AH6 | 119 | ○ | — | 92 | 58 | — | 19.3 | 580 | 712 | 0.31 |
| T131 | S03 | AH7 | 121 | ○ | — | 82 | 50 | — | 21.6 | 588 | 727 | — |
| T132 | S03 | A7 | 121 | ○ | — | 64 | 40 | — | 21.1 | 581 | 719 | — |
| T133 | S03 | A8 | 117 | ○ | — | 46 | 28 | — | 21.4 | 605 | 744 | 0.15 |
| T134 | S03 | AH8 | 116 | ○ | — | 86 | 60 | — | 17.2 | 584 | 708 | 0.47 |
| T135 | S03 | A9 | 116 | ○ | — | 56 | 34 | — | 22.7 | 604 | 747 | 0.17 |
| T136 | S03 | A10 | 118 | ○ | — | 32 | 20 | — | 19.9 | 606 | 740 | — |
| T137 | S03 | A11 | 117 | ○ | — | 38 | 22 | — | 17.8 | 603 | 730 | 0.12 |
| T138 | S03 | A12 | 117 | ○ | — | 36 | 20 | — | 22.6 | 602 | 745 | — |

TABLE 37

| Test No. | Alloy No. | Step No. | Wear Resistance: Amsler Abrasion Test | Wear Resistance: Ball-On-Disk Abrasion Test | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|---|
| T120 | S03 | AH1 | | | 0.0074 | 124 | 80 |
| T121 | S03 | AH2 | | | 0.0074 | 121 | 82 |
| T122 | S03 | A1 | | | 0.0040 | 78 | 53 |
| T123 | S03 | A3 | | | — | — | — |
| T124 | S03 | A4 | | | — | 80 | — |
| T125 | S03 | AH3 | | | — | — | — |
| T126 | S03 | AH4 | | | 0.0070 | 102 | 73 |
| T127 | S03 | A5 | | | 0.0040 | — | — |
| T128 | S03 | A6 | | | 0.0055 | 90 | 60 |
| T129 | S03 | AH5 | | | — | 98 | 64 |
| T130 | S03 | AH6 | | | 0.0060 | 105 | 70 |
| T131 | S03 | AH7 | | | — | — | — |
| T132 | S03 | A7 | | | — | 88 | 57 |
| T133 | S03 | A8 | | | 0.0040 | 83 | — |
| T134 | S03 | AH8 | | | 0.0060 | — | — |
| T135 | S03 | A9 | | | — | 84 | 56 |
| T136 | S03 | A10 | | | 0.0040 | 77 | — |
| T137 | S03 | A11 | | | 0.0050 | 80 | 54 |
| T138 | S03 | A12 | | | — | — | — |

TABLE 38

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T139 | S03 | C0 | 30.6 | 5.3 | 0 | 0 | 94.7 | 100 | 5.3 | 45.9 | 90 | 0 | x | 0.34 | 0.11 |
| T140 | S03 | C1 | 38.1 | 0.9 | 0 | 0 | 99.1 | 100 | 0.9 | 45.7 | 28 | 0 | ○ | 0.44 | 0.11 |
| T141 | S03 | CH2 | 37.8 | 1.4 | 0 | 0 | 98.6 | 100 | 1.4 | 46.8 | 52 | 0 | ○ | 0.43 | 0.11 |
| T142 | S03 | DH1 | 29.8 | 4.8 | 0 | 0 | 95.2 | 100 | 4.8 | 44.4 | 86 | 0 | x | 0.35 | 0.11 |
| T143 | S03 | D1 | 39.0 | 0.5 | 0 | 0 | 99.5 | 100 | 0.5 | 45.2 | 20 | 0 | ○ | 0.45 | 0.11 |
| T144 | S03 | D2 | 39.4 | 0.4 | 0 | 0 | 99.6 | 100 | 0.4 | 45.2 | 18 | 2 | ○ | 0.45 | 0.11 |
| T145 | S03 | D3 | 38.8 | 0.4 | 0 | 0.4 | 99.2 | 100 | 0.8 | 44.8 | 20 | 20 | ○ | 0.46 | 0.11 |
| T146 | S03 | DH2 | 38.4 | 0.4 | 0 | 1.2 | 98.4 | 100 | 1.6 | 44.7 | 18 | 24 | ○ | 0.46 | 0.12 |
| T147 | S03 | D4 | 36.0 | 1.5 | 0 | 0 | 98.5 | 100 | 1.5 | 45.1 | 46 | 0 | Δ | 0.43 | 0.12 |
| T148 | S03 | D5 | 37.7 | 1.1 | 0 | 0 | 98.9 | 100 | 1.1 | 45.9 | 40 | 0 | ○ | 0.43 | 0.11 |

TABLE 38-continued

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T149 | S03 | D6 | 38.6 | 0.6 | 0 | 0 | 99.4 | 100 | 0.6 | 45.2 | 30 | 0 | ○ | 0.45 | 0.11 |
| T150 | S03 | DH3 | 37.1 | 0.8 | 0 | 2.4 | 96.8 | 100 | 3.2 | 45.5 | 38 | 40 or more | ○ | 0.45 | 0.12 |
| T151 | S03 | DH4 | 36.8 | 1.8 | 0 | 0 | 98.2 | 100 | 1.8 | 46.7 | 50 | 0 | Δ | 0.42 | 0.11 |
| T152 | S03 | D7 | 37.0 | 1.4 | 0 | 0 | 98.6 | 100 | 1.4 | 45.9 | 44 | 0 | Δ | 0.43 | 0.11 |
| T153 | S03 | DH5 | 34.6 | 3.6 | 0 | 0 | 96.4 | 100 | 3.6 | 47.7 | 60 | 0 | x | 0.38 | 0.11 |
| T154 | S03 | F1 | 38.7 | 0.5 | 0 | 0 | 99.5 | 100 | 0.5 | 44.9 | 22 | 0 | ○ | 0.45 | 0.11 |
| T155 | S03 | F2 | 38.4 | 0.9 | 0 | 0 | 99.1 | 100 | 0.9 | 46.0 | 32 | 0 | ○ | 0.44 | 0.11 |
| T156 | S03 | F3 | 38.8 | 0.5 | 0 | 0 | 99.5 | 100 | 0.5 | 45.0 | 22 | 0 | ○ | 0.45 | 0.11 |

15

TABLE 39

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T139 | S03 | C0 | 110 | ○ | ○ | 122 | 74 | ○ | 20.4 | 539 | 674 | — |
| T140 | S03 | C1 | 114 | ○ | — | 48 | 28 | ○ | 24.3 | 563 | 711 | 0.16 |
| T141 | S03 | CH2 | 112 | ○ | — | 82 | 52 | — | 23.1 | 542 | 686 | — |
| T142 | S03 | DH1 | 111 | ○ | ○ | 118 | 68 | — | 21.7 | 545 | 684 | — |
| T143 | S03 | D1 | 116 | ○ | — | 32 | 20 | — | 24.6 | 574 | 723 | 0.12 |
| T144 | S03 | D2 | 116 | ○ | — | 36 | 22 | — | 24.7 | 572 | 721 | — |
| T145 | S03 | D3 | 115 | ○ | — | 64 | 42 | — | 23.5 | 558 | 703 | — |
| T146 | S03 | DH2 | 116 | ○ | — | 78 | 48 | ○ | 21.6 | 550 | 690 | — |
| T147 | S03 | D4 | 119 | ○ | — | 74 | 48 | — | 21.6 | 561 | 701 | — |
| T148 | S03 | D5 | 114 | ○ | — | 60 | 40 | — | 22.5 | 567 | 709 | — |
| T149 | S03 | D6 | 115 | ○ | — | 44 | 30 | — | 23.9 | 571 | 717 | 0.13 |
| T150 | S03 | DH3 | 114 | ○ | — | 96 | 64 | — | 20.5 | 540 | 676 | 0.40 |
| T151 | S03 | DH4 | 117 | ○ | — | 82 | 50 | ○ | 21.6 | 556 | 696 | — |
| T152 | S03 | D7 | 118 | ○ | — | 70 | 46 | — | 21.9 | 559 | 700 | — |
| T153 | S03 | DH5 | 110 | ○ | — | 98 | 60 | — | 17.0 | 538 | 661 | — |
| T154 | S03 | F1 | 116 | ○ | — | 34 | 20 | ○ | 24.7 | 571 | 721 | — |
| T155 | S03 | F2 | 115 | ○ | — | 50 | 34 | — | 23.6 | 569 | 714 | 0.16 |
| T156 | S03 | F3 | 117 | ○ | — | 38 | 24 | ○ | 24.4 | 571 | 720 | 0.12 |

TABLE 40

| | | | Wear Resistance | | | Erosion-Corrosion | Erosion-Corrosion |
|---|---|---|---|---|---|---|---|
| Test No. | Alloy No. | Step No. | Amsler Abrasion Test | Ball-On-Disk Abrasion Test | Cavitation Resistance (Decrease in Weight) (g) | Resistance 1 (Decrease in Weight) (mg) | Resistance 2 (Decrease in Weight) (mg) |
| T139 | S03 | C0 | ○ | ○ | 0.0070 | 126 | 85 |
| T140 | S03 | C1 | ◎ | ◎ | 0.0050 | 83 | 55 |
| T141 | S03 | CH2 | ○ | Δ | 0.0050 | — | — |
| T142 | S03 | DH1 | | | 0.0070 | 122 | 79 |
| T143 | S03 | D1 | | | 0.0040 | 78 | 53 |
| T144 | S03 | D2 | | | — | 79 | — |
| T145 | S03 | D3 | | | — | — | — |
| T146 | S03 | DH2 | | | — | 90 | 59 |
| T147 | S03 | D4 | | | 0.0060 | 92 | 63 |
| T148 | S03 | D5 | | | 0.0050 | 85 | — |
| T149 | S03 | D6 | | | — | 81 | — |
| T150 | S03 | DH3 | | | — | — | — |
| T151 | S03 | DH4 | | | — | — | — |
| T152 | S03 | D7 | | | 0.0060 | 96 | 64 |
| T153 | S03 | DH5 | | | — | 113 | 75 |
| T154 | S03 | F1 | | | 0.0040 | 81 | 55 |
| T155 | S03 | F2 | | | 0.0050 | — | — |
| T156 | S03 | F3 | | | — | 80 | — |

TABLE 41

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T201 | S11 | EH1 | 44.3 | 6.2 | 0 | 0 | 93.8 | 100 | 6.2 | 61.5 | 100 | 0 | x | 0.59 | 0.15 |
| T202 | S11 | E1 | 56.2 | 1.1 | 0 | 0 | 98.9 | 100 | 1.1 | 65.3 | 32 | 0 | ○ | 0.76 | 0.15 |
| T203 | S11 | FH1 | 45.6 | 5.9 | 0 | 0 | 94.1 | 100 | 5.9 | 62.5 | 80 | 0 | x | 0.59 | 0.15 |
| T204 | S11 | F1 | 56.3 | 0.7 | 0 | 0 | 99.3 | 100 | 0.7 | 64.1 | 24 | 0 | ○ | 0.78 | 0.15 |
| T205 | S11 | F2 | 56.0 | 1.2 | 0 | 0 | 98.8 | 100 | 1.2 | 65.4 | 34 | 0 | ○ | 0.76 | 0.15 |
| T206 | S11 | F3 | 57.0 | 0.9 | 0 | 0 | 99.1 | 100 | 0.9 | 65.5 | 30 | 0 | ○ | 0.77 | 0.15 |
| T207 | S11 | F152 | 56.5 | 1.1 | 0 | 1.4 | 97.5 | 100 | 2.5 | 66.3 | 38 | 24 | ○ | 0.77 | 0.15 |
| T208 | S12 | FH3 | 31.5 | 5.4 | 0 | 0 | 94.6 | 100 | 5.4 | 47.0 | 86 | 0 | x | 0.33 | 0.11 |
| T209 | S12 | F4 | 41.0 | 0.7 | 0 | 0 | 99.3 | 100 | 0.7 | 48.1 | 24 | 0 | ○ | 0.43 | 0.11 |
| T210 | S12 | F5 | 40.7 | 1.0 | 0 | 0 | 99.0 | 100 | 1.0 | 48.7 | 32 | 0 | ○ | 0.42 | 0.11 |
| T211 | S13 | E1 | 63.8 | 0.2 | 0 | 0 | 99.8 | 100 | 0.2 | 69.7 | 16 | 0 | ○ | 0.54 | 0.10 |
| T212 | S14 | EH1, E2 | 44.2 | 3.8 | 0 | 0 | 96.2 | 100 | 3.8 | 58.1 | 70 | 0 | x | 0.43 | 0.13 |
| T213 | S14 | E1 | 57.5 | 0.1 | 0 | 0 | 99.9 | 100 | 0.1 | 62.6 | 14 | 0 | ○ | 0.52 | 0.13 |
| T214 | S15 | FH3 | 42.0 | 5.8 | 0 | 0 | 94.2 | 100 | 5.8 | 58.5 | 90 | 0 | x | 0.52 | 0.14 |
| T215 | S15 | F4 | 54.0 | 0.8 | 0 | 0 | 99.2 | 100 | 0.8 | 62.1 | 26 | 0 | ○ | 0.68 | 0.14 |
| T216 | S15 | F5 | 53.4 | 1.0 | 0 | 0 | 99.0 | 100 | 1.0 | 62.1 | 36 | 0 | ○ | 0.67 | 0.14 |
| T217 | S16 | E1 | 58.2 | 0.9 | 0 | 0 | 99.1 | 100 | 0.9 | 66.8 | 36 | 0 | ○ | 0.77 | 0.10 |
| T218 | S17-1 | EH1, E2 | 50.5 | 4.5 | 0 | 0 | 95.5 | 100 | 4.5 | 65.8 | 80 | 0 | x | 0.67 | 0.14 |
| T219 | S17-2 | E1 | 62.9 | 0.7 | 0 | 0 | 99.3 | 100 | 0.7 | 71.1 | 32 | 0 | ○ | 0.82 | 0.11 |
| T220 | S18 | E1 | 40.1 | 1.1 | 0 | 0 | 98.9 | 100 | 1.1 | 48.4 | 34 | 0 | ○ | 0.46 | 0.20 |
| T221 | S19 | E1 | 56.2 | 0.7 | 0 | 0 | 99.3 | 100 | 0.7 | 64.0 | 36 | 0 | ○ | 0.55 | 0.08 |
| T222 | S20 | EH1 | 43.2 | 5.5 | 0 | 0 | 94.5 | 100 | 5.5 | 59.4 | 90 | 0 | x | 0.55 | 0.14 |
| T223 | S20 | E1 | 55.5 | 1.5 | 0 | 0 | 98.5 | 100 | 1.5 | 65.6 | 40 | 0 | ○ | 0.67 | 0.14 |

TABLE 42

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T201 | S11 | EH1 | 106 | ○ | ○ | 126 | 76 | — | 11.4 | 537 | 639 | — |
| T202 | S11 | E1 | 114 | ○ | — | 50 | 30 | — | 13.6 | 575 | 686 | — |
| T203 | S11 | FH1 | 107 | ○ | — | 118 | 70 | — | 11.7 | 540 | 642 | 0.49 |
| T204 | S11 | F1 | 114 | ○ | — | 38 | 26 | ○ | 14.6 | 581 | 696 | — |
| T205 | S11 | F2 | 114 | ○ | — | 58 | 38 | — | 13.8 | 575 | 686 | 0.20 |
| T206 | S11 | F3 | 115 | ○ | — | 48 | 32 | — | 14.1 | 580 | 692 | — |
| T207 | S11 | FH2 | 114 | ○ | — | 80 | 52 | — | 12.5 | 555 | 661 | — |
| T208 | S12 | FH3 | 109 | ○ | ○ | 120 | 72 | ○ | 18.7 | 539 | 669 | — |
| T209 | S12 | F4 | 114 | ○ | — | 38 | 22 | ○ | 22.8 | 572 | 715 | — |
| T210 | S12 | F5 | 113 | ○ | — | 52 | 34 | — | 22.0 | 569 | 710 | 0.19 |
| T211 | S13 | E1 | 124 | ○ | ○ | 24 | 16 | — | 12.9 | 588 | 696 | — |
| T212 | S14 | EH1, E2 | 110 | ○ | ○ | 106 | 80 | — | 11.5 | 536 | 638 | 0.44 |
| T213 | S14 | E1 | 116 | ○ | — | 22 | 16 | — | 14.9 | 584 | 700 | 0.07 |
| T214 | S15 | FH3 | 109 | ○ | — | 130 | 80 | ○ | 11.8 | 541 | 644 | 0.49 |
| T215 | S15 | F4 | 114 | ○ | — | 44 | 28 | ○ | 15.6 | 581 | 699 | 0.16 |
| T216 | S15 | F5 | 114 | ○ | — | 52 | 34 | — | 15.3 | 580 | 697 | 0.18 |
| T217 | S16 | E1 | 118 | ○ | ○ | 52 | 34 | — | 13.1 | 575 | 684 | — |
| T218 | S17-1 | EH1, E2 | 112 | ○ | ○ | 112 | 78 | ○ | 8.8 | 550 | 639 | — |
| T219 | S17-2 | E1 | 124 | ○ | — | 50 | 32 | — | 12.3 | 578 | 684 | — |
| T220 | S18 | E1 | 112 | ○ | ○ | 60 | 40 | — | 20.3 | 557 | 692 | — |
| T221 | S19 | E1 | 114 | ○ | ○ | 66 | 44 | — | 14.5 | 572 | 686 | 0.16 |
| T222 | S20 | EH1 | 109 | ○ | ○ | 122 | 72 | — | 11.9 | 544 | 647 | — |
| T223 | S20 | E1 | 114 | ○ | — | 64 | 42 | — | 13.6 | 578 | 689 | — |

TABLE 43

| | | | Wear Resistance | | Cavitation | Erosion- | Erosion- |
|---|---|---|---|---|---|---|---|
| Test No. | Alloy No. | Step No. | Amsler Abrasion Test | Ball-On-Disk Abrasion Test | Resistance (Decrease in Weight) (g) | Corrosion Resistance 1 (Decrease in Weight) (mg) | Corrosion Resistance 2 (Decrease in Weight) (mg) |
| T201 | S11 | EH1 | | | — | — | — |
| T202 | S11 | E1 | | | 0.0010 | 27 | 22 |

TABLE 43-continued

| Test No. | Alloy No. | Step No. | Wear Resistance: Amsler Abrasion Test | Wear Resistance: Ball-On-Disk Abrasion Test | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|---|
| T203 | S11 | EH1 | | | 0.0040 | 56 | 46 |
| T204 | S11 | F1 | | | 0.0010 | 27 | 24 |
| T205 | S11 | F2 | | | — | — | — |
| T206 | S11 | F3 | | | — | — | — |
| T207 | S11 | FH2 | | | — | — | — |
| T208 | S12 | FH3 | | | 0.0080 | 126 | 84 |
| T209 | S12 | F4 | | | 0.0050 | 90 | 62 |
| T210 | S12 | F5 | | | — | — | — |
| T211 | S13 | E1 | | | — | 58 | 41 |
| T212 | S14 | EH1, E2 | | | 0.0050 | 102 | 69 |
| T213 | S14 | E1 | | | 0.0020 | 63 | 45 |
| T214 | S15 | FH3 | | | 0.0050 | 67 | 48 |
| T215 | S15 | F4 | | | 0.0010 | 34 | 28 |
| T216 | S15 | F5 | | | 0.0020 | 35 | 29 |
| T217 | S16 | E1 | | | 0.0010 | 27 | 23 |
| T218 | S17-1 | EH1, E2 | ◎ | Δ | — | 62 | 48 |
| T219 | S17-2 | E1 | ◎ | ○ | 0.0010 | 25 | 21 |
| T220 | S18 | E1 | | | 0.0060 | 98 | 72 |
| T221 | S19 | E1 | | | 0.0020 | 71 | 52 |
| T222 | S20 | EH1 | | | — | — | — |
| T223 | S20 | E1 | | | 0.0020 | | |

TABLE 44

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of δ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T224 | S20 | F1 | 55.7 | 1.2 | 0 | 0 | 98.8 | 100 | 1.2 | 65.1 | 24 | 0 | ○ | 0.69 | 0.14 |
| T225 | S21 | EH1 | 41.0 | 5.5 | 0 | 0 | 94.5 | 100 | 5.5 | 57.1 | 90 | 0 | x | 0.52 | 0.12 |
| T226 | S21 | E1 | 52.4 | 1.2 | 0 | 0 | 98.8 | 100 | 1.2 | 61.6 | 36 | 0 | ○ | 0.65 | 0.12 |
| T227 | S22 | EH1, E2 | 42.0 | 5.8 | 0.5 | 0 | 93.7 | 99.5 | 5.8 | 58.5 | 80 | 0 | x | 0.35 | 0.12 |
| T228 | S22 | E1 | 54.8 | 0.8 | 0 | 0 | 99.2 | 100 | 0.8 | 62.9 | 30 | 0 | ○ | 0.46 | 0.12 |
| T229 | S23 | E1 | 31.0 | 1.1 | 0 | 0 | 98.9 | 100 | 1.1 | 38.8 | 46 | 0 | Δ | 0.41 | 0.09 |
| T230 | S24 | E1 | 41.8 | 1.7 | 0 | 0 | 98.3 | 100 | 1.7 | 51.7 | 38 | 0 | ○ | 0.38 | 0.15 |
| T231 | S25 | F1 | 49.5 | 0.8 | 0 | 0 | 99.2 | 100 | 0.8 | 57.4 | 28 | 0 | ○ | 0.53 | 0.08 |
| T232 | S26 | E1 | 54.3 | 0.7 | 0 | 0 | 99.3 | 100 | 0.7 | 62.0 | 24 | 0 | ○ | 0.68 | 0.18 |
| T233 | S27 | EH1 | 46.2 | 5.4 | 0 | 0 | 94.6 | 100 | 5.4 | 62.5 | 90 | 0 | x | 0.62 | 0.11 |
| T234 | S27 | E1 | 60.8 | 1.2 | 0 | 0 | 98.8 | 100 | 1.2 | 70.4 | 22 | 0 | ○ | 0.77 | 0.11 |
| T251 | S31 | EH1 | 39.5 | 5.3 | 0 | 0 | 94.7 | 100 | 5.3 | 55.3 | 90 | 0 | x | 0.47 | 0.09 |
| T252 | S31 | E1 | 51.2 | 0.8 | 0 | 0 | 99.2 | 100 | 0.8 | 59.1 | 30 | 0 | ○ | 0.60 | 0.09 |
| T253 | S31 | FH1 | 39.4 | 4.9 | 0 | 0 | 95.1 | 100 | 4.9 | 54.7 | 84 | 0 | x | 0.48 | 0.09 |
| T254 | S31 | F1 | 52.0 | 0.4 | 0 | 0 | 99.6 | 100 | 0.4 | 58.4 | 22 | 0 | ○ | 0.61 | 0.09 |
| T255 | S31 | F2 | 51.5 | 0.8 | 0 | 0 | 99.2 | 100 | 0.8 | 59.4 | 36 | 0 | ○ | 0.60 | 0.09 |
| T256 | S31 | F3 | 51.4 | 0.6 | 0 | 0 | 99.4 | 100 | 0.6 | 58.6 | 30 | 0 | ○ | 0.60 | 0.09 |
| T257 | S31 | FH2 | 51.3 | 0.8 | 0 | 2.0 | 97.2 | 100 | 2.8 | 60.2 | 36 | 30 | ○ | 0.61 | 0.09 |
| T258 | S32 | FH3 | 43.6 | 5.3 | 0 | 0 | 94.7 | 100 | 5.3 | 59.6 | 80 | 0 | x | 0.42 | 0.13 |
| T259 | S32 | F4 | 51.4 | 0.6 | 0 | 0 | 99.4 | 100 | 0.6 | 58.6 | 22 | 0 | ○ | 0.54 | 0.13 |
| T260 | S32 | F5 | 51.0 | 0.8 | 0 | 0 | 99.2 | 100 | 0.8 | 58.9 | 34 | 0 | ○ | 0.53 | 0.13 |
| T261 | S33 | E1 | 55.5 | 1.1 | 0 | 0 | 98.9 | 100 | 1.1 | 64.6 | 34 | 0 | ○ | 0.50 | 0.09 |
| T262 | S34 | E1 | 57.2 | 0.1 | 0 | 0 | 99.9 | 100 | 0.1 | 62.0 | 22 | 0 | ○ | 0.42 | 0.11 |

TABLE 45

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T224 | S20 | F1 | 114 | ○ | — | 46 | 30 | ○ | 14.1 | 579 | 692 | 0.22 |
| T225 | S21 | EH1 | 110 | ○ | ○ | 122 | 72 | — | 11.9 | 541 | 644 | — |
| T226 | S21 | E1 | 114 | ○ | — | 58 | 36 | — | 15.4 | 576 | 693 | 0.18 |
| T227 | S22 | EH1, E2 | 106 | ○ | ○ | 126 | 84 | — | 8.6 | 534 | 622 | 0.78 |
| T228 | S22 | E1 | 112 | ○ | — | 46 | 28 | — | 15.1 | 574 | 690 | 0.22 |

TABLE 45-continued

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T229 | S23 | E1 | 123 | ○ | — | 78 | 48 | — | 32.1 | 546 | 716 | 0.27 |
| T230 | S24 | E1 | 114 | ○ | ○ | 74 | 46 | — | 22.2 | 563 | 704 | 0.27 |
| T231 | S25 | F1 | 113 | ○ | — | 50 | 36 | ○ | 18.7 | 588 | 717 | 0.15 |
| T232 | S26 | E1 | 113 | ○ | — | 36 | 24 | — | 13.8 | 582 | 694 | 0.15 |
| T233 | S27 | EH1 | 109 | ○ | ○ | 120 | 100 | — | 8.6 | 549 | 637 | — |
| T234 | S27 | E1 | 119 | ○ | — | 46 | 26 | — | 12.4 | 578 | 683 | 0.21 |
| T251 | S31 | EH1 | 107 | ○ | ○ | 120 | 74 | ○ | 12.9 | 546 | 654 | 0.46 |
| T252 | S31 | E1 | 113 | ○ | — | 42 | 24 | ○ | 16.5 | 583 | 705 | 0.15 |
| T253 | S31 | FH1 | 109 | ○ | — | 118 | 66 | — | 13.3 | 549 | 659 | 0.42 |
| T254 | S31 | F1 | 114 | ○ | — | 30 | 18 | — | 17.5 | 586 | 712 | 0.11 |
| T255 | S31 | F2 | 113 | ○ | — | 48 | 32 | — | 16.8 | 583 | 706 | — |
| T256 | S31 | F3 | 114 | ○ | — | 42 | 26 | — | 17.2 | 585 | 709 | 0.13 |
| T257 | S31 | FH2 | 113 | ○ | — | 96 | 60 | — | 13.6 | 559 | 669 | 0.40 |
| T258 | S32 | FH3 | 107 | ○ | ○ | 118 | 70 | — | 13.8 | 551 | 662 | 0.47 |
| T259 | S32 | F4 | 112 | ○ | — | 34 | 22 | — | 18.5 | 596 | 725 | 0.14 |
| T260 | S32 | F5 | 112 | ○ | — | 48 | 30 | ○ | 18.2 | 594 | 722 | — |
| T261 | S33 | E1 | 112 | ○ | — | 48 | 24 | — | 15.7 | 571 | 690 | 0.19 |
| T262 | S34 | E1 | 117 | ○ | — | 28 | 18 | — | 15.4 | 585 | 703 | 0.07 |

TABLE 46

| Test No. | Alloy No. | Step No. | Wear Resistance: Amsler Abrasion Test | Wear Resistance: Ball-On-Disk Abrasion Test | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|---|
| T224 | S20 | F1 | | | — | 33 | 24 |
| T225 | S21 | EH1 | | | — | — | — |
| T226 | S21 | E1 | | | 0.0020 | 37 | 30 |
| T227 | S22 | EH1, E2 | ◎ | Δ | 0.0050 | 122 | 106 |
| T228 | S22 | E1 | | | 0.0020 | 80 | 56 |
| T229 | S23 | E1 | ○ | ◎ | — | 93 | 65 |
| T230 | S24 | E1 | ◎ | ◎ | 0.0050 | 102 | 72 |
| T231 | S25 | F1 | | | 0.0030 | 68 | 45 |
| T232 | S26 | E1 | | | 0.0020 | 33 | 28 |
| T233 | S27 | EH1 | | | — | 51 | 36 |
| T234 | S27 | E1 | | | — | 26 | 22 |
| T251 | S31 | EH1 | | | 0.0050 | 95 | 64 |
| T252 | S31 | E1 | | | 0.0020 | 45 | 35 |
| T253 | S31 | FH1 | | | 0.0050 | 92 | 62 |
| T254 | S31 | F1 | | | 0.0020 | 42 | 33 |
| T255 | S31 | F2 | | | — | 45 | 35 |
| T256 | S31 | F3 | | | 0.0020 | 43 | 34 |
| T257 | S31 | FH2 | | | 0.0040 | — | — |
| T258 | S32 | FH3 | | | 0.0050 | 98 | 65 |
| T259 | S32 | F4 | | | 0.0020 | 58 | 41 |
| T260 | S32 | F5 | | | — | — | 42 |
| T261 | S33 | E1 | | | 0.0020 | 67 | 48 |
| T262 | S34 | E1 | | | 0.0020 | 92 | 61 |

TABLE 47

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T301 | S51 | EH1 | 27.2 | 7.8 | 0 | 0 | 92.2 | 100 | 7.8 | 45.3 | 150 Or more | 0 | x | 0.34 | 0.13 |
| T302 | S51 | E1 | 33.3 | 2.8 | 0 | 0 | 97.2 | 100 | 2.8 | 45.0 | 62 | 0 | ○ | 0.44 | 0.13 |
| T303 | S52 | EH1 | 26.0 | 7.9 | 0 | 0 | 92.1 | 100 | 7.9 | 44.2 | 150 or more | 0 | x | 0.48 | 0.10 |
| T304 | S52 | E1 | 34.0 | 2.5 | 0 | 0 | 97.5 | 100 | 2.5 | 45.2 | 60 | 0 | ○ | 0.63 | 0.10 |
| T305 | S53 | E1, E3 | 63.0 | 0 | 0 | 0 | 100 | 100 | 0 | 66.2 | 0 | 0 | ○ | 0.49 | 0.13 |
| T306 | S54 | E1, E3 | 68.3 | 0.1 | 0 | 0 | 99.9 | 100 | 0.1 | 73.6 | 14 | 0 | ○ | 0.51 | 0.12 |

TABLE 47-continued

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T307 | S55 | EH1 | 21.0 | 4.9 | 0 | 0 | 95.1 | 100 | 4.9 | 35.3 | 100 | 0 | x | 0.36 | 0.17 |
| T308 | S55 | E1, E3 | 27.0 | 2.1 | 0 | 0 | 97.9 | 100 | 2.1 | 37.0 | 46 | 0 | x | 0.42 | 0.17 |
| T309 | S56 | F1 | 31.1 | 0.2 | 0 | 0 | 99.8 | 100 | 0.2 | 35.3 | 26 | 0 | Δ | 0.46 | 0.14 |
| T310 | S57 | EH1 | 36.0 | 5.5 | 6.0 | 0 | 88.5 | 94.0 | 5.5 | 51.9 | 80 | 0 | x | 0.47 | 0.13 |
| T311 | S57 | E1, E3 | 52.2 | 1.5 | 1.5 | 0 | 97.0 | 98.5 | 1.5 | 62.2 | 46 | 0 | ○ | 0.56 | 0.12 |
| T312 | S58 | F1 | 34.0 | 0.1 | 0 | 0 | 99.9 | 100 | 0.1 | 37.6 | 24 | 0 | Δ | 0.49 | 0.10 |
| T313 | S59 | E1 | 60.8 | 1.7 | 0 | 0 | 98.3 | 100 | 1.7 | 71.7 | 48 | 0 | ○ | 0.88 | 0.13 |
| T314 | S60 | FH1 | 23.2 | 5.4 | 0 | 0 | 94.6 | 100 | 5.4 | 38.3 | 90 | 0 | x | 0.30 | 0.12 |
| T315 | S60 | F1 | 29.5 | 1.2 | 0 | 0 | 98.8 | 100 | 1.2 | 37.5 | 44 | 0 | Δ | 0.38 | 0.12 |
| T316 | S61 | E1, E3 | 52.0 | 1.1 | 0 | 0 | 98.9 | 100 | 1.1 | 60.9 | 46 | 0 | ○ | 0.45 | 0.22 |
| T317 | S62 | E1 | 58.5 | 0.7 | 0 | 0 | 99.3 | 100 | 0.7 | 66.4 | 42 | 0 | ○ | 0.66 | 0.08 |
| T318 | S63 | E1 | 36.8 | 1.0 | 0 | 0 | 99.0 | 100 | 1.0 | 44.6 | 36 | 0 | ○ | 0.41 | 0.20 |
| T319 | S64 | E1 | 39.2 | 1.6 | 0 | 0 | 98.4 | 100 | 1.6 | 48.7 | 54 | 0 | ○ | 0.64 | 0.10 |
| T320 | S65 | E1 | 50.0 | 3.2 | 0 | 0 | 96.8 | 100 | 3.2 | 63.2 | 70 | 0 | ○ | 0.37 | 0.12 |

TABLE 48

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T301 | S51 | EH1 | 102 | ○ | ○ | 120 | 74 | ○ | 15.4 | 491 | 609 | 0.46 |
| T302 | S51 | E1 | 108 | ○ | — | 100 | 62 | — | 20.3 | 540 | 675 | 0.43 |
| T303 | S52 | EH1 | 105 | ○ | ○ | 120 | 74 | ○ | 15.5 | 494 | 612 | — |
| T304 | S52 | E1 | 106 | ○ | — | 96 | 60 | — | 22.0 | 563 | 704 | — |
| T305 | S53 | E1, E3 | 124 | Δ | ▲ | 18 | 12 | — | 13.3 | 591 | 700 | — |
| T306 | S54 | E1, E3 | 128 | Δ | ○ | 18 | 14 | — | 11.7 | 598 | 701 | — |
| T307 | S55 | EH1 | 119 | ○ | ○ | 120 | 74 | ○ | 27.4 | 520 | 677 | 0.46 |
| T308 | S55 | E1, E3 | 124 | ○ | — | 86 | 54 | — | 28.8 | 532 | 693 | — |
| T309 | S56 | F1 | 130 | Δ | ▲ | 36 | 24 | — | 35.9 | 553 | 733 | — |
| T310 | S57 | EH1 | 117 | ○ | Δ | 166 | 94 | x | 9.2 | 495 | 586 | 3.29 |
| T311 | S57 | E1, E3 | 113 | ○ | — | 104 | 74 | Δ | 12.6 | 555 | 661 | 1.09 |
| T312 | S58 | F1 | 131 | Δ | ▲ | 32 | 22 | — | 33.1 | 570 | 743 | — |
| T313 | S59 | E1 | 124 | ○ | ○ | 92 | 58 | — | 10.0 | 558 | 653 | — |
| T314 | S60 | FH1 | 116 | ○ | ○ | 124 | 74 | ○ | 24.8 | 507 | 656 | — |
| T315 | S60 | F1 | 123 | Δ | — | 76 | 44 | — | 26.9 | 539 | 695 | — |
| T316 | S61 | E1, E3 | 113 | ○ | ○ | 70 | 48 | — | 11.9 | 552 | 655 | — |
| T317 | S62 | E1 | 119 | ○ | ○ | 70 | 46 | — | 13.4 | 563 | 673 | 0.15 |
| T318 | S63 | E1 | 118 | ○ | ○ | 68 | 44 | — | 22.8 | 536 | 679 | — |
| T319 | S64 | E1 | 114 | ○ | — | 80 | 62 | — | 20.5 | 558 | 694 | — |
| T320 | S65 | E1 | 108 | ○ | Δ | 102 | 72 | — | 11.5 | 538 | 639 | — |

45

TABLE 49

| Test No. | Alloy No. | Step No. | Wear Resistance: Amsler Abrasion Test | Wear Resistance: Ball-On-Disk Abrasion Test | Cavitation Resistance (Decrease in Weight) (g) | Erosion-Corrosion Resistance 1 (Decrease in Weight) (mg) | Erosion-Corrosion Resistance 2 (Decrease in Weight) (mg) | Note |
|---|---|---|---|---|---|---|---|---|
| T301 | S51 | EH1 | | | 0.0090 | 127 | 83 | |
| T302 | S51 | E1 | | | 0.0070 | 99 | 64 | |
| T303 | S52 | EH1 | | | 0.0090 | 91 | 71 | |
| T304 | S52 | E1 | | | 0.0060 | 58 | 44 | |
| T305 | S53 | E1, E3 | | | 0.0010 | 78 | 60 | Cracked when extruded |
| T306 | S54 | E1, E3 | ○ | Δ | — | 68 | 47 | |
| T307 | S55 | EH1 | | | 0.0110 | 115 | 80 | |
| T308 | S55 | E1, E3 | Δ | Δ | 0.0090 | 101 | 72 | |
| T309 | S56 | F1 | | | 0.0080 | 92 | 72 | Cracked when extruded |
| T310 | S57 | EH1 | | | 0.0060 | — | — | |
| T311 | S57 | E1, E3 | ○ | Δ | 0.0040 | 96 | 77 | |

TABLE 49-continued

| Test No. | Alloy No. | Step No. | Wear Resistance: Amsler Abrasion Test | Wear Resistance: Ball-On-Disk Abrasion Test | Cavitation Resistance (Decrease in Weight) (g) | Erosion-Corrosion Resistance 1 (Decrease in Weight) (mg) | Erosion-Corrosion Resistance 2 (Decrease in Weight) (mg) | Note |
|---|---|---|---|---|---|---|---|---|
| T312 | S58 | F1 | | | 0.0070 | 71 | 49 | Cracked when extruded |
| T313 | S59 | E1 | | | 0.0010 | 36 | 25 | |
| T314 | S60 | FH1 | | | 0.0100 | 147 | 95 | |
| T315 | S60 | F1 | | | 0.0080 | 108 | 72 | |
| T316 | S61 | E1, E3 | Δ | Δ | 0.0030 | 100 | 67 | |
| T317 | S62 | E1 | | | — | 68 | 70 | |
| T318 | S63 | E1 | | | 0.0070 | 120 | 82 | |
| T319 | S64 | E1 | | | 0.0050 | — | — | |
| T320 | S65 | E1 | | | 0.0040 | 118 | 80 | |

TABLE 50

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T321 | S66 | F1 | 47.2 | 0.1 | 0 | 0 | 99.9 | 100 | 0.1 | 49.1 | 16 | 0 | ○ | 0.27 | 0.13 |
| T322 | S67 | E1 | 30.1 | 1.5 | 0 | 0 | 98.5 | 100 | 1.5 | 37.4 | 44 | 0 | Δ | 0.37 | 0.13 |
| T323 | S68 | EH1, E2 | 29.8 | 1.8 | 0 | 0 | 98.2 | 100 | 1.8 | 37.9 | 40 | 0 | x | 0.08 | 0.09 |
| T324 | S68 | E1 | 35.2 | 0.1 | 0 | 0 | 99.9 | 100 | 0.1 | 37.1 | 14 | 0 | Δ | 0.09 | 0.08 |
| T325 | S69 | EH1 | 33.0 | 7.2 | 1.0 | 0 | 91.8 | 99.0 | 7.2 | 50.7 | 150 or more | 0 | x | 0.52 | 0.12 |
| T326 | S69 | E1 | 43.8 | 2.2 | 0 | 0 | 97.6 | 100 | 2.2 | 54.8 | 56 | 0 | ○ | 0.66 | 0.12 |
| T327 | S70 | EH1 | 30.3 | 3.7 | 0 | 0 | 96.3 | 100 | 3.7 | 43.4 | 86 | 0 | x | 0.47 | 0.10 |
| T328 | S70 | F1 | 38.8 | 0.1 | 0 | 0 | 99.9 | 100 | 0.1 | 42.6 | 22 | 0 | Δ | 0.58 | 0.10 |
| T329 | S71 | FH1 | 33.3 | 7.8 | 0 | 0 | 92.2 | 100 | 7.8 | 51.7 | 150 or more | 0 | x | 0.53 | 0.08 |
| T330 | S71 | F1 | 45.0 | 2.9 | 0 | 0 | 97.1 | 100 | 2.9 | 57.5 | 56 | 0 | ○ | 0.67 | 0.08 |
| T331 | S72 | E1, E3 | 23.2 | 0.2 | 0 | 0 | 99.8 | 100 | 0.2 | 25.9 | 22 | 0 | x | 0.12 | 0.12 |
| T332 | S73 | E1, E3 | 34.2 | 0.2 | 0 | 0 | 99.8 | 100 | 0.2 | 36.9 | 26 | 0 | Δ | 0.04 | 0.00 |
| T333 | S74 | E1 | 39.5 | 0.0 | 0 | 0 | 100 | 100 | 0 | 41.5 | 34 | 0 | ○ | 0.05 | 0.04 |
| T334 | S75 | E1 | 32.0 | 0.8 | 0 | 0 | 99.2 | 100 | 0.8 | 39.0 | 36 | 0 | Δ | 0.40 | 0.10 |
| T335 | S76 | F1 | 67.0 | 0.3 | 0 | 0 | 99.7 | 100 | 0.3 | 73.6 | 20 | 0 | ○ | 0.60 | 0.12 |
| T336 | S77 | EH1, E2 | 36.6 | 5.2 | 0 | 0 | 94.8 | 100 | 5.2 | 52.2 | 88 | 0 | x | 0.39 | 0.05 |
| T337 | S77 | E1, E3 | 46.9 | 0.8 | 0 | 0 | 99.2 | 100 | 0.8 | 54.6 | 26 | 0 | ○ | 0.50 | 0.05 |
| T338 | S78 | E1 | 59.0 | 0.6 | 0 | 0 | 99.4 | 100 | 0.6 | 66.6 | 44 | 0 | ○ | 0.75 | 0.07 |
| T339 | S79 | E1 | 30.4 | 1.1 | 0 | 0 | 98.9 | 100 | 1.1 | 38.2 | 48 | 0 | Δ | 0.44 | 0.11 |
| T340 | S80 | E1 | 39.5 | 0.0 | 0 | 0 | 100 | 100 | 0 | 41.5 | 0 | 0 | ○ | 0.05 | 0.04 |
| T341 | S81 | EH1 | 43.0 | 6.7 | 0 | 0 | 93.3 | 100 | 6.7 | 60.7 | 150 or more | 0 | x | 0.53 | 0.15 |
| T342 | S81 | E1 | 56.5 | 1.2 | 0 | 0 | 98.8 | 100 | 1.2 | 65.9 | 48 | 0 | ○ | 0.69 | 0.15 |
| T343 | S82 | E1 | 57.9 | 1.3 | 0 | 0 | 98.7 | 100 | 1.3 | 67.6 | 50 | 0 | ○ | 0.67 | 0.14 |

TABLE 51

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T321 | S66 | F1 | 115 | ○ | — | 30 | 20 | — | 23.9 | 578 | 725 | 0.08 |
| T322 | S67 | E1 | 118 | ○ | — | 92 | 54 | — | 28.6 | 538 | 698 | 0.27 |
| T323 | S68 | EH1, E2 | 125 | ○ | ○ | 100 | 66 | ○ | 29.8 | 550 | 714 | — |
| T324 | S68 | E1 | 128 | ○ | — | 60 | 38 | ○ | 32.8 | 555 | 727 | 0.14 |
| T325 | S69 | EH1 | 103 | ○ | ○ | 132 | 88 | — | 11.3 | 471 | 572 | 1.20 |
| T326 | S69 | E1 | 110 | ○ | — | 102 | 62 | ○ | 19.4 | 566 | 699 | — |
| T327 | S70 | EH1 | 117 | ○ | ▲ | 118 | 72 | — | 19.0 | 547 | 678 | — |
| T328 | S70 | F1 | 127 | Δ | — | 32 | 22 | — | 28.8 | 577 | 738 | — |
| T329 | S71 | FH1 | 104 | ○ | ○ | 134 | 90 | — | 7.8 | 510 | 594 | — |
| T330 | S71 | F1 | 108 | ○ | — | 98 | 64 | — | 13.6 | 549 | 659 | — |
| T331 | S72 | E1, E3 | 134 | Δ | ▲ | 60 | 42 | ○ | 52.2 | 524 | 741 | 0.15 |
| T332 | S73 | E1, E3 | 127 | ○ | — | 90 | 60 | — | 34.2 | 554 | 729 | 0.12 |

TABLE 51-continued

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | Strength Index | 150° C. Creep Strain (%) |
|---|---|---|---|---|---|---|---|---|---|---|---|---|
| T333 | S74 | E1 | 125 | ○ | ○ | 86 | 62 | — | 26.7 | 573 | 728 | — |
| T334 | S75 | E1 | 130 | Δ | — | 52 | 48 | — | 35.9 | 554 | 733 | 0.15 |
| T335 | S76 | F1 | 127 | Δ | ○ | 28 | 18 | — | 11.7 | 596 | 698 | — |
| T336 | S77 | EH1, E2 | 108 | ○ | ○ | 118 | 76 | ○ | 16.6 | 547 | 670 | 0.45 |
| T337 | S77 | E1, E3 | 113 | ○ | — | 86 | 54 | — | 20.0 | 584 | 718 | 0.15 |
| T338 | S78 | E1 | 120 | ○ | ○ | 82 | 48 | — | 12.4 | 565 | 670 | 0.17 |
| T339 | S79 | E1 | 129 | Δ | — | 88 | 52 | — | 26.1 | 531 | 684 | 0.27 |
| T340 | S80 | E1 | 124 | ○ | ○ | 88 | 60 | — | 27.9 | 558 | 717 | — |
| T341 | S81 | EH1 | 115 | ○ | ○ | 122 | 72 | — | 10.0 | 522 | 617 | — |
| T342 | S81 | E1 | 128 | ○ | — | 86 | 56 | — | 11.7 | 562 | 665 | — |
| T343 | S82 | E1 | 117 | ○ | — | 90 | 60 | — | 11.9 | 555 | 659 | — |

TABLE 52

| | | | Wear Resistance | | Cavitation | Erosion-Corrosion | Erosion-Corrosion | |
|---|---|---|---|---|---|---|---|---|
| Test No. | Alloy No. | Step No. | Amsler Abrasion Test | Ball-On-Disk Abrasion Test | Resistance (Decrease in Weight) (g) | Resistance 1 (Decrease in weight) (mg) | Resistance 2 (Decrease in Weight) (mg) | Note |
| T321 | S66 | F1 | | | — | 171 | 117 | |
| T322 | S67 | E1 | | | 0.0080 | 112 | 78 | |
| T323 | S68 | EH1, E2 | | | 0.0090 | 254 | 165 | |
| T324 | S68 | E1 | | | 0.0070 | 236 | 153 | |
| T325 | S69 | EH1 | | | — | 111 | 71 | |
| T326 | S69 | E1 | | | 0.0040 | 38 | 31 | |
| T327 | S70 | EH1 | | | 0.0080 | 100 | 66 | Cracked when extruded |
| T328 | S70 | F1 | | | 0.0050 | 50 | 38 | |
| T329 | S71 | FH1 | | | 0.0070 | — | — | |
| T330 | S71 | F1 | | | 0.0050 | — | — | |
| T331 | S72 | E1, E3 | Δ | Δ | 0.0070 | 224 | 152 | |
| T332 | S73 | E1, E3 | Δ | Δ | 0.0070 | 235 | 155 | |
| T333 | S74 | E1 | | | 0.0060 | 227 | 148 | |
| T334 | S75 | E1 | | | — | 105 | 74 | |
| T335 | S76 | F1 | | | — | 54 | 41 | |
| T336 | S77 | EH1, E2 | | | 0.0060 | 97 | 71 | |
| T337 | S77 | E1, E3 | | | 0.0040 | 85 | 60 | |
| T338 | S78 | E1 | | | — | 56 | 40 | |
| T339 | S79 | E1 | Δ | Δ | 0.0070 | 109 | 78 | |
| T340 | S80 | E1 | | | 0.0060 | 230 | 152 | |
| T341 | S81 | EH1 | | | — | — | — | |
| T342 | S81 | E1 | | | — | — | — | |
| T343 | S82 | E1 | | | — | — | — | |

The above-described experiment results are summarized as follows.

1) It was able to be verified that, by satisfying the composition according to the embodiment, the composition relational expressions f1, f2, and f3, the requirements of the metallographic structure, and the metallographic structure relational expressions f4 to f7, excellent machinability can be obtained with addition of a small amount of Pb, and a hot extruded material or a hot forged material having excellent hot workability, excellent corrosion resistance in a strict environment, cavitation resistance, erosion-corrosion resistance, and a high strength and having impact resistance, high temperature properties, wear resistance, and a high strength index can be obtained (for example, Alloys No. S01, S02, S03 and S11 to S26).

2) It was able to be verified that addition of Sb and As further improves corrosion resistance under strict conditions (Alloys No. S31 to S34).

3) It was able to be verified that the cutting resistance further deteriorates due to addition of Bi (Alloys No. S31 to S33).

4) When the Cu content was low, machinability was excellent. However, corrosion resistance, impact resistance, and high temperature properties deteriorated. Conversely, when the Cu content was high, machinability and hot workability deteriorated (for example, Alloys No. S51, S23, S17, S53).

5) When the Sn content was higher than 0.84 mass %, the area ratio of γ phase was higher than 2%. Therefore, cavitation resistance and erosion-corrosion resistance were excellent, but impact resistance and strength index deteriorated. On the other hand, when the Sn content was lower than 0.36 mass %, cavitation resistance and erosion-corrosion resistance deteriorated (Alloys No. S59, S66 to S68, S73, and S74).

6) When the P content was high, impact resistance deteriorated. On the other hand, when the P content was low, the dezincification corrosion depth in a strict environment was large (Alloys No. S02, S03, S26, S61, S73, S74, and S78).

7) It was able to be verified that, even if inevitable impurities are contained to the extent contained in alloys manufactured in the actual production, there is not much influence on the properties (Alloys No. S01, S02, and S03). It was verified that, in Tests No. T65, T81, T95, and T104 (for example, Alloy No. S02/Steps No. A4, B1, D3, and E2), mainly, the area ratio of an intermetallic compound of Si and Fe was about 0.1%.

8) When Fe was added such that the content thereof was outside of the composition according to the embodiment but higher than the limit of the inevitable impurities, an intermetallic compound of Fe and Si or an intermetallic compound of Fe and P was formed, and machinability slightly deteriorated (Alloys No. S79 and S81).

9) When the value of the composition relational expression f1 was 74.4 or higher or 74.6 or higher and was 78.2 or lower or 77.8 or lower, the proportion of γ phase was 2% or lower even with addition of 0.36 to 0.84% of Sn, and thus machinability, corrosion resistance, strength, impact resistance, high temperature properties, cavitation resistance, and erosion-corrosion resistance were good (for example, Alloys No. S01 to S03 S11 to S27 and Steps No. E1 and F1).

10) When the value of the composition relational expression f2 was low, the amount of γ phase increased, and machinability was excellent. However, high-temperature hot workability, corrosion resistance, impact resistance, and high temperature properties deteriorated. When the value of the composition relational expression f2 was high, hot workability deteriorated, and there was a problem in hot extrusion. In addition, machinability deteriorated, and the amount of γ phase having a long length of a long side increased (Alloys No. S01, S53, S56 to S58, S65, and S70).

11) When the area ratio of γ phase in the metallographic structure was higher than 2%, or the length of the long side of γ phase was longer than 50 μm, machinability was excellent, but corrosion resistance, impact resistance, high temperature properties, tensile strength, and strength index deteriorated. In particular, when the area ratio of γ phase was high, the selective corrosion of γ phase in the dezincification corrosion test in a strict environment occurred (Alloys No. S01 and Steps No. AH1, AH2, AH6, C0, DH1, DH5, EH1, E1, FH1, and E2). In addition, cavitation resistance and erosion-corrosion resistance also deteriorated. When the area ratio of γ phase was 1.5% or lower and further 0.8% or lower and the length of the long side of γ phase was 40 μm or less and further 30 μm or less, corrosion resistance, cavitation resistance, erosion-corrosion resistance, impact resistance, high temperature properties, tensile strength, and strength index were further improved (Alloys No. S01 to S03 and S11 to S27).

When the area ratio of μ phase was higher than 2%, corrosion resistance, impact resistance, high temperature properties, and strength index deteriorated. In the dezincification corrosion test in a strict environment, grain boundary corrosion or selective corrosion of μ phase occurred (Alloy No. S01 and Steps No. AH4, AH8, and BH3). In addition, cavitation resistance and erosion-corrosion resistance also slightly deteriorated. When the area ratio of μ phase was 1.0% or lower and further 0.5% or lower and the length of the long side of μ phase was 15 μm or less and further 5 μm or less, corrosion resistance, impact resistance, high temperature properties, tensile strength, and strength index were further improved (Alloys No. S01 to S03).

When the area ratio of β phase was higher than 0.3%, corrosion resistance, cavitation resistance, erosion-corrosion resistance, impact resistance, high temperature properties, and wear resistance were further improved (Alloys No. S22 and S57).

When the area ratio of κ phase was higher than 65%, machinability, impact resistance, and hot workability deteriorated. On the other hand, when the area ratio of κ phase was lower than 30%, machinability, cavitation resistance, erosion-corrosion resistance, and wear resistance deteriorated (Alloys No. S76 and S60 and Step No. F1).

When κ phase was present in α phase and the amount of κ phase present in α phase increased, strength, strength index, wear resistance, machinability, cavitation resistance, and erosion-corrosion resistance were improved (Alloys No. S55, S23, S24, S67, and S03 and Steps No. AH1, AH2, A1, and A6). When acicular κ phase was not present, wear resistance deteriorated (Alloy No. S55).

12) When the value of the metallographic structure relational expression f6=(γ)+(μ) was higher than 3%, or the value of f4=(α)+(κ) was lower than 96.5%, corrosion resistance, impact resistance, and high temperature properties deteriorated (Alloys No. S65, S69, and S71).

When the value of the metallographic structure relational expression $f7=1.05(\kappa)+6x(\gamma)^{1/2}+0.5x(\mu)$ was higher than 72, machinability deteriorated (Alloy No. S54).

When the area ratio of γ phase was higher than 2%, cutting resistance was low and the shapes of many chips were also excellent irrespective of the value of the metallographic structure relational expression f7 (for example, Alloys No. S51, S52, and S71).

13) When the amount of Sn in κ phase was lower than 0.4 mass %, cavitation resistance and erosion-corrosion resistance deteriorated. Even when the Sn content in the alloy was 0.36% or higher and further 0.4% or higher, cavitation resistance and erosion-corrosion resistance deteriorated in some cases. (Alloys No. S51, S55, S56, S60, and the like)

When β phase and μ phase were present, cavitation resistance and erosion-corrosion resistance deteriorated under substantially the same Sn concentration in κ phase (Alloys No. S12 and S57 and Steps A1 and AH4).

Even when the Sn contents in the alloys were the same, the Sn concentration in κ phase largely varies depending on the proportion of γ phase, and there was a large difference in the decrease (erosion-corrosion resistance) in the erosion-corrosion resistance test (for example, Steps No. AH1 and A1 of Alloys No. S01, S02, and S03 and Steps No. EH1 and E1 of Alloys No. S14 and S22).

Erosion-corrosion resistance is affected by f1, f2, f3, and whether or not acicular κ phase was present in a phase, but it is presumed that erosion-corrosion resistance substantially depends on the Sn concentration in κ phase. A Sn concentration of about 0.4% to 0.55% in κ phase is presumed to be a critical amount of Sn (Alloys No. S01 to S03 and S11 to S27).

In addition, when the proportions of κ phase were substantially the same, when the Sn concentration in κ phase was low, cutting resistance was high (for example, Alloys No. S73 and S23).

When f3=P/Sn was higher than 0.35, cavitation resistance and erosion-corrosion resistance deteriorated (Alloys No. S61 and S63). When f3 was lower than 0.09, impact resistance deteriorated (Alloy No. S78).

Wear resistance was tested using two kinds of methods. When the proportion of κ phase was high or when the proportion of γ phase or μ phase was high, wear resistance was slightly poor when tested using a ball-on-disk method. When the proportion of κ phase was high, wear resistance was slightly good when tested using an Amsler method. When the proportions of the respective phases were in the ranges defined by the embodiment, the good results were obtained (Alloys No. S01, S02, S03, S24, S54, and S57 and Steps No. C0, C1, and CH1).

14) When the requirements of the composition and the requirements of the metallographic structure were satisfied, the tensile strength was 540 N/mm$^2$ or higher, and the creep strain after holding the material at 150° C. for 100 hours in a state where 0.2% proof stress at room temperature was applied was 0.4% or lower and was 0.3% or lower in most parts (for example, Alloys No. S01, S02, and 503).

15) When the requirements of the composition and the requirements of the metallographic structure were satisfied, the Charpy impact test value was 12 J/cm$^2$ or higher. In addition, when cold working was not performed, the Charpy impact test value was 14 J/cm$^2$ or higher in most parts. When the length of the long side of μ phase that was not able to be observed at a microscopic magnification was long, impact resistance deteriorated (Alloy No. S01 and Steps No. A3, A4, and AH3).

16) In the evaluation of the materials using the mass-production facility and the materials prepared in the laboratory, substantially the same results were obtained (Alloys No. S01 and S02 and Steps No. F1 and E1).

In all the materials extruded at 580° C., flaky cracks were formed on the surface. Therefore, extrusion was not able to be performed to the end, and thus the evaluation was stopped. When a laboratory extrusion facility was used, flaky cracks were formed on some alloys, and thus extrusion was not able to be performed up to a sufficient length as compared to an alloy having an excellent surface state. However, after removing defects portions, the evaluation progressed.

17) Regarding manufacturing conditions, any one of the following test 1) to 3) was performed.

1) Hot working was performed at a hot working temperature of 600° C. to 740° C., a heat treatment was performed on the hot worked material at 510° C. to 575° C. for 20 minutes to 480 minutes, and cooling was performed in a temperature range from 470° C. to 380° C. at an average cooling rate of higher than 2.5° C./min and lower than 600° C./min.

2) A heat treatment was performed at 620° C. or lower, cooling was performed in a temperature range from 575° C. to 510° C. at an average cooling rate of 2.5° C./min, and cooling was performed in a temperature range from 470° C. to 380° C. at an average cooling rate of higher than 2.5° C./min and lower than 600° C./min.

3) After forging, cooling was performed in a temperature range from 575° C. to 510° C. at an average cooling rate of 2.5° C./min, and cooling was performed in a temperature range from 470° C. to 380° C. at an average cooling rate of higher than 2.5° C./min and lower than 600° C./min.

In either case, it was able to be verified that a hot forged material or a hot extruded material having excellent corrosion resistance in a strict environment, cavitation resistance, and erosion-corrosion resistance and having excellent strength, strength index, impact resistance, and high temperature properties was obtained. Even when a continuously cast rod was used as a material for forging, a forged product having excellent properties was obtained (Alloy No. S01 and Steps No. A1 to A9, D1 to D7, and F1 to F5).

When the expression $(T-500)\times t$ (wherein when T was 540° C. or higher, T was set as 540) substantially representing a relationship between the heat treatment time (t) and the heat treatment temperature (T) was 800 or higher and further 1200 or higher, a material having excellent properties was obtained (Steps No. A5 to A9). This calculation expression is also applicable to a heat treatment in a continuous heat treatment method.

18) It was able to be verified that, during low-temperature annealing after cold working or hot working, when a heat treatment was performed under conditions of temperature: 240° C. to 340° C., heating time: 10 minutes to 300 minutes, and $150 \leq (T-220)\times(t)^{1/2} \leq 1200$ (where the heating temperature is represented by TOC and the heating time is represented by t min), a cold worked material or a hot worked material having excellent corrosion resistance in a strict environment, cavitation resistance, and erosion-corrosion resistance and having excellent impact resistance and high temperature properties was obtained (Alloy No. S01 and Steps No. B1 to B3).

When a cold working step was performed at a working ratio of 4% to 10% (heat treatment after cold drawing or cold drawing after heat treatment), the tensile strength was improved by 40 N/mm$^2$ or more, and the strength index was significantly improved as compared to an original extruded material or a material on which cold working was not performed. When a heat treatment was performed at 510° C. to 575° C. after cold working, both tensile strength and impact resistance were improved as compared to a hot extruded material (Alloy No. S01 and Steps No. AH1, AH2, A1, and A10 to A12).

19) In Test No. T18 (Alloy No. S01 and Step No. AH9) and Test No. T60 (Alloy No. S02 and Step No. AH9), small flaky cracks were formed on the surface, sufficient extrusion was not able to be performed, and then the evaluation was stopped.

In addition, in Test No. T25 (Alloy No. S01 and Step No. BH1) and Test No. T84 (Alloy No. S02 and Step No. BH1), correction was insufficient, low-temperature annealing was inappropriate, and there was a problem in quality.

As described above, in the alloy according to the embodiment in which the contents of the respective additive elements, the respective composition relational expressions, the metallographic structure, and the respective metallographic structure relational expressions are in the appropriate ranges, hot workability (hot extrusion, hot forging) is excellent, and corrosion resistance and machinability are also excellent. In addition, the alloy according to the embodiment can obtain excellent properties by adjusting the manufacturing conditions in hot extrusion and hot forging and the conditions in the heat treatment so that they fall in the appropriate ranges.

Example 2

Regarding an alloy according to Comparative Example of the embodiment, a Cu—Zn—Si copper alloy casting (Test No. T401/Alloy No. S101) which had been used in a harsh water environment for 8 years was prepared. There was no detailed data on the water quality of the environment where the casting had been used and the like. Using the same method as in Example 1, the composition and the metallographic structure of Test No. T401 were analyzed. In addition, a corroded state of a cross-section was observed using the metallographic microscope. Specifically, the sample was embedded in a phenol resin material such that the exposed surface was maintained to be perpendicular to the longitudinal direction. Next, the sample was cut such that a cross-section of a corroded portion was obtained as the longest cut portion. Next, the sample was polished. The cross-section was observed using the metallographic microscope. In addition, the maximum corrosion depth was measured.

Next, a similar alloy casting was prepared with the same composition and under the same preparation conditions of Test No. T401 (Test No. T402/Alloy No. S102). Regarding the similar alloy casting (Test No. T402), the analysis of the composition and the metallographic structure, the evaluation (measurement) of the mechanical properties and the like, and the dezincification corrosion tests 1 to 3 were performed as described in Example 1. By comparing the corrosion of Test No. T401 which developed in actual water environment and that of Test No. T402 in the accelerated tests of the dezincification corrosion tests 1 to 3 to each other, the appropriateness of the accelerated tests of the dezincification corrosion tests 1 to 3 was verified.

In addition, by comparing the evaluation result (corroded state) of the dezincification corrosion test 1 of the alloy according to the embodiment described in Example 1 (Test No. T88/Alloy No. S02/Step No. C1) and the corroded state of Test No. T401 or the evaluation result (corroded state) of the dezincification corrosion test 1 of Test No. T402 to each other, the corrosion resistance of Test No. T88 was examined.

Test No. T402 was prepared using the following method.

Raw materials were dissolved to obtain substantially the same composition as that of Test No. T401 (Alloy No. S101), and the melt was cast into a mold having an inner diameterϕ of 40 mm at a casting temperature of 1000° C. to prepare a casting. Next, the casting was cooled in the temperature range of 575° C. to 510° C. at an average cooling rate of about 20° C./min, and subsequently was cooled in the temperature range from 470° C. to 380° C. at an average cooling rate of about 15° C./min. As a result, a sample of Test No. T402 was prepared.

The analysis method of the composition and the metallographic structure, the measurement method of the mechanical properties and the like, and the methods of the dezincification corrosion tests 1 to 3 were as described in Example 1.

The obtained results are shown in Tables 53 to 55 and FIGS. 4A to 4C.

TABLE 53

| Alloy | Component Composition (mass %) | | | | | | | Composition Relational Expression | | |
|---|---|---|---|---|---|---|---|---|---|---|
| No. | Cu | Si | Pb | Sn | P | Others | Zn | f1 | f2 | f3 |
| S101 | 75.4 | 3.01 | 0.037 | 0.01 | 0.04 | Fe: 0.02, Ni: 0.01, Ag: 0.02 | Balance | 77.8 | 62.1 | 4.0 |
| S102 | 75.4 | 3.01 | 0.033 | 0.01 | 0.04 | Fe: 0.02, Ni: 0.02, Ag: 0.02 | Balance | 77.8 | 62.1 | 4.0 |

TABLE 54

| Test No. | Alloy No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|
| T401 | S101 | 27.4 | 3.9 | 0 | 0 | 96.1 | 100 | 3.9 | 40.6 | 110 | 0 | x | 0.01 | 0.06 |
| T402 | S102 | 28.0 | 3.8 | 0 | 0 | 96.2 | 100 | 3.8 | 41.1 | 120 | 0 | x | 0.01 | 0.06 |

TABLE 55

| Test No. | Alloy No. | Maximum Corrosion Depth (μm) | Corrosion Test 1 (μm) | Corrosion Test 2 (μm) | Corrosion Test 3 (ISO 6509) | 150° C. Creep Strain (%) |
|---|---|---|---|---|---|---|
| T401 | S101 | 138 | | | | |
| T402 | S102 | | 146 | 102 | ○ | 0.46 |

In the copper alloy casting used in a harsh water environment for 8 years (Test No. T401), at least the contents of Sn and P were out of the ranges of the embodiment.

FIG. 4A shows a metallographic micrograph of the cross-section of Test No. T401.

Test No. T401 was used in a harsh water environment for 8 years, and the maximum corrosion depth of corrosion caused by the use environment was 138 μm.

In a surface of a corroded portion, dezincification corrosion occurred irrespective of whether it was α phase or κ phase (average depth of about 100 μm from the surface).

In the corroded portion where α phase and κ phase were corroded, more solid α phase was present at deeper locations.

The corrosion depth of α phase and κ phase was uneven without being uniform. Roughly, corrosion occurred only in γ phase from a boundary portion of α phase and κ phase to the inside (a depth of about 40 m from the corroded boundary between α phase and κ phase towards the inside: local corrosion of only γ phase)

FIG. 4B shows a metallographic micrograph of a cross-section of Test No. T402 after the dezincification corrosion test 1.

The maximum corrosion depth was 146 μm

In a surface of a corroded portion, dezincification corrosion occurred irrespective of whether it was α phase or κ phase (average depth of about 100 μm from the surface).

In the corroded portion, more solid α phase was present at deeper locations.

The corrosion depth of α phase and κ phase was uneven without being uniform. Roughly, corrosion occurred only in γ phase from a boundary portion of α phase and κ phase to the inside (the length of corrosion that locally occurred only to γ phase from the corroded boundary between α phase and κ phase was about 45 μm).

It was found that the corrosion shown in FIG. 4A occurred in the harsh water environment for 8 years and the corrosion shown in FIG. 4B occurred in the dezincification corrosion test 1 were substantially the same in terms of corrosion form. In addition, because the amount of Sn and the amount of P did not fall within the ranges of the embodiment, both α phase and κ phase were corroded in a portion in contact with water or the test solution, and γ phase was selectively corroded here and there at deepest point of the corroded portion. The Sn concentration and the P concentration in κ phase were low.

The maximum corrosion depth of Test No. T401 was slightly less than the maximum corrosion depth of Test No. T402 in the dezincification corrosion test 1. However, the maximum corrosion depth of Test No. T401 was slightly more than the maximum corrosion depth of Test No. T402 in the dezincification corrosion test 2. Although the degree of corrosion in the actual water environment is affected by the water quality, the results of the dezincification corrosion tests 1 and 2 substantially matched the corrosion result in the actual water environment regarding both corrosion form and corrosion depth. Accordingly, it was found that the conditions of the dezincification corrosion tests 1 and 2 are appropriate and the evaluation results obtained in the dezincification corrosion tests 1 and 2 are substantially the same as the corrosion result in the actual water environment.

In addition, the acceleration rates of the accelerated tests of the dezincification corrosion tests 1 and 2 substantially matched that of the corrosion in the actual harsh water environment. This presumably shows that the dezincification corrosion tests 1 and 2 simulated a harsh environment.

The result of Test No. T402 in the dezincification corrosion test 3 (the dezincification corrosion test according to ISO6509) was "0" (good). Therefore, the result of the dezincification corrosion test 3 did not match the corrosion result in the actual water environment.

The test time of the dezincification corrosion test 1 was 2 months, and the dezincification corrosion test 1 was an about 75 to 100 times accelerated test. The test time of the dezincification corrosion test 2 was 3 months, and the dezincification corrosion test 2 was an about 30 to 50 times accelerated test. On the other hand, the test time of the dezincification corrosion test 3 (dezincification corrosion test according to ISO 6509) was 24 hours, and the dezincification corrosion test 3 was an about 1000 times or more accelerated test.

It is presumed that, by performing the test for a long period of time of 2 or 3 months using the test solution close to the actual water environment as in the dezincification corrosion tests 1 and 2, substantially the same evaluation results as the corrosion result in the actual water environment were obtained.

In particular, in the corrosion result of Test No. T401 in the harsh water environment for 8 years, or in the corrosion results of Test No. T402 in the dezincification corrosion tests 1 and 2, not only α phase and κ phase on the surface but also γ phase were corroded. However, in the corrosion result of the dezincification corrosion test 3 (dezincification corrosion test according to ISO 6509), substantially no γ phase was corroded. Therefore, it is presumed that, in the dezincification corrosion test 3 (dezincification corrosion test according to ISO 6509), the corrosion of α phase and κ phase on the surface and the corrosion of γ phase were not able to be appropriately evaluated, and the evaluation result did not match the corrosion result in the actual water environment.

Figure 4:
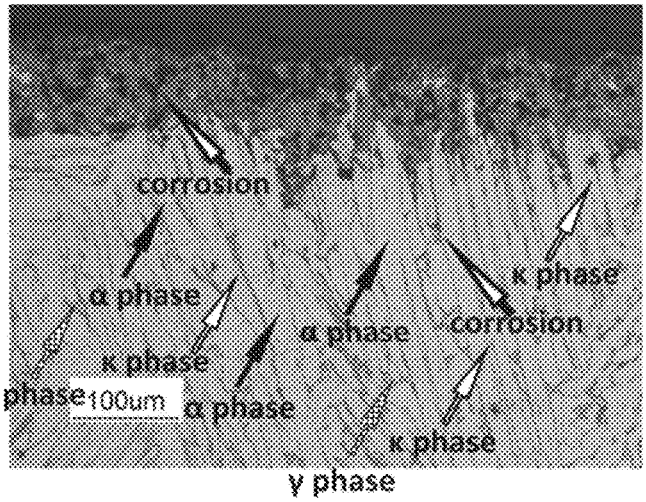
FIG. 4A is a metallographic micrograph of a cross-section of the alloy of Test No. T401 according to Example 2 after use in a harsh water environment for 8 years.
FIG. 4B is a metallographic micrograph of a cross-section of the alloy of Test No. T402 after dezincification corrosion test 1.
FIG. 4C is a metallographic micrograph of a cross-section of the alloy of Test No. T88 after dezincification corrosion test 1.
Figure 4:
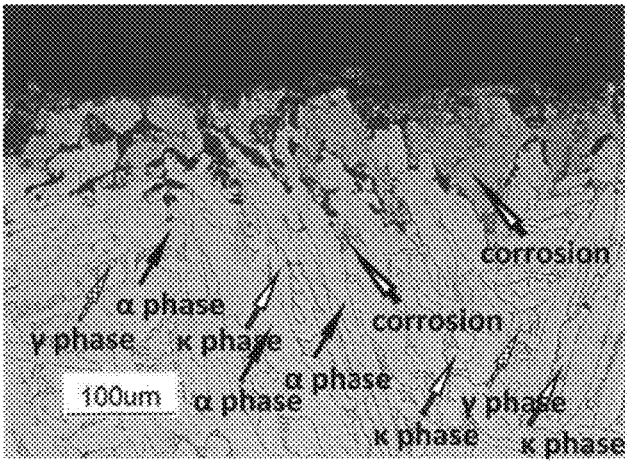
Figure 4:
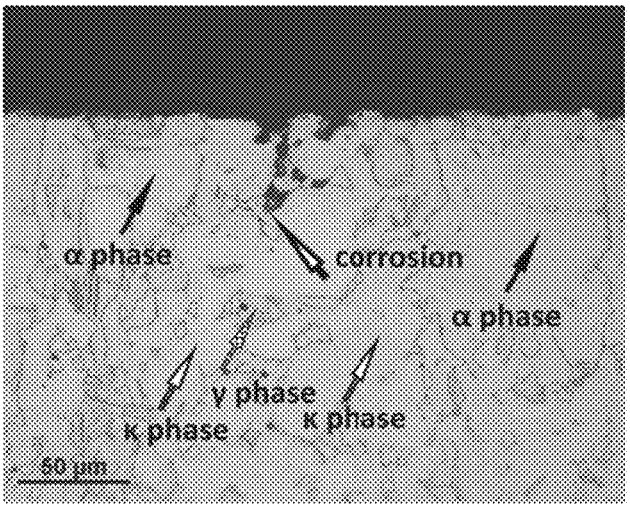

FIG. 4(*c*) shows a metallographic micrograph of a cross-section of Test No. T88 (Alloy No. S02/Step No. C1) after the dezincification corrosion test 1.

In the vicinity of the surface, only γ phase exposed to the surface was corroded. α phase and κ phase were solid (were not corroded). In Test No. T88, it is presumed that, in addition to the amount of γ phase, the length of the long side of γ phase is one of the large factors that determine the corrosion depth.

In can be seen that, in the Test No. T88 according to the embodiment shown in FIG. 4(*c*), the corrosion of a phase and κ phase in the vicinity of the surface did not occur or was significantly suppressed as compared to Tests No. T401 and T402 shown in FIGS. 4(*a*) and 4(*b*). Based on the observation result of the corrosion form, the reason for this is presumed to be that the Sn content in κ phase reached 0.68% and corrosion resistance of κ phase was high.

INDUSTRIAL APPLICABILITY

The free-cutting copper alloy according to the present invention has excellent hot workability (hot extrudability and hot forgeability) and excellent corrosion resistance and machinability. Therefore, the free-cutting copper alloy according to the present invention is suitable for devices such as faucets, valves, or fittings for drinking water consumed by a person or an animal every day, in members for electrical uses, automobiles, machines and industrial plumbing such as valves, or fittings, or in devices and components that come in contact with liquid.

Specifically, the free-cutting copper alloy according to the present invention is suitable to be applied as a material that composes faucet fittings, water mixing faucet fittings, drainage fittings, faucet bodies, water heater components, EcoCute components, hose fittings, sprinklers, water meters, water shut-off valves, fire hydrants, hose nipples, water supply and drainage cocks, pumps, headers, pressure reducing valves, valve seats, gate valves, valves, valve stems, unions, flanges, branch faucets, water faucet valves, ball valves, various other valves, and fittings for plumbing, through which drinking water, drained water, or industrial water flows, for example, components called elbows, sockets, bends, connectors, adaptors, tees, or joints.

In addition, the free-cutting copper alloy according to the present invention is suitable for solenoid valves, control valves, various valves, radiator components, oil cooler components, and cylinders used as automobile components, and is suitable for pipe fittings, valves, valve stems, heat exchanger components, water supply and drainage cocks, cylinders, or pumps used as mechanical members, and is suitable for pipe fittings, valves, or valve stems used as industrial plumbing members.

The invention claimed is:

1. A free-cutting copper alloy worked material that is obtained by performing any one or both of cold working and hot working, the free-cutting copper alloy worked material comprising:

76.0 mass % to 79.0 mass % of Cu;

3.1 mass % to 3.6 mass % of Si;

0.36 mass % to 0.84 mass % of Sn;

0.06 mass % to 0.14 mass % of P;

0.022 mass % to 0.10 mass % of Pb; and a balance including Zn and inevitable impurities, wherein a total amount of Fe, Mn, Co, and Cr as the inevitable impurities is lower than 0.08 mass %, when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$74.4 \leq f1 = [Cu] + 0.8 \times [Si] - 8.5 \times [Sn] + [P] + 0.5 \times [Pb] \leq 78.2,$$

$$61.2 \leq f2 = [Cu] - 4.4 \times [Si] - 0.7 \times [Sn] - [P] + 0.5 \times [Pb] \leq 62.8,$$

and $$0.09 \leq f3 = [P]/[Sn] \leq 0.35$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$30 \leq (\kappa) \leq 65,$$

$$0 \leq (\kappa) \leq 2.0,$$

$$0 \leq (\beta) \leq 0.3,$$

$$0(\mu) \leq 2.0,$$

$$96.5 \leq f4 = (\alpha) + (\kappa),$$

$$99.4 \leq f5 = (\alpha) + (\kappa) + (\gamma) + (\mu),$$

$$0 \leq f6 = (\gamma) + (\mu) \leq 3.0, \text{ and}$$

$$36 \leq f7 = 1.05 \times (\kappa) + 6 \times (\gamma)^{1/2+} 0.5 \times (\mu) \leq 72$$

are satisfied,

κ phase is present in α phase, a length of a long side of γ phase is 40 μm or less, and a length of a long side of μ phase is 15 μm or less.

2. The free-cutting copper alloy worked material according to claim 1, further comprising:

one or more element(s) selected from the group consisting of 0.02 mass % to 0.08 mass % of Sb, 0.02 mass % to 0.08 mass % of As, and 0.02 mass % to 0.20 mass % of Bi.

3. A free-cutting copper alloy worked material that is obtained by performing any one or both of cold working and hot working, the free-cutting copper alloy worked material comprising:

76.5 mass % to 78.7 mass % of Cu;

3.15 mass % to 3.55 mass % of Si;

0.41 mass % to 0.78 mass % of Sn;

0.06 mass % to 0.13 mass % of P;

0.023 mass % to 0.07 mass % of Pb; and a balance including Zn and inevitable impurities, wherein a total amount of Fe, Mn, Co, and Cr as the inevitable impurities is lower than 0.08 mass %, when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$74.6 \leq f1 = [Cu] + 0.8 \times [Si] - 8.5 \times [Sn] + [P] + 0.5 \times [Pb] \leq 77.8,$$

$$61.42 \leq f2 [Cu] - 4.4 \times [Si] - 0.7 \times [Sn] - [P] + 0.5 \times [Pb] 62.6, \text{ and}$$

$$0.1 \leq f3 = [P]/[Sn] \leq 0.3$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$33 \leq (\kappa) \leq 62,$$

$$0(\gamma) \leq 1.5,$$

$$0 \leq (\gamma) \leq 0.2,$$

$$0 \leq (\mu) \leq 1.0,$$

$$97.5 \leq f4 = (\alpha) + (\kappa),$$

$$99.6 f5 = (\alpha) + (\kappa) + (\kappa) + (\mu),$$

$$0 \leq f6 = (\gamma) + (\mu) \leq 2.0, \text{ and}$$

$$40 \leq f7 = 1.05 \times (\kappa) + 6 \times (\gamma)^{1/2} + 0.5 \times (\mu) \leq 70$$

are satisfied,

κ phase is present in α phase, a length of a long side of γ phase is 40 μm or less, and a length of a long side of μ phase is 15 μm or less.

4. The free-cutting copper alloy worked material according to claim 3, further comprising:

one or more element(s) selected from the group consisting of 0.02 mass % to 0.07 mass % of Sb, 0.02 mass % to 0.07 mass % of As, and 0.02 mass % to 0.10 mass % of Bi.

5. The free-cutting copper alloy worked material according to claim 1, wherein the amount of Sn in κ phase is 0.40 mass % to 0.85 mass %, and the amount of P in κ phase is 0.07 mass % to 0.22 mass %.

6. The free-cutting copper alloy worked material according to claim 1, wherein a Charpy impact test value is 12 J/cm$^2$ to 45 J/cm$^2$, a tensile strength is 540 N/mm$^2$ or higher, and a creep strain after holding the material at 150° C. for 100 hours in a state where a load corresponding to 0.2% proof stress at room temperature is applied is 0.4% or lower.

7. The free-cutting copper alloy worked material according to claim 1, that is used in a device for water supply, an industrial plumbing member, a device that comes in contact with liquid, or an automobile component that comes in contact with liquid.

8. A method of manufacturing the free-cutting copper alloy worked material according to claim 1, the method comprising:

any one or both of a cold working step and a hot working step; and an annealing step that is performed after the cold working step or the hot working step, wherein in the annealing step, the material is held at a temperature of 510° C. to 575° C. for 20 minutes to 8 hours or is cooled in a temperature range from 575° C. to 510° C. at an average cooling rate of 0.1° C./min to 2.5° C./min, and subsequently the material is cooled in a temperature range from 470° C. to 380° C. at an average cooling rate of higher than 3° C./min and lower than 500° C./min.

9. A method of manufacturing the free-cutting copper alloy worked material according to claim 1, the method comprising:

a hot working step, wherein the material's temperature during hot working is 600° C. to 740° C., wherein when hot extrusion is performed as the hot working, the material is cooled in a temperature range from 470° C. to 380° C. at an average cooling rate of higher than 3° C./min and lower than 500° C./min in the process of cooling, and wherein when hot forging is performed as the hot working, the material is cooled in a temperature range from 575° C. to 510° C. at an average cooling rate of 0.1° C./min to 2.5° C./min and subsequently is cooled in a temperature range from 470° C. to 380° C. at an average cooling rate of higher than 3° C./min and lower than 500° C./min in the process of cooling.

10. A method of manufacturing the free-cutting copper alloy worked material according to claim 1, the method comprising:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C.;

the heating time is in a range of 10 minutes to 300 minutes; and when the material's temperature is represented by T° C. and the heating time is represented by t min, $150 \leq (T-220) \times (t)^{1/2} \leq 1200$ is satisfied.

11. The free-cutting copper alloy worked material according to claim 2, wherein the amount of Sn in κ phase is 0.40 mass % to 0.85 mass %, and the amount of P in κ phase is 0.07 mass % to 0.22 mass %.

12. The free-cutting copper alloy worked material according to claim 2, wherein a Charpy impact test value is 12 J/cm$^2$ to 45 J/cm$^2$, a tensile strength is 540 N/mm$^2$ or higher, and a creep strain after holding the material at 150° C. for 100 hours in a state where a load corresponding to 0.2% proof stress at room temperature is applied is 0.4% or lower.

13. The free-cutting copper alloy worked material according to claim 2, that is used in a device for water supply, an industrial plumbing member, a device that comes in contact with liquid, or an automobile component that comes in contact with liquid.

14. The method of manufacturing a free-cutting copper alloy worked material according to claim 8, wherein the manufactured free-cutting copper alloy worked material further comprises:

one or more element(s) selected from the group consisting of 0.02 mass % to 0.08 mass % of Sb, 0.02 mass % to 0.08 mass % of As, and 0.02 mass % to 0.20 mass % of Bi.

15. The method of manufacturing a free-cutting copper alloy worked material according to claim 9, wherein the manufactured free-cutting copper alloy worked material further comprises:

one or more element(s) selected from the group consisting of 0.02 mass % to 0.08 mass % of Sb, 0.02 mass % to 0.08 mass % of As, and 0.02 mass % to 0.20 mass % of Bi.

16. The method of manufacturing a free-cutting copper alloy worked material according to claim 10, wherein the manufactured free-cutting copper alloy worked material further comprises:

one or more element(s) selected from the group consisting of 0.02 mass % to 0.08 mass % of Sb, 0.02 mass % to 0.08 mass % of As, and 0.02 mass % to 0.20 mass % of Bi.

* * * * *